US009975012B2

(12) United States Patent
Sanchez et al.

(10) Patent No.: US 9,975,012 B2
(45) **Date of Patent: *May 22, 2018**

(54) METAL WOOD CLUB

(71) Applicant: Acushnet Company, Fairhaven, MA (US)

(72) Inventors: Richard Sanchez, Temecula, CA (US); Thomas Orrin Bennett, Carlsbad, CA (US); David S. Cornelius, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/660,483

(22) Filed: Jul. 26, 2017

(65) Prior Publication Data

US 2017/0319918 A1 Nov. 9, 2017

Related U.S. Application Data

(60) Division of application No. 15/154,692, filed on May 13, 2016, which is a continuation-in-part of application No. 14/969,248, filed on Dec. 15, 2015, now Pat. No. 9,707,456, which is a continuation-in-part of application No. 14/966,316, filed on Dec. 11, 2015, now Pat. No. 9,750,992.

(51) Int. Cl.
*A63B 53/06* (2015.01)
*A63B 53/04* (2015.01)

(52) U.S. Cl.
CPC .. *A63B 53/0466* (2013.01); *A63B 2053/0433* (2013.01); *A63B 2053/0491* (2013.01); *A63B 2209/02* (2013.01)

(58) Field of Classification Search
CPC ..... A63B 53/0466; A63B 2209/02; A63B 2053/0491; A63B 2053/0433
See application file for complete search history.

(56) References Cited

U.S. PATENT DOCUMENTS

| | | | |
|---|---|---|---|
| 1,091,231 | A | 3/1914 | Millar |
| 1,096,359 | A | 5/1914 | Dwight |
| 1,133,129 | A | 3/1915 | Govan |
| 1,167,387 | A | 1/1916 | Daniel |
| 1,396,470 | A | 11/1921 | Taylor |
| 1,436,579 | A | 11/1922 | Dayton |
| 1,467,435 | A | 9/1923 | Kinnear |
| 1,575,364 | A | 3/1926 | Hodgkins |
| 1,840,924 | A | 1/1932 | Tucker |
| 2,041,676 | A | 5/1936 | Gallagher |
| 2,750,194 | A | 6/1956 | Clark |
| 3,064,980 | A | 11/1962 | Steiner |

(Continued)

OTHER PUBLICATIONS

U.S. Appl. No. 13/875,964, filed May 2, 2013, Bennett et al.

(Continued)

*Primary Examiner* — Stephen Blau
(74) *Attorney, Agent, or Firm* — Kevin N. McCoy

(57) ABSTRACT

A golf club head having a body having a first receptacle having ant aperture and a weight retention member affixed to the receptacle, the weight retention member having an opening, the weight retention member configured to receive a weighted insert, wherein at least a portion of the receptacle is located on the sole.

20 Claims, 85 Drawing Sheets

(56) References Cited

U.S. PATENT DOCUMENTS

| | | | |
|---|---|---|---|
| 3,606,327 | A | 9/1971 | Gorman |
| 3,794,328 | A | 2/1974 | Gordon |
| 3,897,066 | A | 7/1975 | Belmont |
| 3,979,123 | A | 9/1976 | Belmont |
| 4,052,075 | A | 10/1977 | Daly |
| 4,195,842 | A | 4/1980 | Coleman |
| 4,512,583 | A | 4/1985 | Vilmorin |
| D285,473 | S | 9/1986 | Flood |
| 4,732,389 | A | 3/1988 | Kobayashi |
| 4,754,977 | A | 7/1988 | Sahm |
| 4,811,949 | A | 3/1989 | Kobayashi |
| 4,869,507 | A | 9/1989 | Sahm |
| 4,944,515 | A | 7/1990 | Shearer |
| 5,028,049 | A | 7/1991 | McKeighen |
| 5,042,806 | A | 8/1991 | Helmstetter |
| 5,176,383 | A | 1/1993 | Duclos |
| D344,118 | S | 2/1994 | Lin |
| 5,447,309 | A | 9/1995 | Vincent |
| 5,484,155 | A | 1/1996 | Yamawaki et al. |
| 5,547,427 | A | 8/1996 | Rigal et al. |
| 5,570,886 | A | 11/1996 | Rigal et al. |
| 5,586,948 | A | 12/1996 | Mick |
| 5,797,807 | A | 8/1998 | Moore |
| 5,803,830 | A | 9/1998 | Austin et al. |
| 5,888,148 | A | 3/1999 | Allen |
| 5,989,134 | A | 11/1999 | Antonious |
| 6,074,310 | A | 6/2000 | Ota |
| 6,120,389 | A | 9/2000 | Kruse |
| 6,123,627 | A | 9/2000 | Antonious |
| D433,073 | S | 10/2000 | Sodano |
| 6,458,044 | B1 | 10/2002 | Vincent et al. |
| 6,471,601 | B1 | 10/2002 | McCabe et al. |
| D465,251 | S | 11/2002 | Wood et al. |
| 6,524,194 | B2 | 2/2003 | McCabe |
| D482,421 | S | 11/2003 | Kessler |
| 6,645,085 | B2 | 11/2003 | McCabe et al. |
| 6,648,772 | B2 | 11/2003 | Vincent et al. |
| 6,648,773 | B1 | 11/2003 | Evans |
| 6,811,496 | B2 | 11/2004 | Wahl et al. |
| D501,235 | S | 1/2005 | Imamoto |
| 6,890,269 | B2 | 5/2005 | Burrows |
| D514,184 | S | 1/2006 | Kawami |
| D519,178 | S | 4/2006 | Shimazaki |
| D527,434 | S | 8/2006 | Foster et al. |
| 7,121,956 | B2 | 10/2006 | Lo |
| D532,474 | S | 11/2006 | Bennett et al. |
| 7,140,977 | B2 | 11/2006 | Atkins, Sr. |
| 7,166,038 | B2 | 1/2007 | Williams et al. |
| 7,294,064 | B2 | 11/2007 | Tsurumaki et al. |
| 7,824,277 | B2 | 11/2010 | Bennett et al. |
| 7,927,231 | B2 | 4/2011 | Sato |
| 7,997,998 | B2 | 8/2011 | Bennett et al. |
| 8,523,702 | B2 | 9/2013 | Thomas |
| 8,540,587 | B2 | 9/2013 | Hirsch |
| 8,591,352 | B2 | 11/2013 | Hirano |
| 8,834,294 | B1 | 9/2014 | Seluga |
| 8,858,362 | B1 * | 10/2014 | Leposky ..... A63B 53/0466 473/334 |
| 8,956,244 | B1 | 2/2015 | Westrum |
| 9,067,110 | B1 | 6/2015 | Seluga |
| 9,333,390 | B1 | 5/2016 | Manwaring |
| 9,421,432 | B2 | 8/2016 | Galvan |
| 2002/0137576 | A1 | 9/2002 | Dammen |
| 2002/0160851 | A1 | 10/2002 | Liao |
| 2004/0192463 | A1 | 9/2004 | Tsurumaki et al. |
| 2005/0009622 | A1 | 1/2005 | Antonious |
| 2005/0096151 | A1 | 5/2005 | Hou et al. |
| 2006/0052181 | A1 | 3/2006 | Serrano et al. |
| 2007/0155533 | A1 | 7/2007 | Solheim et al. |
| 2011/0294595 | A1 | 12/2011 | Bennett |
| 2012/0165115 | A1 | 1/2012 | Matsunaga |
| 2013/0090185 | A1 | 4/2013 | Boyd et al. |
| 2013/0130829 | A1 | 5/2013 | Bennett |
| 2013/0244808 | A1 | 9/2013 | Bennett |
| 2014/0187346 | A1 | 7/2014 | Beno |
| 2014/0235369 | A1 | 8/2014 | Willett |
| 2015/0051012 | A1 | 2/2015 | Galvan |

OTHER PUBLICATIONS

U.S. Appl. No. 13/738,862, filed Jan. 10, 2013, Bennett et al.
U.S. Appl. No. 13/206,191, filed Aug. 9, 2011, Bennett et al.
U.S. Appl. No. 15/085,888, filed Mar. 30, 2016, Frame et al.
U.S. Appl. No. 15/186,054, filed Jun. 17, 2016, Murphy et al.
U.S. Appl. No. 15/339,692, filed Oct. 31, 2016, Cleghorn et al.

* cited by examiner

METAL WOOD CLUB

RELATED APPLICATIONS

The current application is a divisional of U.S. patent application Ser. No. 15/154,692, filed on May 13, 2016, currently pending, which is a continuation-in-part of U.S. patent application Ser. No. 14/969,248, Metal Wood Club, to Sanchez et al., filed on Dec. 15, 2015, now U.S. Pat. No. 9,707,456, which is a continuation-in-part of U.S. patent application Ser. No. 14/966,316, Metal Wood Club, to Knutson et al., filed on Dec. 11, 2015, currently pending, the disclosure of which are incorporated by reference in their entirety.

TECHNICAL FIELD

This present technology generally relates to systems, devices, and methods related to golf clubs, and more specifically to a wood-type golf club head with improved physical attributes.

DESCRIPTION OF THE RELATED TECHNOLOGY

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention relates primarily to hollow golf club heads, such as wood-type and utility-type (generally referred to herein as wood-type golf clubs).

Wood-type or metal-type golf club heads generally include a front or striking face, a crown, a sole and an arcuate skirt including a heel, a toe and a back. The crown and skirt are sometimes referred to as a shell. The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club is particularly important to the golf shot because it contacts and interacts with the ground during the swing.

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design and manufacture of wood-type club heads requires careful attention to club head construction. Among the many factors that must be considered are material selection, material treatment, structural integrity and overall geometrical design. Exemplary geometrical design considerations include loft, lie, face angle, horizontal face bulge, vertical face roll, face size, center of gravity, sole curvature, and overall head weight. The interior design of the club head may be tailored to achieve particular characteristics, such as by including hosel or shaft attachment means, perimeter weighting on the face or body of the club head, and fillers within hollow club heads. Club heads are typically formed from stainless steel, aluminum, or titanium and are cast, stamped, as by forming sheet metal with pressure, forged, or formed by a combination of any two or more of these processes.

The club heads may be formed from multiple pieces that are welded or otherwise joined together to form a hollow head, as is often the case of club heads designed with inserts, such as soleplates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face and hosel. As technology progressed, it became more desirable to increase the performance of the face of the club, usually by using a titanium material.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

Known methods to enhance the weight distribution of wood-type club heads to help reduce the club from being open upon contact with the ball usually include the addition of weights to the body casting itself or strategically adding a weight element at some point in the club. Many efforts have been made to incorporate weight elements into the wood-type club head. These weight elements are usually placed at specific locations, which will have a positive influence on the flight of the ball or to overcome a particular golfer's shortcomings.

The sole of the golf club is particularly important to the golf shot because it contacts and interacts with the ground during the golf shot. There are many sole configurations to optimize the performance of the club. Typically, the sole of the club is slightly curved such that when the club head is placed on the ground, the leading edge is located above the ground. The curvature toward the front of the club generally provides bounce. Bounce assists in preventing the club from digging into the ground and substantially slowing club head speed. The curvature toward the trailing edge generally prevents the club head from getting caught on the ground during the back swing.

The present invention is directed to an improved weighting system for wood-type golf clubs that increases the club's playability.

SUMMARY

The systems, methods, and devices described herein have innovative aspects, no single one of which is indispensable or solely responsible for their desirable attributes. Without limiting the scope of the claims, some of the advantageous features will now be summarized.

One non-limiting embodiment of the present technology includes a golf club head comprising a body having a face, a sole, a crown, and a skirt joining the face, sole and crown; a hollow golf club interior within the body; the body having a coordinate system with an x-axis located horizontal to the club face, a y-axis located vertical to the club face, and a z-axis located through the club face; the body having a center of gravity; wherein the body comprises a receptacle, the receptacle comprising an aperture; a weight retention system configured to receive a weighted insert, the weight retention system comprising a weight retention member affixed to the receptacle, the weight retention member comprising an opening on one end of the weight retention member configured to receive the weighted insert, at least a portion of the weight retention member extending through the first aperture into the hollow golf club interior; wherein the weighted insert comprises a heavy end and a lighter end, wherein the weight retention member is configured to receive the weighted insert in both a first configuration and a second configuration, wherein the first configuration comprises the heavy end of the weighted insert adjacent the opening of the weight retention member and the second configuration comprises the lighter end of the weighted insert adjacent the opening of the weight retention member; wherein at least a portion of the receptacle is located on the sole; wherein the weight retention member is permanently affixed to the receptacle; wherein the receptacle includes a pair of perimeter walls, each of the perimeter walls are substantially perpendicular to the sole adjacent the perimeter walls, the pair of perimeter walls separated by the aperture, the pair of perimeter walls substantially parallel to one another; wherein the receptacle includes a pair of shelves connecting the pair of perimeter walls at each end of the aperture, wherein the shelves are substantially curved, the pair of shelves recessed towards the hollow golf club head interior from the sole; wherein the weight retention member abuts the pair of perimeter walls and the pair of shelves; wherein a majority of the body, by weight, is formed from a first material having a first density; wherein the weight retention member is formed from a second material, the second material having a second density and wherein the second density is less than the first density.

An additional non-limiting embodiment of the present technology includes a golf club head comprising a body having a face, a sole, a crown, and a skirt joining the face, sole and crown; a hollow golf club interior within the body; the body having a coordinate system with an x-axis located horizontal to the club face, a y-axis located vertical to the club face, and a z-axis located through the club face; the body having a center of gravity; wherein the body comprises a receptacle, the receptacle comprising an aperture; a weight retention system configured to receive a weighted insert, the weight retention system comprising a weight retention member affixed to the receptacle, the weight retention member comprising an opening on one end of the weight retention member configured to receive the weighted insert; wherein at least a portion of the receptacle is located on the sole; wherein the weight retention member is permanently affixed to the receptacle; wherein the receptacle includes a pair of perimeter walls, each of the perimeter walls formed at an angle relative to the sole adjacent the receptacle, the pair of perimeter walls separated by the aperture; wherein the receptacle includes a pair of shelves connecting the pair of perimeter walls at each end of the aperture, the pair of shelves recessed towards the hollow golf club head interior from the sole; wherein the weight retention member abuts the pair of perimeter walls and the pair of shelves; wherein a majority of the body, by weight, is formed from a first material having a first density; wherein the weight retention member is formed from a second material, the second material having a second density and wherein the second density is less than the first density.

In an additional non-limiting embodiment of the present technology each of the perimeter walls are formed at an angle of at least 45 degrees relative to the sole adjacent the receptacle.

In an additional non-limiting embodiment of the present technology each of the perimeter walls are substantially perpendicular to the sole adjacent the receptacle.

In an additional non-limiting embodiment of the present technology at least a portion of the receptacle are located on the skirt.

In an additional non-limiting embodiment of the present technology at least a portion of the weight retention member extends through the aperture into the hollow golf club interior.

In an additional non-limiting embodiment of the present technology the weight retention member is formed of fiber reinforced plastic.

In an additional non-limiting embodiment of the present technology the weighted insert comprises a heavy end and a lighter end, wherein the weight retention member is configured to receive the weighted insert in both a first configuration and a second configuration, wherein the first configuration comprises the heavy end of the weighted insert adjacent the opening of the weight retention member and the second configuration comprises the lighter end of the weighted insert adjacent the opening of the weight retention member.

In an additional non-limiting embodiment of the present technology the weight retention system further comprises a head locking feature configured to lock the weighted insert in the weight retention system.

In an additional non-limiting embodiment of the present technology the weight retention member further comprises a pair of sidewalls, the pair of sidewalls substantially parallel to one another, the pair of sidewalls configured to abut the perimeter walls of the receptacle.

An additional non-limiting embodiment of the present technology includes a golf club head comprising a body having a face, a sole, a crown, and a skirt joining the face, sole and crown; a hollow golf club interior within the body; the body having a coordinate system with an x-axis located horizontal to the club face, a y-axis located vertical to the club face, and a z-axis located through the club face; the body having a center of gravity; wherein the body comprises a receptacle; a weight retention system configured to receive a weighted insert, the weight retention system comprising a weight retention member affixed to the receptacle, the weight retention member comprising an opening on one end of the weight retention member configured to receive the weighted insert; wherein the weighted insert comprises a heavy end and a lighter end, wherein the weight retention member is configured to receive the weighted insert in both a first configuration and a second configuration, wherein the first configuration comprises the heavy end of the weighted insert adjacent the opening of the weight retention member and the second configuration comprises the lighter end of the weighted insert adjacent the opening of the weight retention member; wherein the weight retention member is permanently affixed to the receptacle; wherein the receptacle includes a pair of perimeter walls, each of the perimeter walls formed at an angle relative to the sole; wherein the receptacle includes a pair of shelves connecting the pair of perimeter walls at each end of the receptacle, the pair of shelves recessed towards the hollow golf club head interior from the sole; wherein the weight retention member abuts the pair of perimeter walls and the pair of shelves; wherein a majority of the body, by weight, is formed from a first material having a first density; wherein the weight retention member is formed from a second material, the second material having a second density and wherein the second density is less than the first density.

In an additional non-limiting embodiment of the present technology each of the perimeter walls are formed at an angle of at least 45 degrees relative to the sole adjacent the receptacle.

In an additional non-limiting embodiment of the present technology each of the perimeter walls are substantially perpendicular to the sole adjacent the receptacle.

In an additional non-limiting embodiment of the present technology at least a portion of the receptacle are located on the skirt.

In an additional non-limiting embodiment of the present technology at least a portion of the weight retention member extends through the aperture into the hollow golf club interior.

In an additional non-limiting embodiment of the present technology the weight retention member is formed of fiber reinforced plastic.

In an additional non-limiting embodiment of the present technology the weight retention system further comprises a head locking feature configured to lock the weighted insert in the weight retention system.

In an additional non-limiting embodiment of the present technology the weight retention member further comprises a pair of sidewalls, the pair of sidewalls substantially parallel to one another, the pair of sidewalls configured to abut the perimeter walls of the receptacle.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

Preferred features of the present invention are disclosed in the accompanying drawings, wherein similar reference characters denote similar elements throughout the several views, and wherein.

DETAILED DESCRIPTION

Figure 1:
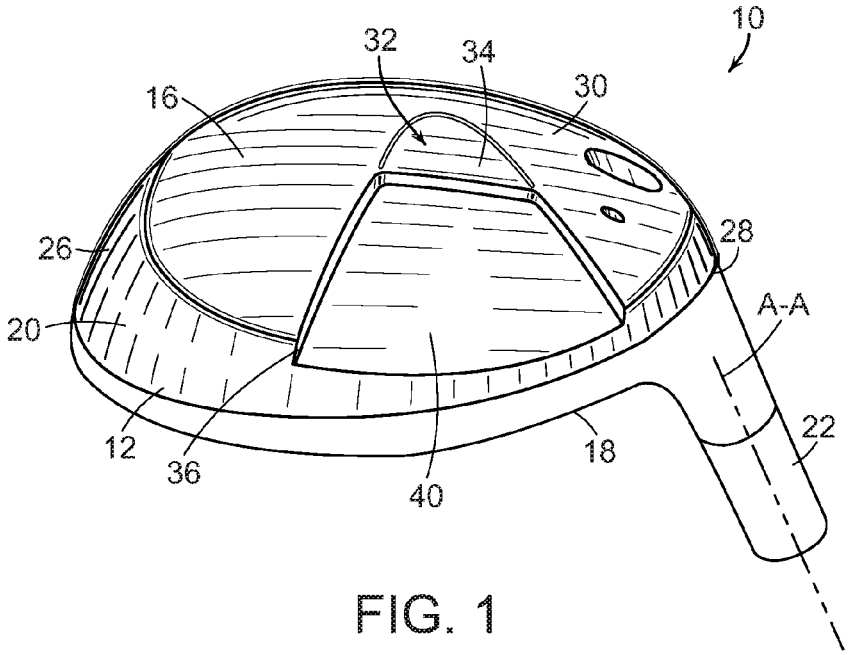
FIG. 1 is a perspective view of an embodiment of a club head of the present invention.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure FIG. 1 shows a golf club head 10 of the present invention. Club head 10 includes a body 12 having a strike face 14, a sole 16, a crown 18, a skirt 20 and a hosel 22. The body defines a hollow interior volume 24 (See FIGS. 4B-4D). Foam or other material may partially or completely fill the interior volume. Weights may be included within the interior volume. The face may be provided with grooves or score lines of varying design. The club head has a toe 26 and a heel 28.

A golf club shaft (not shown) is attached at hosel 22 and is disposed along a shaft axis A-A. The hosel 22 may extend to the bottom of the club head 10, may terminate at a location between the sole and crown portions 16 and 18 of the head 10, or the hosel 22 may terminate flush with the crown portion 26.

It is recommended that the inner volume 24 have a volume greater than 125 cubic centimeters, and more preferably greater than 175 cubic centimeters. Preferably, the mass of the inventive club head 10 is greater than 150 grams, but less than 220 grams; although the club head may have any suitable weight. The body 12 may be formed of sheets welded together or cast, preferably from steel, aluminum or titanium or any other suitable material or combination thereof.

The strike face 14 may be made by milling, casting, forging or stamping and forming. The face 14 may be made of any suitable material, including titanium, titanium alloy, carbon steel, stainless steel, beryllium copper, and other metals or composites. The face 14 may have any suitable thickness, and may be uniform or varied. As will be appreciated, the face 14 may be connected to the body 12 by any suitable means, including bonding and welding. Alternatively, the body 12 and face 14 may be cast simultaneously forming a homogeneous shell and eliminating the need to bond or otherwise permanently secure a separate face 14 to the body 12. Alternatively, the sole 16 or crown 18 may be formed separately and fitted to the remainder of the body 12 as is known to those of skill in the art.

Figure 2:
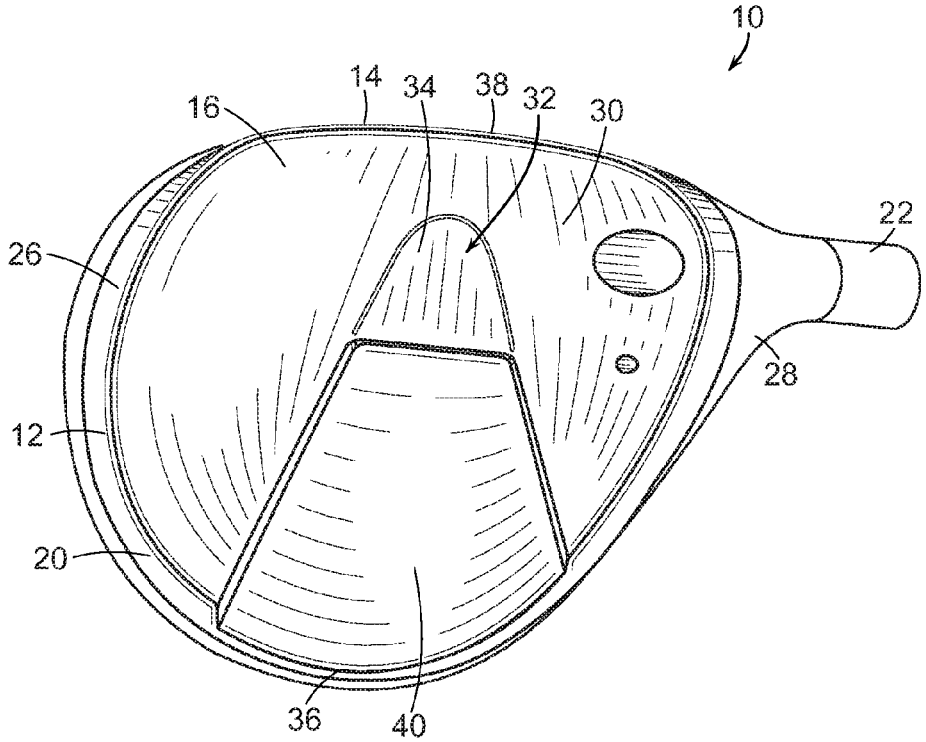
FIG. 2 is bottom plan view of an embodiment of a club head of FIG. 1.

The sole 16 preferably has a complex shape that accomplishes two objectives. The first objective is to provide a surface for the club head 10 to sit on in the address position that squares the face 14 to the target. The second objective is to provide a sole shape that gives more clearance to the ground at impact than would be available in a club head with a conventional sole. In order to achieve the first objective, an address portion or zero degree bounce portion 30 is provided. This portion is a sufficient area on the sole 16 on which the club head 10 may rest when placed at the address position by a golfer. The zero degree bounce portion 30 may be a flat portion provided on the sole 16. The zero degree bounce portion 30 may be directly centered behind the face 16 or, as illustrated, may be provided more toward the heel 28. As illustrated in FIGS. 1 and 2, the sole 16 has a zero degree bounce portion 30, such that at address the club head 10 rests at this point and the face 14 is square to the target. The zero degree bounce portion 30 enables the club head 10 to sit just as a conventional club head without a sole having a complex shape. Thus, the complex sole of the inventive club head 10 does not adversely affect the way the club head sits at address.

Figure 3A:
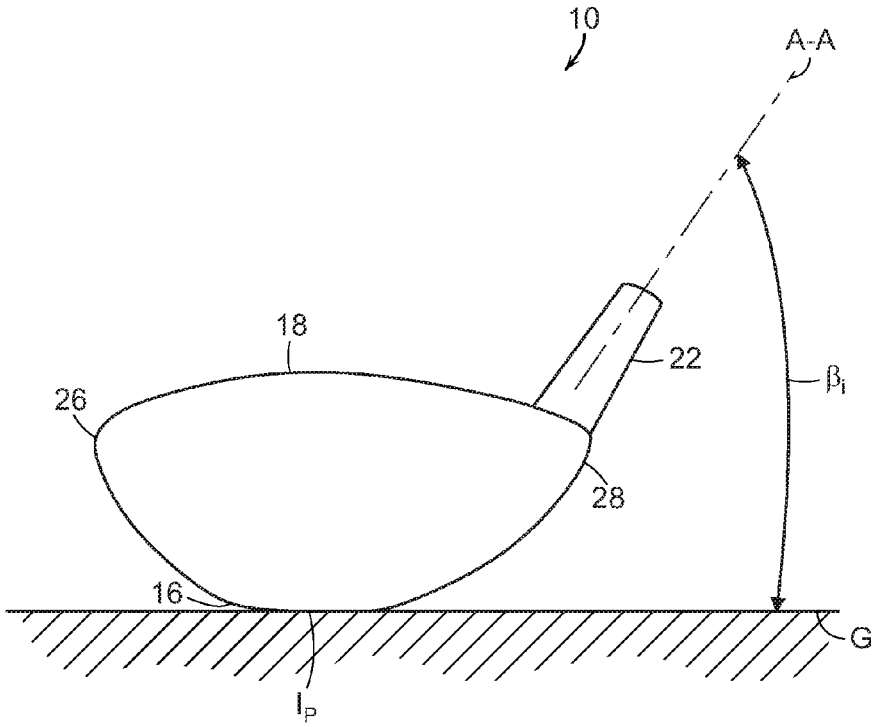
FIG. 3A is a front plan view of an embodiment of a club head according to FIG. 1 at impact with a golf ball.
Figure 3B:
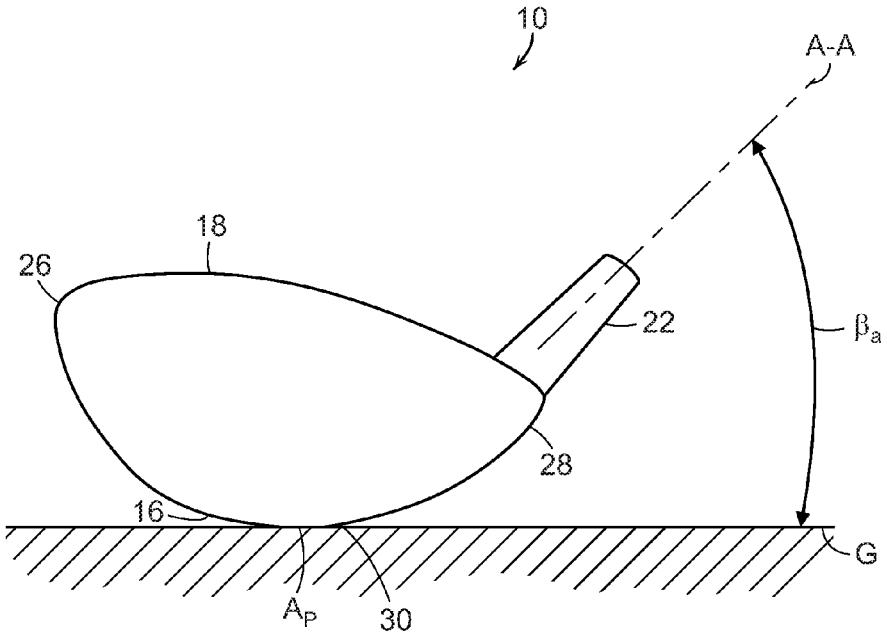
FIG. 3B is a front plan view of an embodiment of a club head according to FIG. 1 at address.

In order to achieve the second objective, a portion of the sole 16 is relieved to give it a multi-relief surface 32 with a negative bounce. Preferably, a negative bounce portion 34 is provided on the sole 16 in a center portion that is spaced from the face 14 of the club head 10. Thus, the club head 10 has two areas of bounce. As illustrated in FIGS. 3A and 3B, the impact position Ip of the club head 10 is different than an address position Ap because the dynamics of the golf swing cause the shaft to flex at impact thereby moving the position of the club head 10. FIG. 3B illustrates the club head at address where the face is square to the target, the shaft axis A-A creates an angle with the ground G called the shaft angle □a. As illustrated in FIG. 3A, during impact, the club head is rotated a few degrees upright, and the shaft axis A-A creates a different angle with the ground G called shaft angle □i.

It will be appreciated that in one embodiment the toe 26 may be up at least 5 degrees at a first measurement, for example when the club head 10 sits at address, such that the face 14 measures square. At a second measurement, for example during impact with a golf ball, taken at a centered position the face 14 measures differently than the first measurement. For example, the face 14 may measure at least two degrees more open at the second measurement than the first measurement, or at least two degrees open at the second measurement than the first measurement. The centered position may comprise the negative bounce portion 34, which may be a substantially flat surface. When the first measurement occurs at the address position, the shaft angle □a preferably measures about 55 to 45 degrees. When the second measurement occurs at impact of the club head 10 with a golf ball, the shaft angle □i measures about 55 degrees to 60 degrees.

As illustrated in FIGS. 1 and 2, the sole 16 features a multi-relief surface 32 to provide greater ground clearance at the trailing edge 36 of the sole 16 to minimize turf resistance. With this construction, the ground/sole contact point remains forward toward the leading edge 38 of the strike face 14. Maintaining a forward ground/sole contact point improves directional control and ball flight, by reducing the potential of the club head 10 to bounce or skip onto the ball. This is particularly true of players that play the ball forward in their stance, or who sweep the ball from the turf with a shallow angle of attack. Preferably, the multi-relief surface 32 sole features the negative bounce portion 32 and a cutaway portion 40.

Figure 4B:
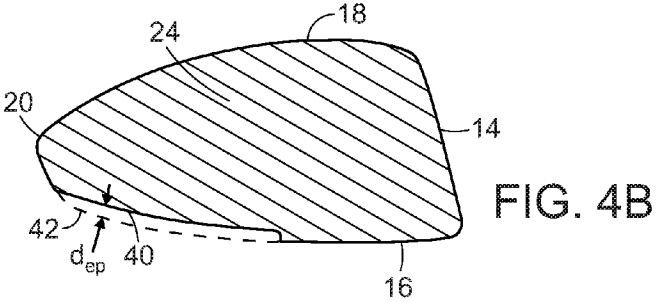
FIG. 4B is a cross-sectional view of the club head of FIG. 4 taken along line 3B-3B in FIG. 4.
Figure 4C:
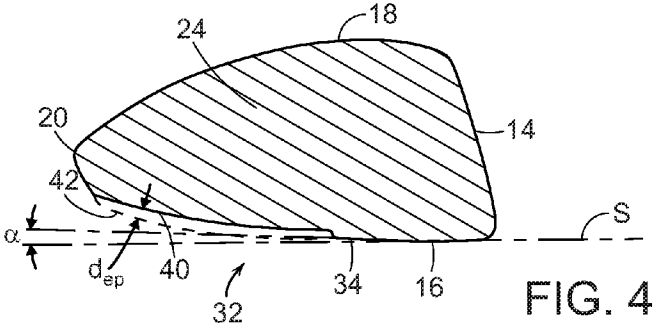
FIG. 4C is a cross-sectional view of the club head of FIG. 4 taken along line 4C-4C in FIG. 4.
Figure 4D:
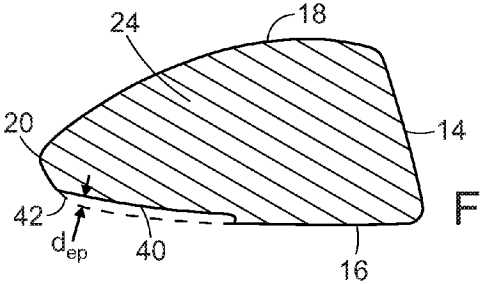
FIG. 4D is a cross-sectional view of the club head of FIG. 4 taken along line 4D-4D in FIG. 4.
Figure 4A:
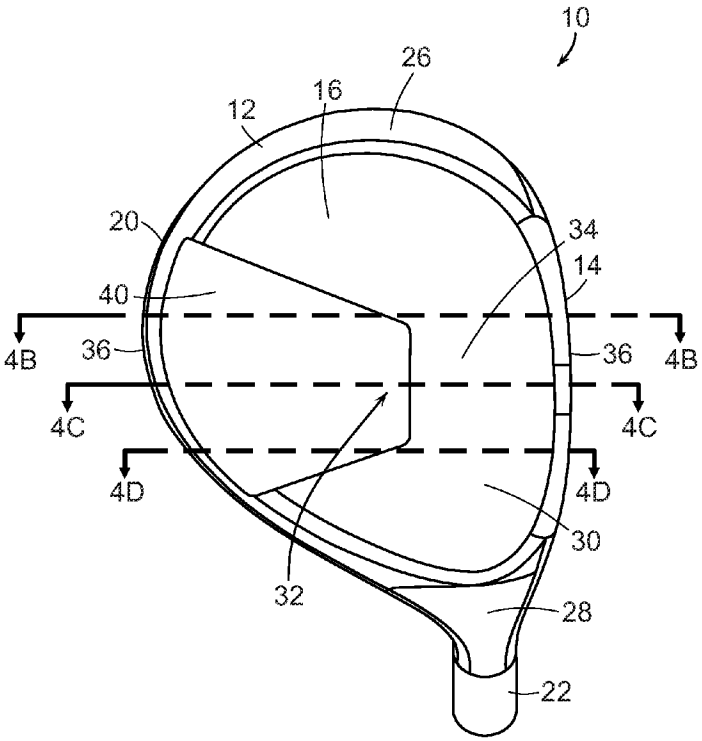
FIG. 4A is bottom plan view of an embodiment of a club head of FIG. 1.

The negative bounce portion 34 may have any desired overall shape; preferably the negative bounce portion 34 has a triangular shape as shown in FIGS. 1 and 2. FIGS. 4A-4D illustrates the negative bounce portion 34 and cutaway portion 40 in the sole 16. Cross-sectional views illustrated in FIGS. 4B and 4D show cutaway portion 40 in comparison with the regular surface 42 of a conventional club head sole. FIG. 4B illustrates the cross-sectional view of the center section of the club head 10 with the negative bounce portion 34 and cutaway portion 40 in comparison with the regular surface of a conventional club head sole 42.

Figure 5:
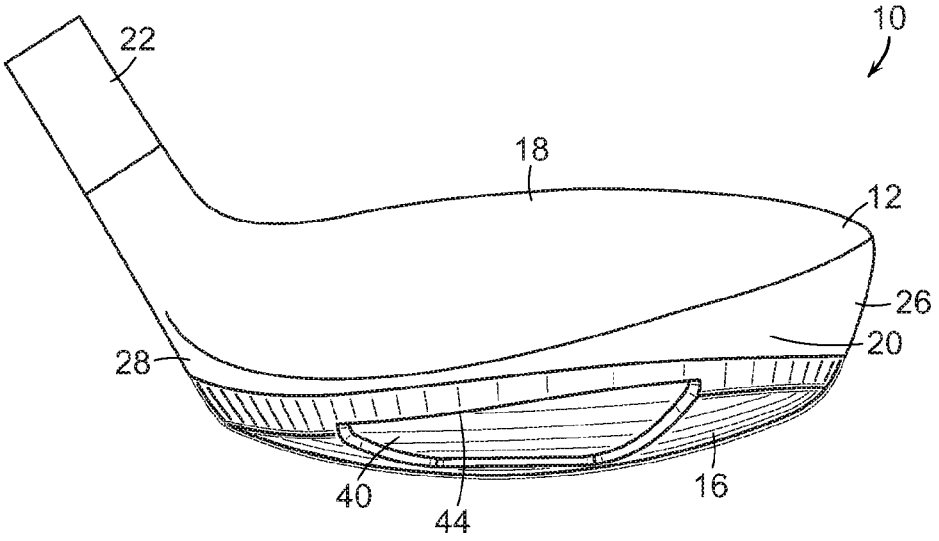
FIG. 5 is a back view of the club head of FIG. 1.
Figure 6:
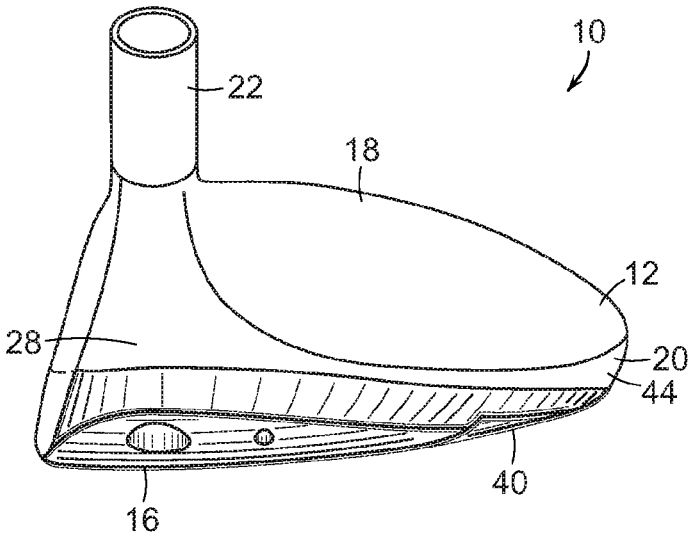
FIG. 6 is a heel side view of the club head of FIG. 1.

The cutaway portion 40 extends from the negative bounce portion 34 to the trailing edge 36 of to the club head 10. As illustrated in FIGS. 4B-D, the cutaway portion 40 continues and may gradually increase the negative surface from the plane S running along the bottom of the sole. Preferably, the cutaway portion 40 has a depth dcp of about 0.05 to 0.5 inch from the regular surface of a conventional club head sole 42; this depth may or may not be constant. FIGS. 5 and 6 illustrate the back 44 and heel 28 of the club head. The full extent of the cutaway portion 40 can be envisioned.

Figure 7B:
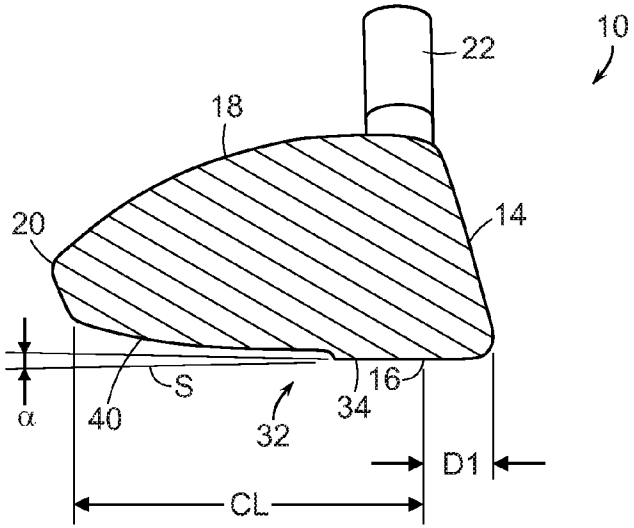
FIG. 7B is a cross sectional view of the club head of FIG. 7A taken along line 7B-7B.
Figure 7A:
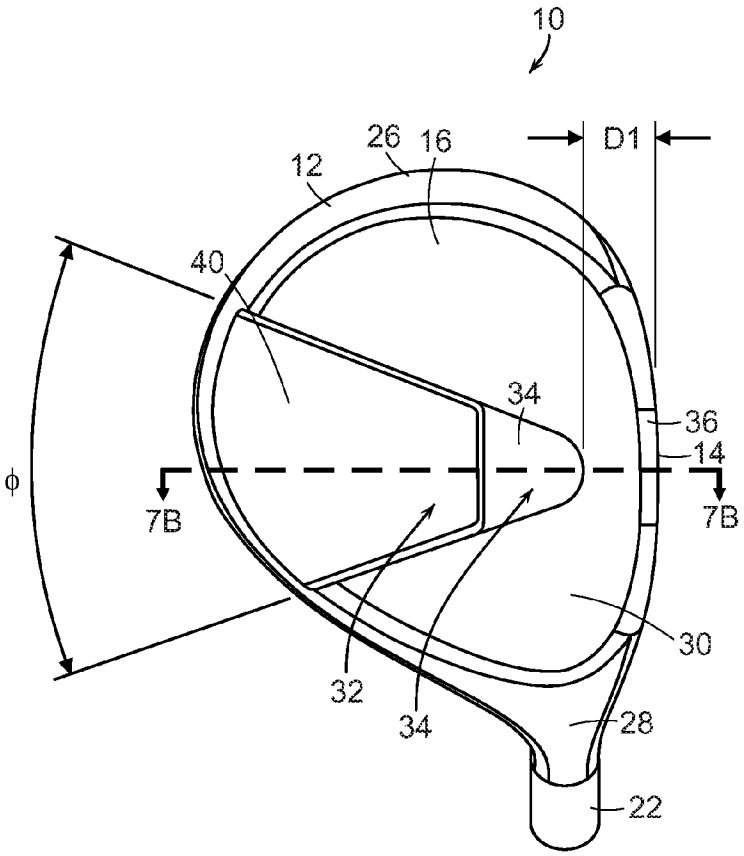
FIG. 7A is a bottom plan view of a club head with the inventive sole of FIG. 1.

FIGS. 7A-7B illustrate the sole 16 of the club head 10 and a cross-sectional view through line 7B-7B which illustrates the multi-relief surface 32 of the sole 16. The negative bounce portion 34 is spaced a distance D1 from the strike face, where D1 is preferably about 0.1 to 1.0 inch. More preferably, D1 is about 0.35 to 0.65 inch from the strike face 14 of the club head 10. The distance D1 may be different for different club heads as it may depend on the face progression and the loft of the club head. As illustrated, the negative bounce portion 34 comprises a surface having an angle □ from a plane S running along the bottom of the sole 16 parallel to the z-axis of a coordinate system running through the club head. The negative bounce portion 34 comprises about a negative 0.5 to a negative 4.0 degree surface, such that the angle □ is about negative 0.5 to 4.0 degrees from the plane S. Preferably, the negative bounce portion 34 comprises about a negative 2.0 degree surface. It will be appreciated that the negative bounce portion 34 may have a constant angle or may have an angle that varies toward the back of the sole. The negative bounce portion 34 may have locations with multiple radii.

As illustrated, the multi-relief surface 32 includes both the negative bounce portion 34 and the cutaway portion 40 and these form a triangular shape. The triangular shape forms an angle □, angle □ is preferably about 35 to 50 degrees, and more preferably about 38 to 44 degrees. The negative bounce portion 34 and cutaway portion 40 have a length L, length L is preferably about 1 to 5 inches, and more preferably about 2 to 4 inches.

Figure 8:
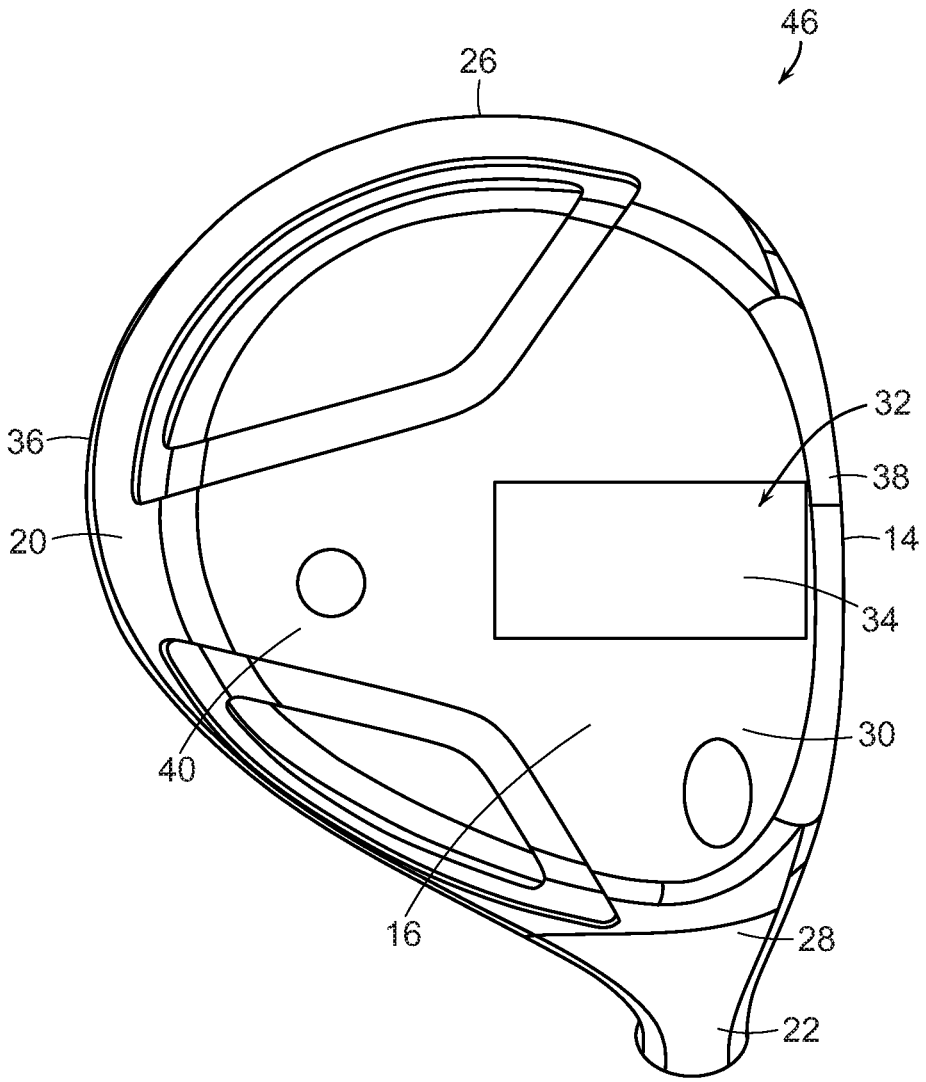
FIG. 8 is a bottom plan view of another alternative embodiment of a club head of the present invention.

FIG. 8 shows an alternative embodiment for the sole 16. The club head 46 features a multi-relief sole 32 as described above. The multi-relief sole features the negative bounce portion 34 and the cutaway portion 40. It will be appreciated that the negative bounce portion 34 and cutaway portion 40 may have any suitable shape.

In general, to increase the sweet spot, the center of gravity of the club head is moved toward the bottom and back of the club head. This permits an average golfer to launch the ball up in the air faster and hit the ball farther. In addition, the moment of inertia of the club head is increased to minimize the distance and accuracy penalties associated with off-center hits. In order to move the weight down and back without increasing the overall weight of the club head, material or mass is generally taken from one area of the club head and moved to another. Materials can be taken from the face of the club, creating a thin club face, the crown and/or sole and placed toward the back of the club.

Figure 9:
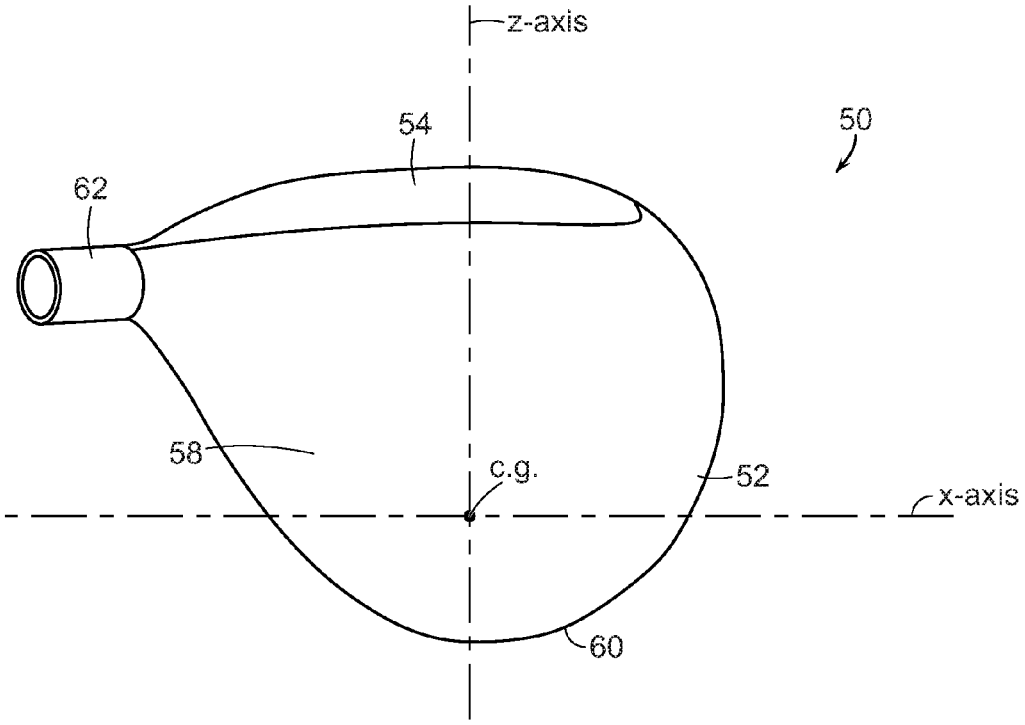
FIG. 9 is a top plan view of an alternative embodiment of a club head according to the present invention.

FIG. 9 illustrates a top of a club head 50 according to another embodiment of the present invention. Club head 50 includes a body 52 having a strike face 54, a sole 56 (see FIGS. 10A and 10B), a crown 58, a skirt 60 and a hosel 62. The body defines a hollow interior volume 64 (See FIGS. 10B and 12B). The face may be provided with grooves or score lines of varying design. The club head has a toe 66 and a heel 68.

FIG. 9 illustrates the center of gravity (c.g.) along the x-axis and z-axis. In order to improve playability of the club head 50 it is desired to be able to move the c.g. within the club head 50 to a more optimal position. Preferably, the club head 50 features a weight system 70 (see FIGS. 10A-10B and 12A-12B) to move the c.g. within the club head 50 to a more optimal position. Preferably, the c.g. is movable within a 6 mm distance along the z-axis in comparison to a club head without the weight system. More preferably, the c.g. is movable within a 4 mm distance along the z-axis. The c.g. may be movable within a 6 mm distance along the x-axis in comparison to a club head without the weight system, more preferably within a 2 mm distance, and still more preferably within a 0.5 mm distance. Additionally, the c.g. is moveable within a 6 mm distance along the y-axis in comparison to a club head without the weight system (See FIGS. 10A-10B and 12A-12B). Preferably the c.g. is moveable within a 2 mm distance along the y-axis.

The c.g. adjustability may not substantially affect the dynamic loft of the club head. For example, for a 3 mm front-back c.g. shift the dynamic loft changes about 0.4 degrees. When the c.g. is moved back, the backspin may increase, for example between 100 and 300 rpm per 3 mm of c.g. movement toward the rear of the club head.

Figure 10A:
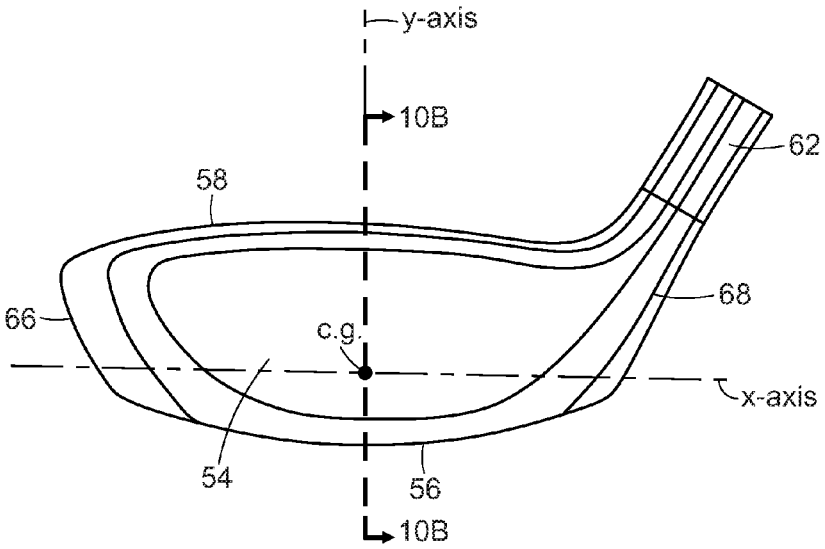
FIG. 10A is a front plan view of a club head according to an embodiment of the club head of FIG. 9.
Figure 10B:
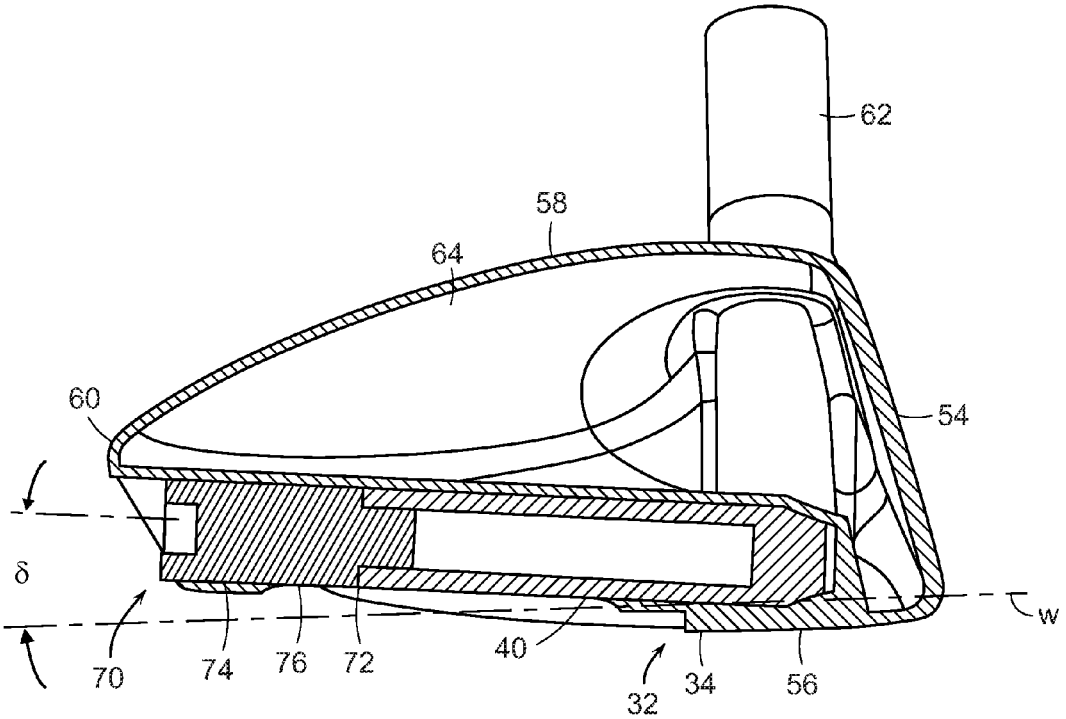
FIG. 10B is a cross-sectional view of the club head of FIG. 10A, taken along lines 10B-10B.

FIG. 10A illustrates the front face 54 of the club head showing the x-axis and the y-axis. FIG. 10B is a cross-sectional view taken along lines 10B-10B of FIG. 10A. FIG. 10B depicts the inside of the club head featuring a weight system 70 according to the invention, and the c.g. may be moved along the z axis and y axis.

Figure 11:
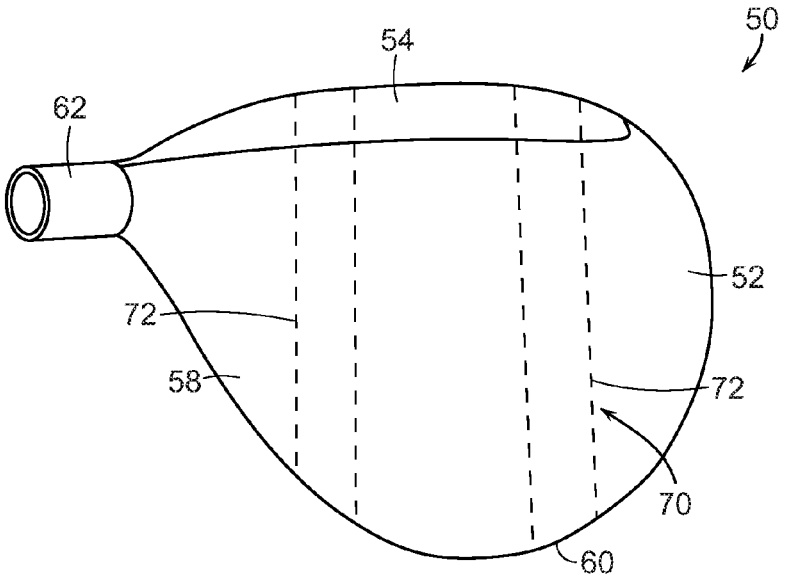
FIG. 11 is a top plan view of the club head according to an embodiment of FIG. 9.

FIG. 10B depicts the weight system 70 as a tube 72 placed within the club head 50 within a plane formed by the y-axis and z-axis to adjust the c.g. of the club head. As illustrated in FIG. 11, it will be appreciated that more than one tube 72 may be provided within the club head 50. As illustrated in FIG. 10B, the weight system 70 features a tube 72 with a weight 74 at one end 76 of the tube 72. As shown in FIG. 10B, the weight 74 is placed the back of the club head 50 to move the c.g. to a desired location for desirable ball flight. When the weight 74 is located at a back of the club head 50, a shot hit off the club head 50 has increased backspin and a higher launch angle resulting in a softer landing. In an alternative embodiment, it will be appreciated that the tube 72 may feature multiple inserts varying in weight for placement within the tube 72 to move the c.g. of the club head 50 to a desired location.

As illustrated, the tube 72 is preferably provided at an angle within the club head 50. The tube 72 is angled downward toward the face 54 of the club head 50, such that the tube 72 is provided within the plane formed by the z-axis and y-axis. The tube 72 may be angled by an angle ||, where || is at least 1 degree from the plane W formed by the z axis and x axis. Preferably, the tube is angled downward toward the face 54 by at least 3 degrees from the plane W formed by the z-axis and x-axis. More preferably, the tube 72 is angled downward toward the face of the club head 50 by about 3 to 7 degrees from the plane W formed by the z-axis and x-axis. It will be appreciated that although the tube 72 is described herein as being provided within a plane formed by the y-axis and z-axis, the tube 72 may be offset in either direction from that plane by any desired amount.

Figure 12A:
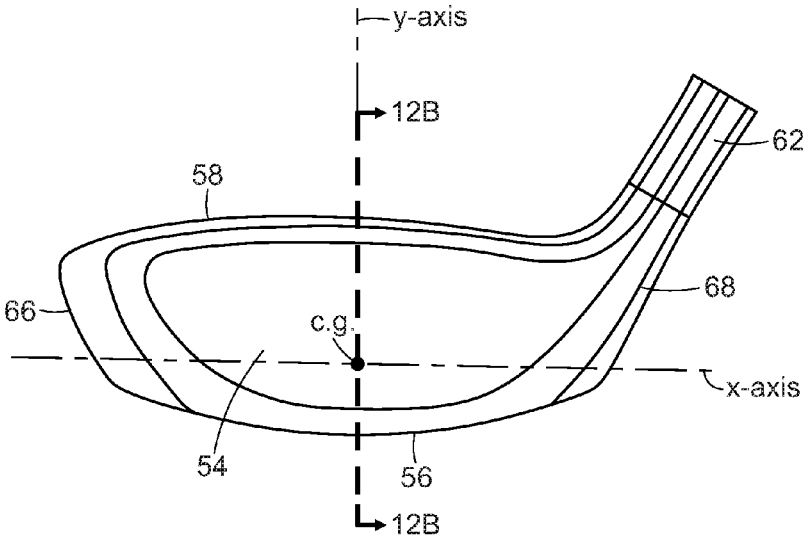
FIG. 12A is a front plan view of a club head according to an embodiment of the club head of FIG. 9.
Figure 12B:
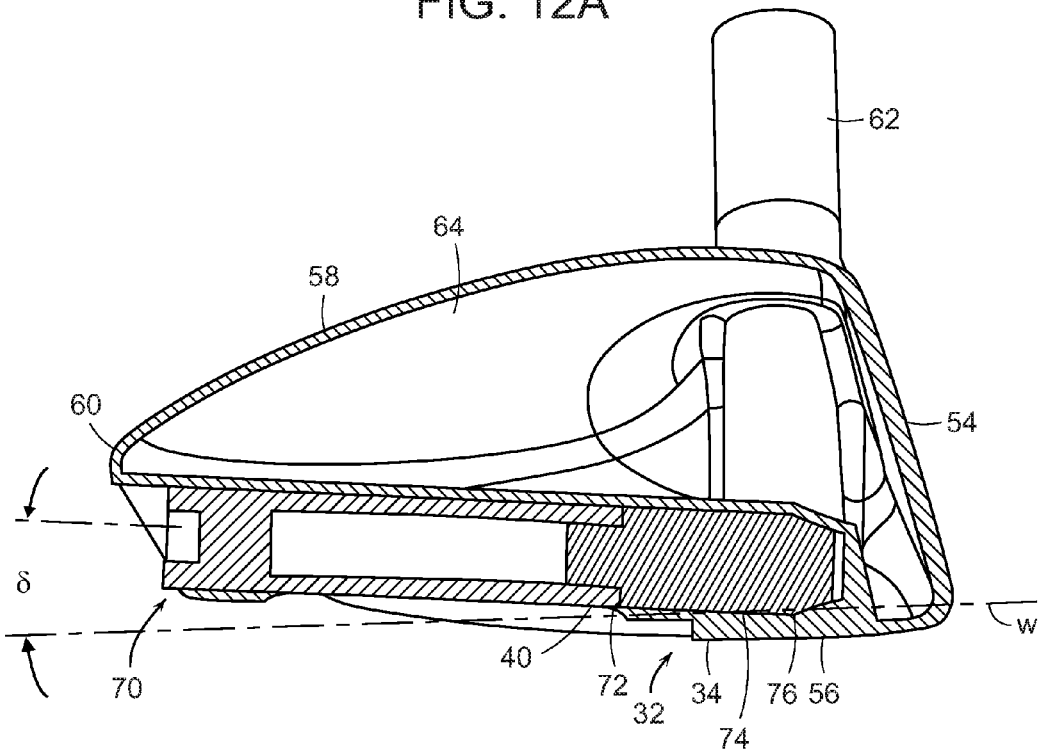
FIG. 12B is a cross-sectional view of the club head of FIG. 12A, taken along lines 12B-12B.

Now referring to FIG. 12A-12B, it will be appreciated that the tube 72 may be flipped within the club head 50, such that the weight 74 is provided at the other end 76 of the club head 50, closer to the face 54, to move the c.g. to a different location for desirable ball flight. When the weight 74 is located at a front of the club head 50 a shot hit off the club head 50 has less backspin and a lower trajectory resulting in a shallower landing for increased distance. It will be appreciated that the tube 72 itself may be able to be inserted in the club head with the weight 74 in either direction, or that different tubes 72 may be selectable with the weight 74 at the desired end and then provided in the club head.

It will be appreciated that a club having the weight system 70, such as the tube 72 and weight 74, may also include the multi-relief surface 32 on the sole 56 as described above. For example, in FIGS. 10B and 12B the sole 56 may feature a multi-relief surface 32 with a negative bounce portion 34 and a cutaway portion 40 as described above. It will also be appreciated that the angle □ of the tube may be substantially parallel to the multi-relief surface 32.

Figure 13:
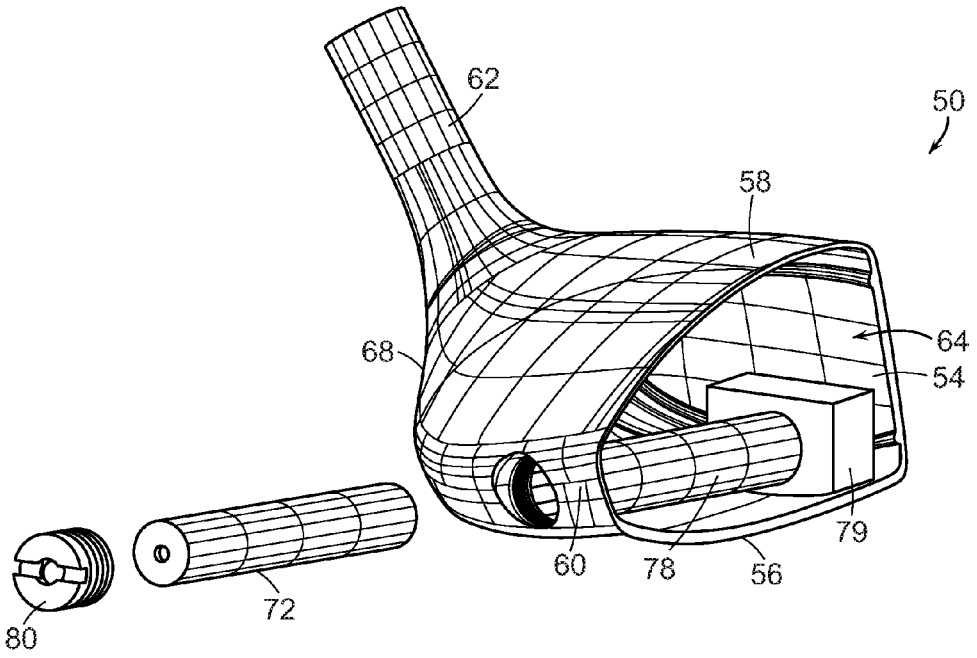
FIG. 13 is a back perspective cut-out view of an embodiment of a club head according to FIG. 9.
Figure 14:
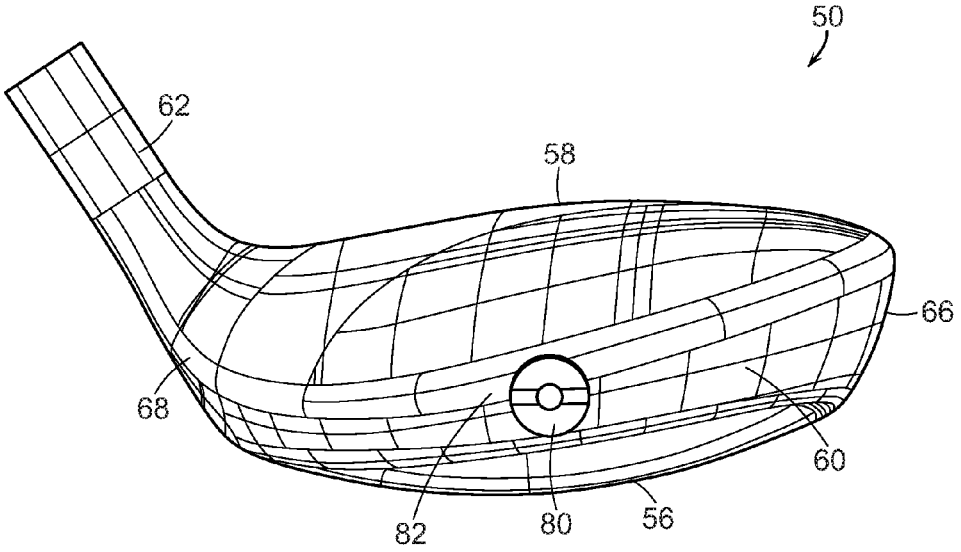
FIG. 14 is a back view of the club head of FIG. 13.

FIG. 13 illustrates how the tube 72 may be inserted into the club head 50. A sheath 78 extending from a block 79 in the club head 50 receives the tube 72 with the weight 74, and a fastener 80 locks the tube 72 in place within the club head 50. The tube 72 is fastened to the outside of the club head 50 substantially flush with an outer surface 82 of the club head, as illustrated in FIG. 14.

Figure 15:
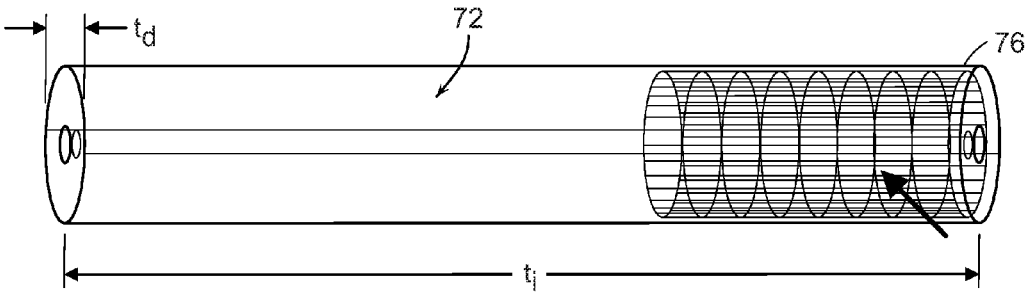
FIG. 15 is a perspective view of a weight tube according to the embodiment of the FIG. 13.

FIG. 15 illustrates the tube 72 according to the embodiment of FIG. 13. The weight 74 is provided at an end 76 of the tube 72. It will be appreciated that the tube 72 and weight 74 may be joined by threaded engagement, epoxy, mechanical lock or other joining method. The weight 74 may comprise tungsten or any other suitable material. The weight 74 has a mass of about 10 to 25 grams. The combined mass of the tube 72 and weight 74 is about 20 to 40 grams. Preferably, the tube 72 comprises aluminum, although any other suitable material may be used.

It is envisioned that the orientation of the tube 72 may be set during manufacture, may be modified by the user, or may be modifiable by the manufacturer or a designated fitting location. The tube 72 has a diameter td of about 0.3 to 0.5 inch and a length tl of about 2 to 3 inches. It will be appreciated that more than one tube 72 could be provided in the club head 50 at any one time as illustrated in FIG. 11, or that multiple tubes 72 with a different mass may be provided to the user or fitting location.

Figure 16:
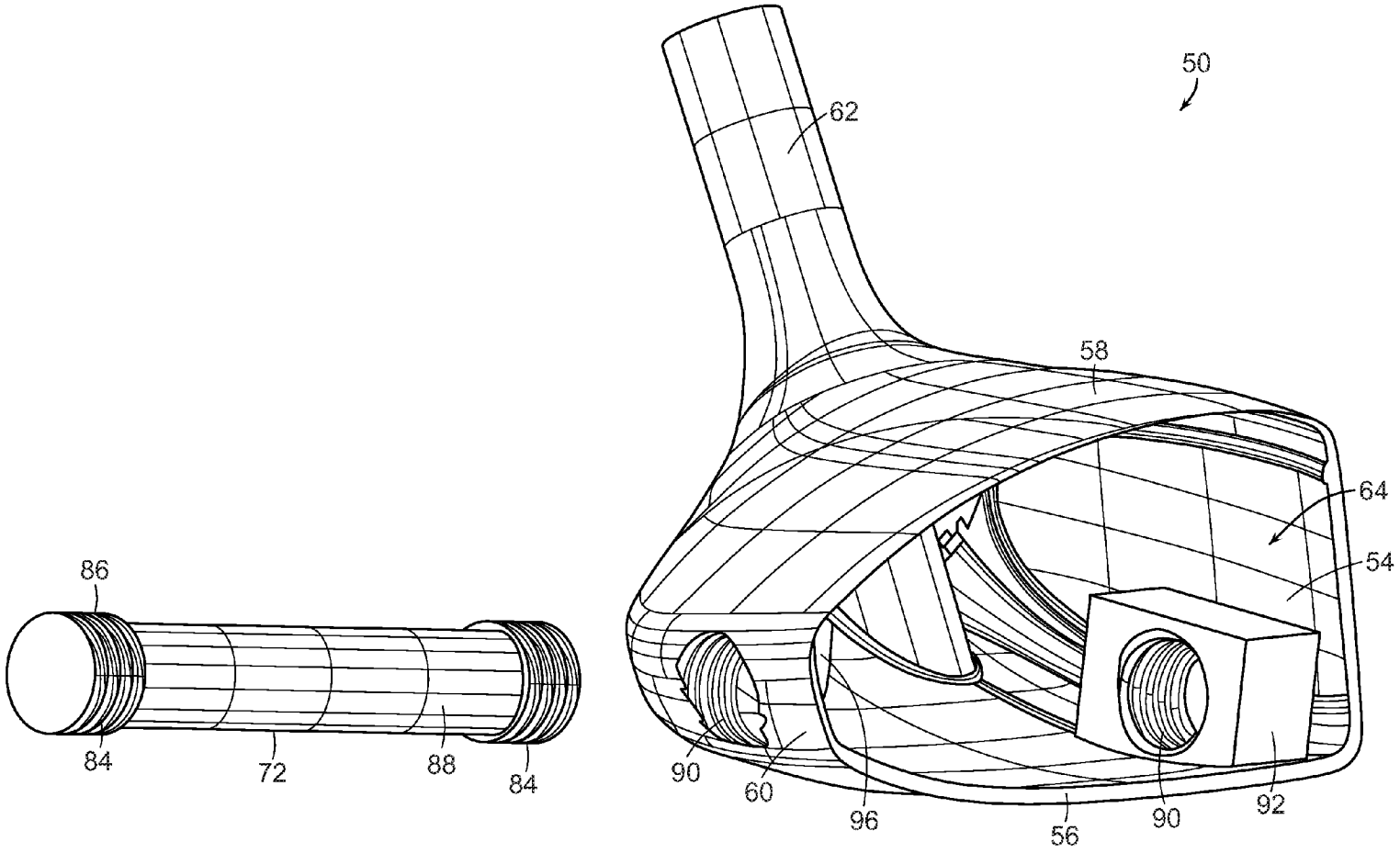
FIG. 16 is a back perspective cut-out view of another embodiment of a club head according to FIG. 9.

FIG. 16 illustrates an alternative embodiment for placement of the tube 72 within the club head 50. In this embodiment, the tube 72 has threads 84 on both ends 86 and 88 that interlock in threaded engagement to the mating threads 90 on a block 92 inside the club head adjacent the face 54 and threads 94 on a block 96 adjacent the skirt 60 of the club head 50. The tube 72 is fastened to the inside of the club head 50 adjacent the face 54. It is envisioned that the orientation of the tube 72 may be set during manufacture, may be modified by the user, or may be modifiable by the manufacturer or a designated fitting location.

Figure 17:
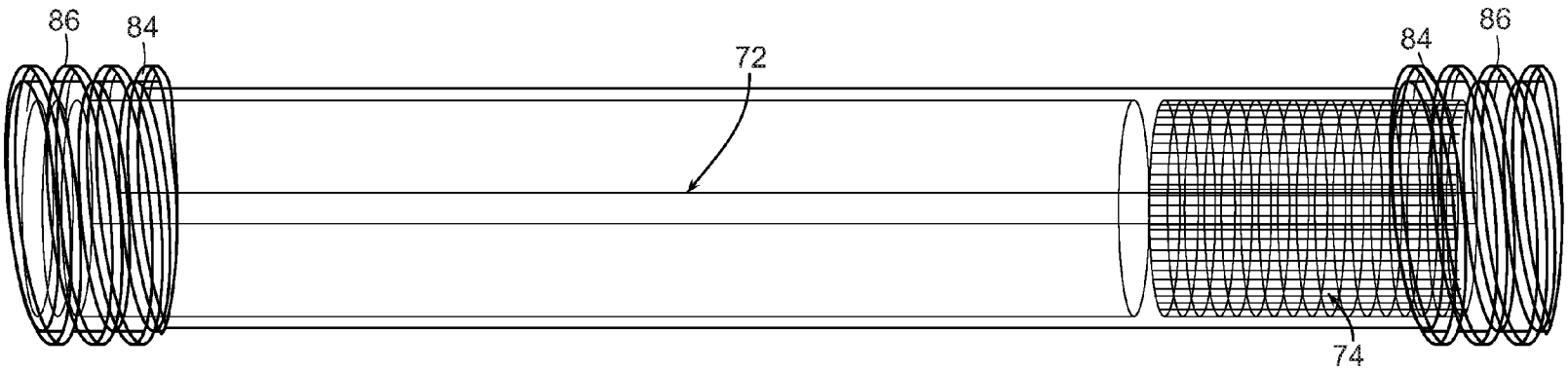
FIG. 17 is a perspective view of a weight tube according to the embodiment of the FIG. 17.

FIG. 17 illustrates the tube 72 of the embodiment of FIG. 16 showing the dual threaded ends 86 and 88 of the tube that may be inserted in either direction into the club head 50 and threadedly received adjacent the face 54. The tube 72 has a diameter td and a length tl as described above and the weight 74 and tube 72 have a similar mass as described above. The exterior of the tube 72 would align substantially flush with the outer surface 82 of the club head 50.

Figure 18:
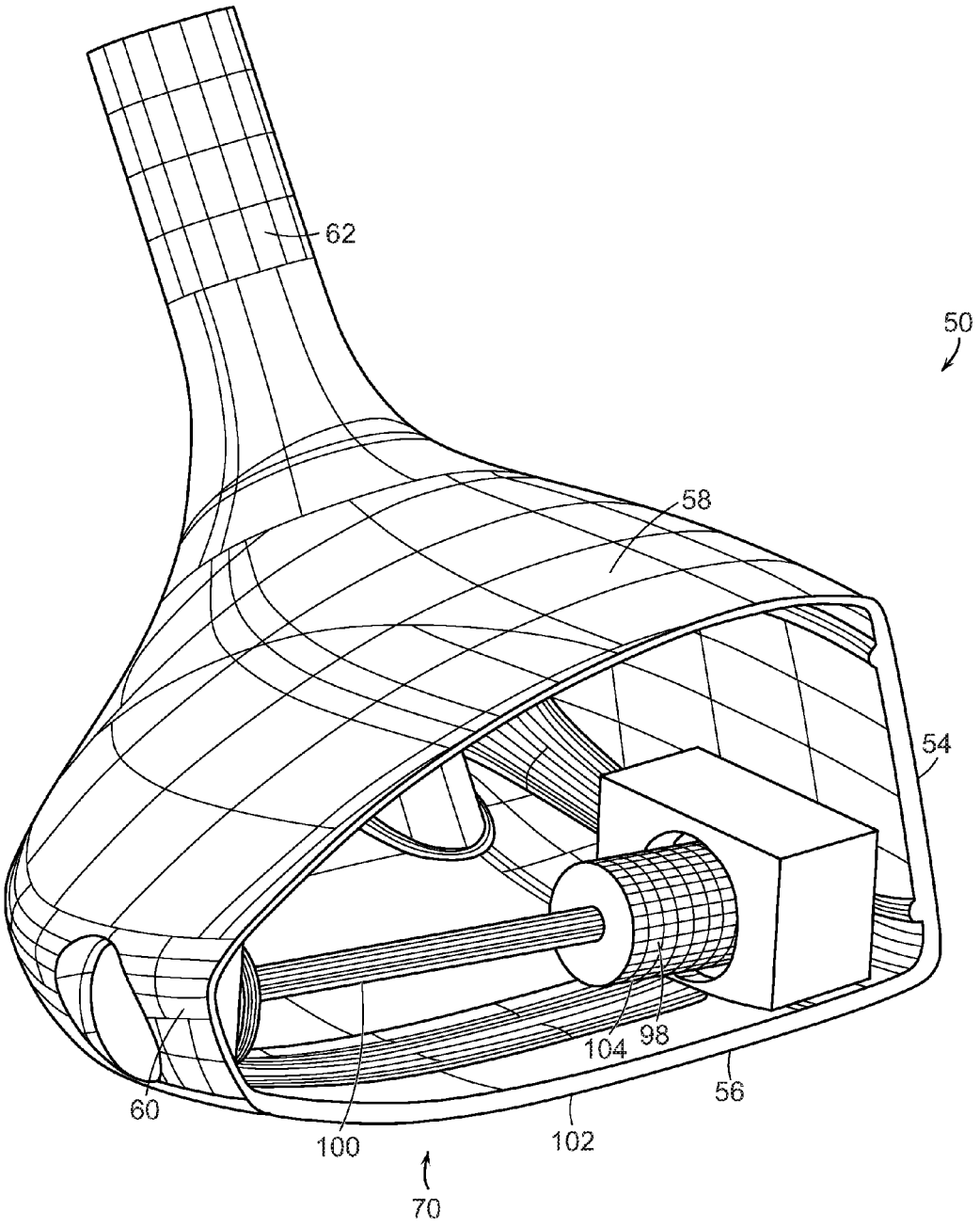
FIG. 18 is a back perspective cut-out view of another embodiment of a club head according to FIG. 9.

FIG. 18 shows an alternative embodiment for the weight system 70 where a weight 98 may be slid along a pipe 100 provided in the club head 50. The exterior surface 102 of the sole 56 of the club head 50 may feature a mechanism 104 to move the weight 98 along the pipe 100 to the desired location to move the c.g. for the desired ball flight as described above. Alternatively, the position of the weight 98 on the pipe 100 may be set during manufacture of the club head.

Figure 19:
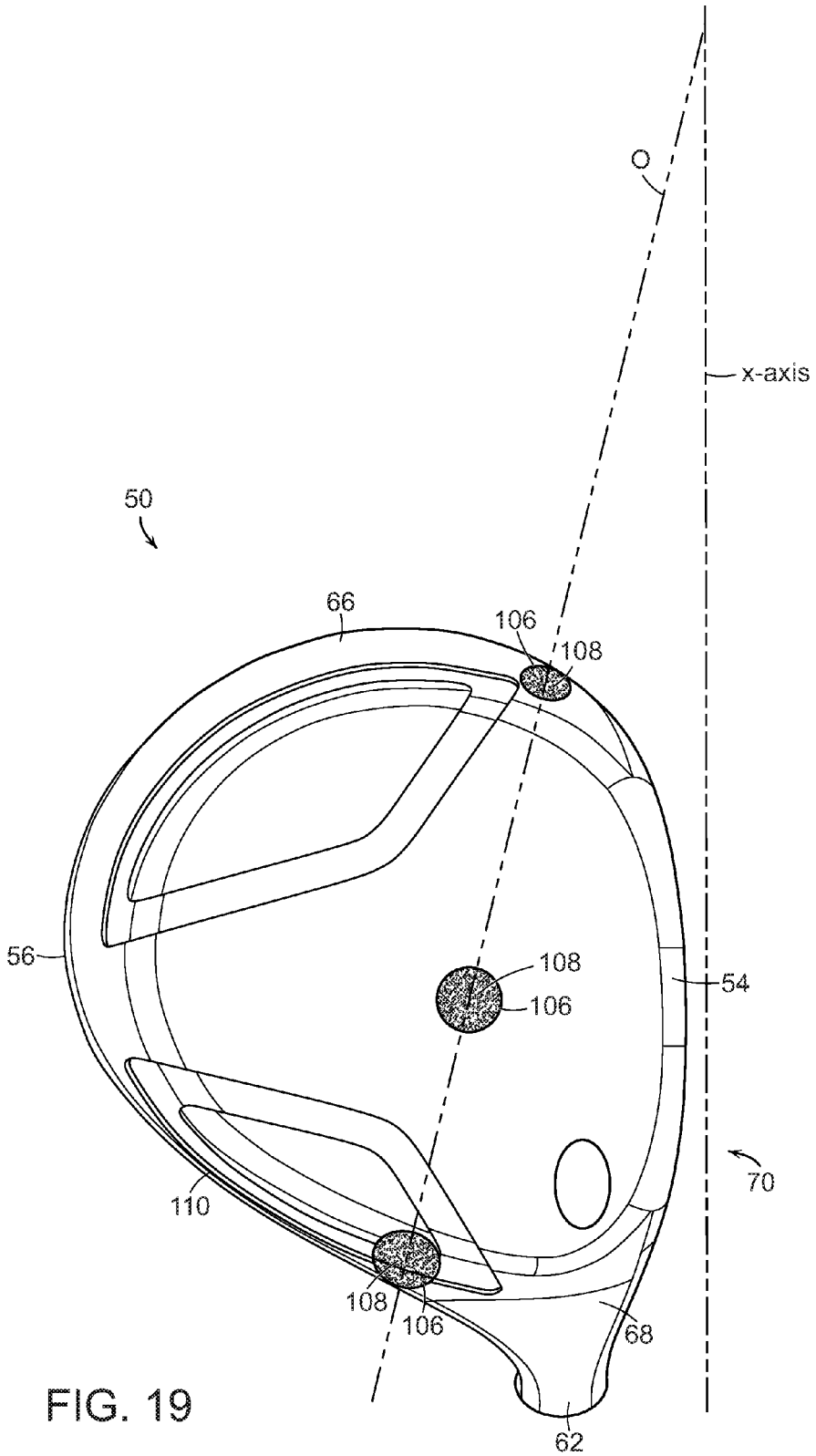
FIG. 19 is a bottom plan view of another embodiment of a club head according to FIG. 9.

FIG. 19 features another alternative embodiment for the weight system 70. This embodiment features two or more cavities 106 in the sole 56 of the club head 50 for receiving inserts 108. The cavities 106 may be placed in any desired location on the club head 50. As illustrated, the three cavities 106 are provided along an axis O offset from the x-axis. The cavities 106 may be aligned parallel to the x-axis or may be offset in either direction. The cavities 106 may be provided on an axis O offset from the x-axis by 0 to 90 degrees in either direction. The back portion 110 of the club head may feature deeper cavities 106 to mimic the angle of the tube 72 described above relative to the plane formed by the z-axis and x-axis. The inserts 108 may have different mass and may be placed in the different cavities 106 to move the c.g. to a desired location. The inserts 108 may be movable by the user, or they may be set at the time of manufacture or modifiable in a fitting environment.

Figure 20:
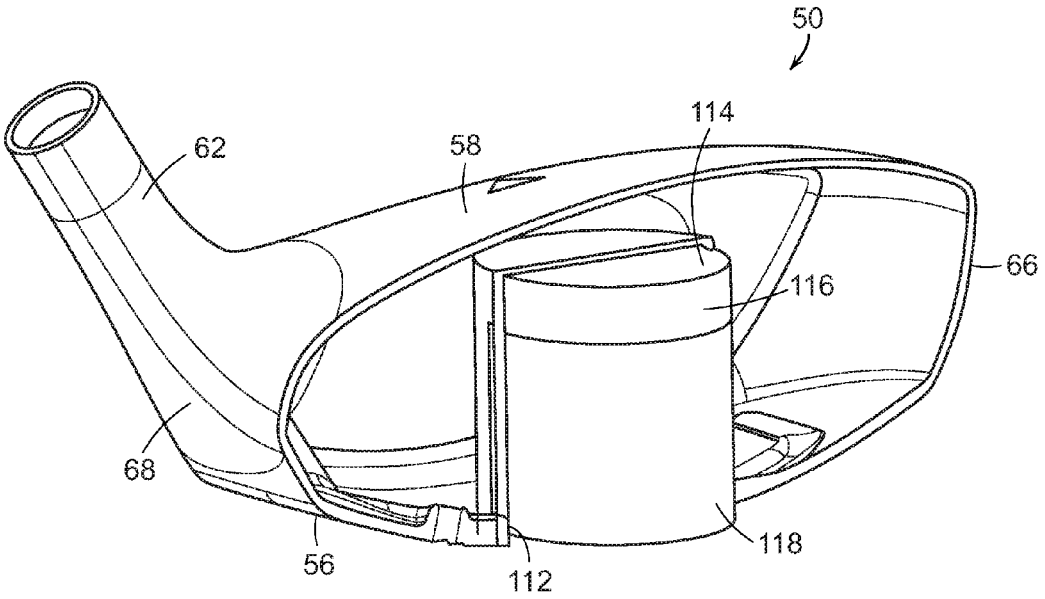
FIG. 20 is a front perspective cut-out view of another embodiment of a club head according to FIG. 9.

FIG. 20 illustrates yet another alternative embodiment of the weighting system 70 for moving the center of gravity along the y-axis. As illustrated, the club head 50 features a vertical cavity 112 extending from the sole 56 into the hollow volume 64 of the club head. The cavity 112 may be placed in any desired location in the sole 56, for example centered along the width of the face 54 and located more toward the back of the club head 50, as illustrated. A weight 114 is made to fit within the cavity 112, such that it mates securely within the cavity 112. It will be appreciated that the weight 114 may be secured in the cavity in any suitable manner, including threaded engagement, epoxy, mechanical lock, or other joining method. As illustrated, the cavity 112 is cylindrical and the weight 114 is a corresponding cylindrical plug, although it will be appreciated that the weight 114 and mating cavity 112 may be any suitable shape and size. The weight 114 features a heavy end 116 and a lighter end 118. The heavy or lighter end 116 and 118 may be placed closer to the sole 56 to move the c.g. to the desired location along the y-axis. It is envisioned that the orientation of the orientation of the weight 114 may be set during manufacture, may be modified by the user, or may be modifiable by the manufacturer or a designated fitting location. This embodiment may assist in isolating just one attribute, moving the c.g. along the y-axis, thereby making club fitting more straight forward.

Figure 21:
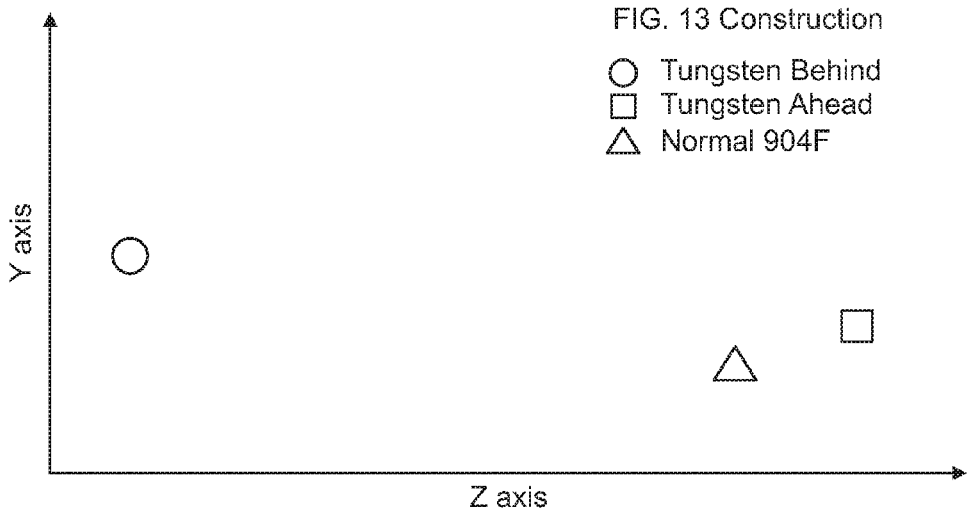
FIG. 21 is a graph depicting the movement of the center of gravity along the y-axis and z-axis according to the embodiment of FIG. 13.

As illustrated in FIG. 21, the movement of the c.g. is illustrated based on the construction of FIG. 13. It illustrates the movement of the c.g. along the y-axis and z-axis between a normal Titleist 904F fairway wood without a weight system, a club head 50 with the weight system 70 of FIG. 13 having the weight 74 in the back of the club head 50, and a club head 50 with the weight system 70 of FIG. 13 having the weight 74 in the front of the club head 50. FIG. 21 illustrates the relative position of the c.g. along the y-axis and z-axis for these various club heads.

Figure 22:
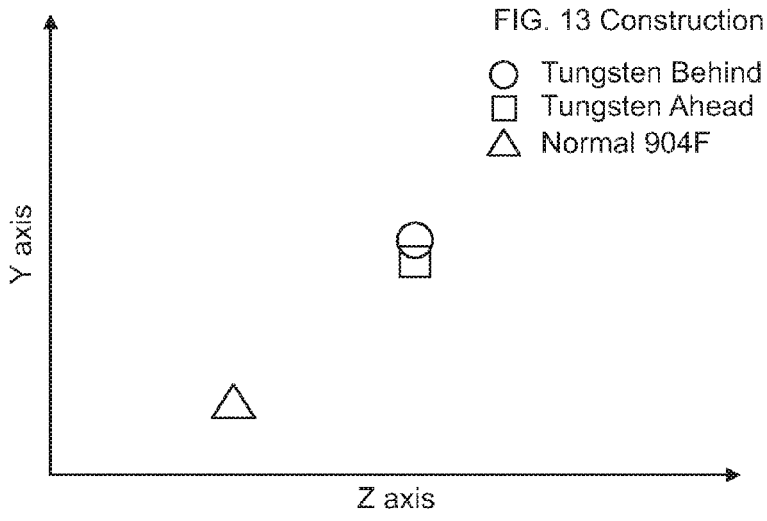
FIG. 22 is a graph depicting the movement of the center of gravity along the y-axis and x-axis according to the embodiment of FIG. 13.

As illustrated in FIG. 22, the movement of the c.g. is illustrated based on the construction of FIG. 13. It illustrates the movement of the c.g. along the y-axis and x-axis between a normal Titleist 904F fairway wood without a weight system, a club head 50 with the weight system 70 of FIG. 13 having the weight 74 in the back of the club head 50, and a club head 50 with the weight system 70 of FIG. 13 having the weight 74 in the front of the club head 50. FIG. 22 illustrates the relative position of the c.g. along the y-axis and x-axis for these various club heads.

Figure 23:
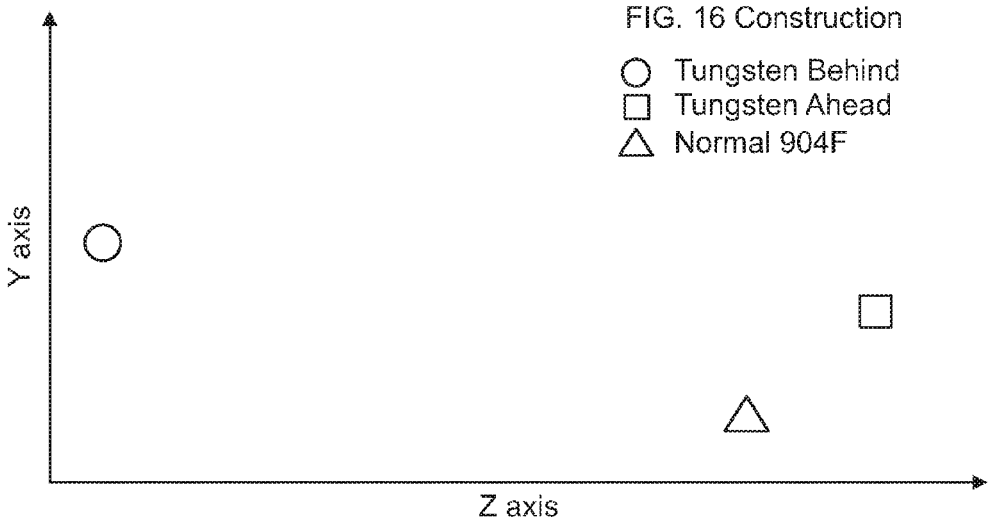
FIG. 23 is a graph depicting the movement of the center of gravity along the y-axis and z-axis according to the embodiment of FIG. 16.

As illustrated in FIG. 23, the movement of the c.g. is illustrated based on the construction of FIG. 16. It illustrates the movement of the c.g. along the y-axis and z-axis between a normal Titleist 904F fairway wood without a weight system, a club head 50 with the weight system 70 of FIG. 16 having the weight 74 in the back of the club head 50, and a club head 74 with the weight system 70 of FIG. 16 having the weight 74 in the front of the club head 50. FIG. 23 illustrates the relative position of the c.g. along the y-axis and z-axis for these various club heads.

Figure 24:
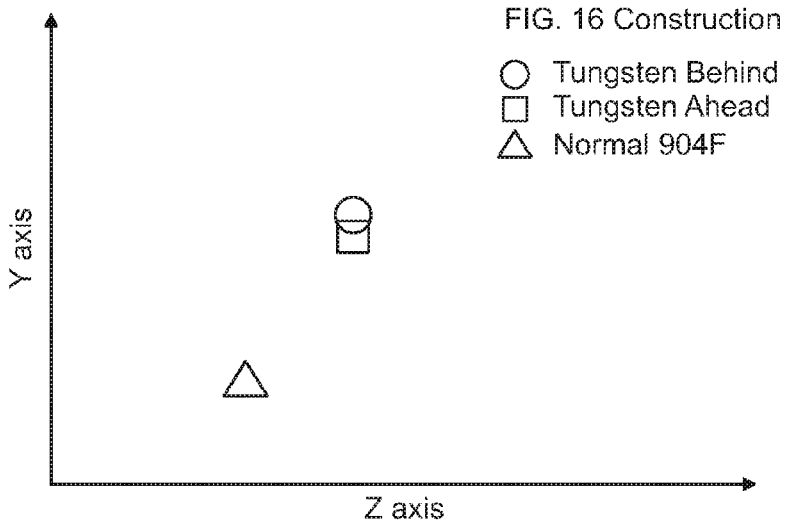
FIG. 24 is a graph depicting the movement of the center of gravity along the y-axis and x-axis according to the embodiment of FIG. 16.

As illustrated in FIG. 24, the movement of the c.g. is illustrated based on the construction of FIG. 16. It illustrates the movement of the c.g. along the y-axis and x-axis between a normal Titleist 904F fairway wood without a weight system, a club head 50 with the weight system 70 of FIG. 16 having the weight 74 in the back of the club head 50, and a club head 50 with the weight system 70 of FIG. 16 having the weight 74 in the front of the club head 50. FIG. 24 illustrates the relative position of the c.g. along the y-axis and x-axis for these various club heads. The locations of the c.g. shown in FIGS. 21-24 were calculated using a commercially available CAD (computer aided design) system.

Figure 25:
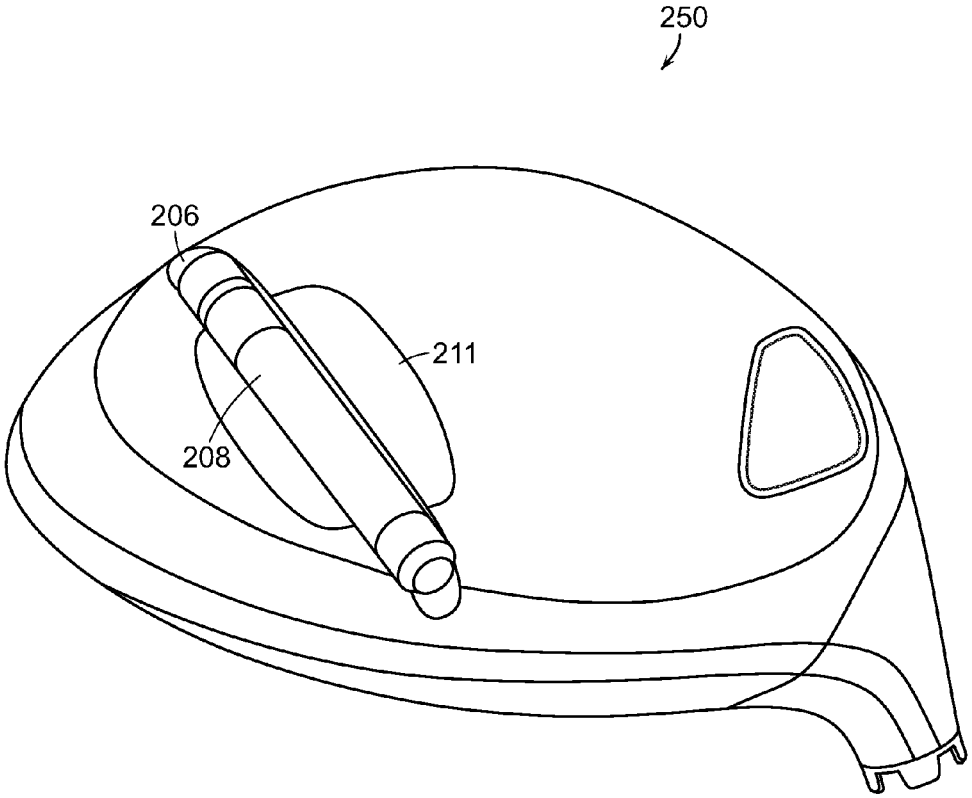
FIG. 25 is a perspective view of a golf club head in accordance with an alternative embodiment of the present invention.

FIG. 25 of the accompanying drawings shows a perspective view of a golf club head 250 in accordance with an alternative embodiment of the present invention. This embodiment of the present invention has one or more cavities 206 in the sole of the club head 250 for receiving a weighted insert 208. The cavity 206 in this embodiment may generally be shown in a generally elongated cylindrical shape with an opening 211 that exposes the cylindrical weighted insert 208 to the sole of the golf club head 250. The orientation of the cavity 206 and the weighted insert 208 may generally be offset at an angle from the striking face of the club head to promote the change in the center of gravity of the club head 250 along two or more axis. In order to show the offset angle of the weighted insert 208, FIG. 26 is provided showing an exploded sole view of a golf club 250 having a weighted insert 108 in accordance with this alternative embodiment of the present invention.

Figure 26:
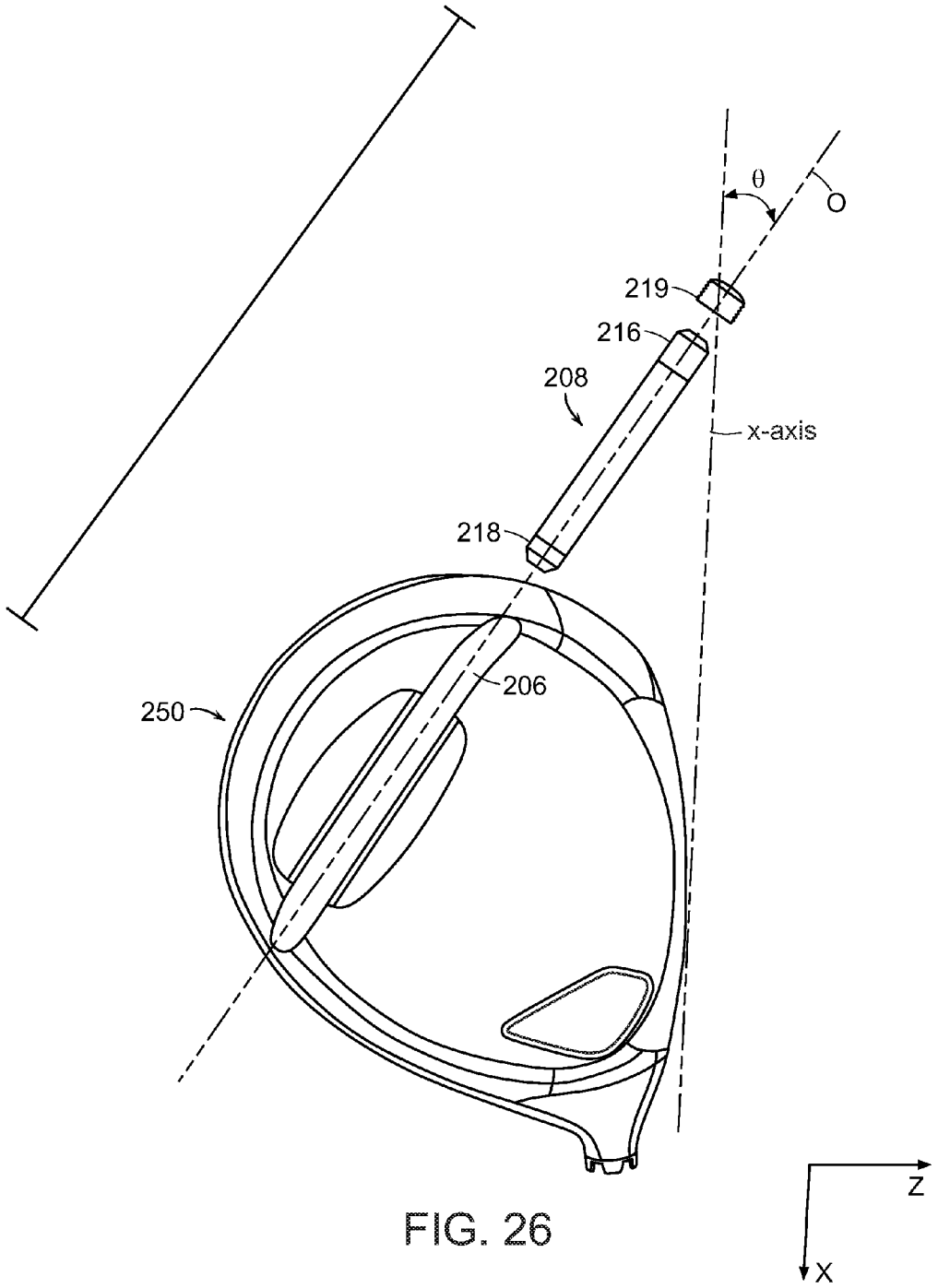
FIG. 26 is an exploded sole view of a golf club head according to the embodiment of FIG. 25.

FIG. 26 of the accompanying drawings shows an exploded sole view of a golf club 250 having a weighted insert 208. More specifically, FIG. 26 shows the cavity 206 and the weighted insert 208 aligned along an axis O that is offset from the x-axis at an angle θ. This angle θ, similar to the prior discussion in FIG. 19, may generally be offset from the x-axis by an angle of 0 to 90 degrees in either direction, but more preferably between about 0 to about 90 degrees in the positive direction, more preferably between about 3 to about 45 degrees, and most preferably between about 5 to about 35 degrees all without departing from the scope and content of the present invention. Having the axis O offset from the x-axis is beneficial to the present invention because it allows the weighted insert 208 to alter the center of gravity of the golf club head along the x-axis and the z-axis simultaneously, depending on the orientation of the weighted insert 208. However, in order to achieve this, the weighted insert 208 must within itself, have some inherent weighting characteristics that favor such an extreme movement in the center of gravity.

The exploded view of the golf club 250 with the weighted insert 208 shown in FIG. 26 also allows the inherent weighting characteristics of the weighted insert 208 to be shown. In this figure, the weighted insert 208 may be further comprised of a heavy end 216, a lighter end 218, and a cap 219. The utilization of a heavy end 216 and a lighter end 218 in this type of weighted insert 208 maximizes the bi-directional adjustability of the elongated cylindrical weighted insert 208 to shift the center of gravity of the golf club head 250. In a first orientation, when the heavy end 216 is located close to the cap 219 near the toe end of the golf club head 250, the center of gravity of the golf club head is shifted forward and toe-ward relative to the neutral position; while in a second orientation, when the heavy end is located away from the cap 210 near the heel end of the golf club head 250, the center of gravity of the golf club head will be shifted rearward and heel-ward relative to the neutral position.

Due to the nature of the orientation of the weighted insert 208 being at an orientation that is offset from the x-axis, combined with its internal weighting components with a heavy end 216 and a lighter end 218, the length of the weighted insert 208 becomes important; as an increase in the length of the weighted insert 208 results in a greater effect on the center of gravity of the golf club head 250. Hence, in order to achieve a discernible change in the center of gravity of the golf club 250 by the change in orientation of the weighted insert 208, the length of the weighted insert 208 may generally be between about 50 mm to about 100 mm, more preferably between about 60 mm to about 90 mm, even more preferably between about 70 mm to about 80 mm.

The heavy end 216 of the weighted insert 208 may generally be comprised of a material having a relatively high density such as tungsten with a density of greater than about 10.9 g/cm3; however numerous other materials may be used without departing from the scope and content of the present invention so long as it has a density greater than the remainder of the weighted insert 208. The lighter end 218 of the weighted insert could be made out the same tungsten material as the heavy end 216, but in a smaller volume. However, alternative materials for the lighter end 218 such as steel, titanium, or any other material having a density greater than the central part of the weighted insert 208 all without departing from the scope and content of the present invention. The central portion of the weighted insert 208 may generally be juxtaposed and placed between the heavy end and the lighter end. In order to maximize the effects of the heavy end 216 and the lighter end 218, the central portion of the weighted insert 208 may generally be made out of a lightweight material such as carbon fiber composite, aluminum, magnesium, plastic, or any other lightweight material with a density of less than about 2.5 g/cm3 all without departing from the scope and content of the present invention.

Figure 27:
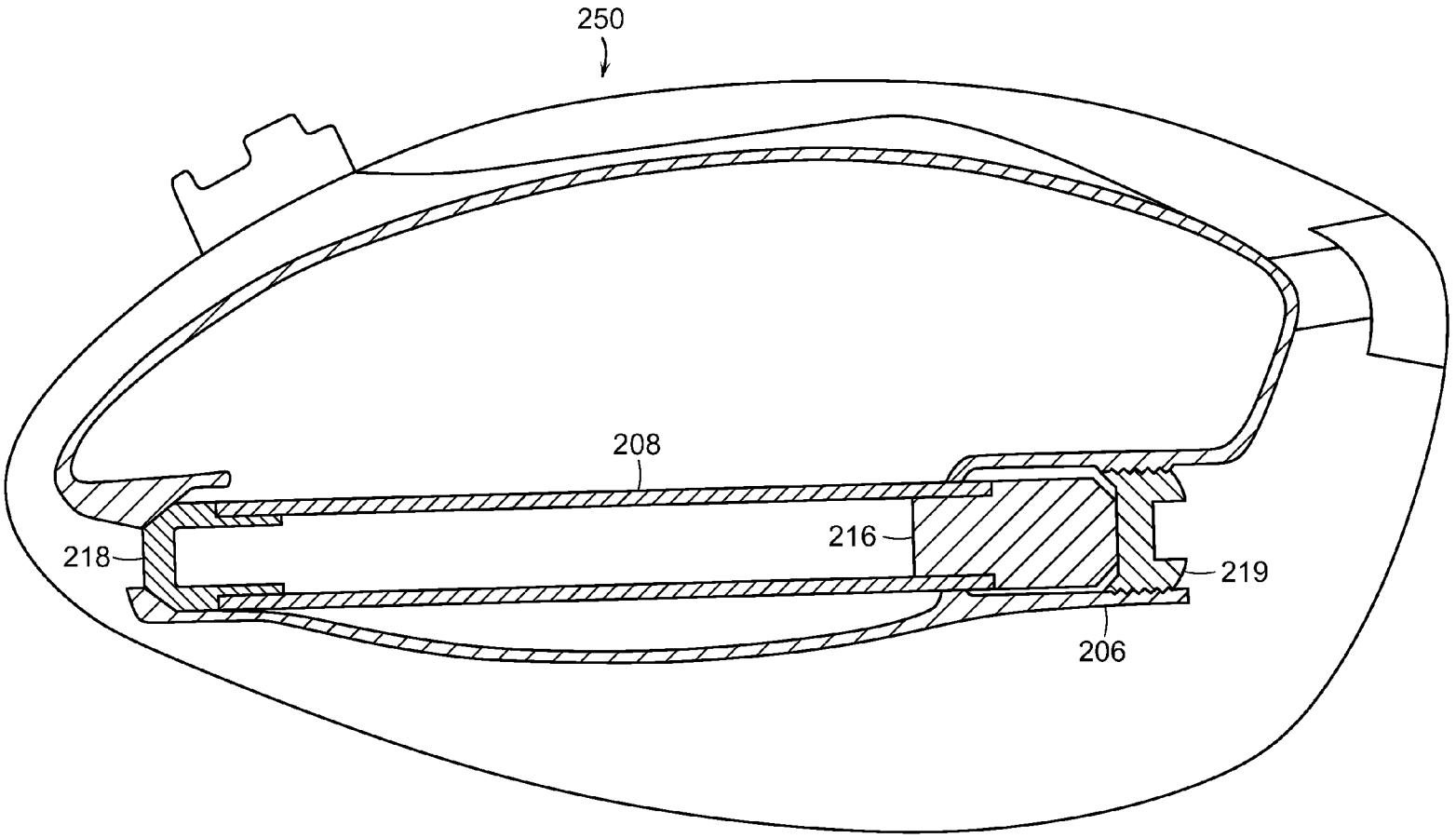
FIG. 27 is a cross-sectional view of a golf club head according to the embodiment of FIG. 25, taken across cross-sectional line O.

In the embodiment shown, the threaded cap 219 may help retain the weighted insert 208 using a compressive force as shown in the cross-sectional view shown in FIG. 27. However, in alternative embodiments of the present invention, the cap 219 may be magnetic in nature to further enhance the bond between the cap 219 and the weighted insert 208.

In order to illustrate the inner workings of the weighted insert 208 and the golf club 250, FIG. 27 is provided here with a cross-sectional view of the golf club head 250 along cross-sectional line O, as shown previously in FIG. 26. The cross-sectional view of the golf club head 250 allows the relationship between the weighted insert 208, the heavy end 216, the lighter end 218, the cap 219, and the cavity 206 to be shown in more detail. As it can be seen in FIG. 27, the cavity 206 may generally have a chamfered portion around its terminal end, matching the geometries of the extremities of the heavier end 216 and the lighter end 218 to allow either the heavier end 216 or the lighter end 218 to sit inside the cavity 206. Another feature worth identifying in this cross-sectional view is the difference in the construction of the heavy end 216 and the lighter end 218. In order to create the mass difference between the heavy end 216 and the lighter end 218, the heavy end 216 could be a dense solid piece of tungsten, while the lighter end 218 could be a hollow piece of tungsten. In alternative embodiments of the present invention, the lighter end 218 could even be made out of lightweight material such as aluminum, steel, or any other material having a density lower than tungsten all without departing from the scope and content of the present invention. In a further alternative embodiment of the present invention lighter end 218 may even be formed out of the same piece as the remainder of the weighted insert 208 without departing from the scope and content of the present invention. In order to further exaggerate the weighting effects, the central portion of the weighted insert 208 may generally be a hollow composite type material, as shown in the cross-sectional view in FIG. 27. Finally, FIG. 27 shows a threaded cap 219 to coincide with a threaded entry portion of the cavity 206 to secure the weighted insert 208 within the cavity 206.

In an alternative embodiment of the present invention, the central portion of the weighted insert 208 could have some mass properties of its own. In one example, the central portion could have its own heavier side and a lighter side, creating even more weighting adjustments. In one setting, the heavier side 216 could be on the same side as the heavier side of the central portion, creating an ultra-heavy side and an ultra-light side to the weighted insert 208. However, in another setting, the heavier side 216 could be paired with the lighter side of the central portion, with the weighting characteristics of the components cancelling each other out to create a more neutral setting.

In a further alternative embodiment of the present invention, the cap 219 may contain a see through window within the "cavity of the opening" to allow the user to see the terminal surface of the weighted insert 208. The window, in one exemplary embodiment, may be made out of see through flexi-glass, however, numerous other materials may be used to provide a see through window without departing from the scope and content of the present invention. Having a see through window will allow the orientation of the weighted insert 208 to be seen without the need to disassemble the weighted insert 208 from the cavity 206. In order to achieve this, the end surfaces of the weighted insert 208 could be painted different colors, with each of the two different colors indicating whether the lighter end 218 or the heavy end 216 is shown.

Figure 28:
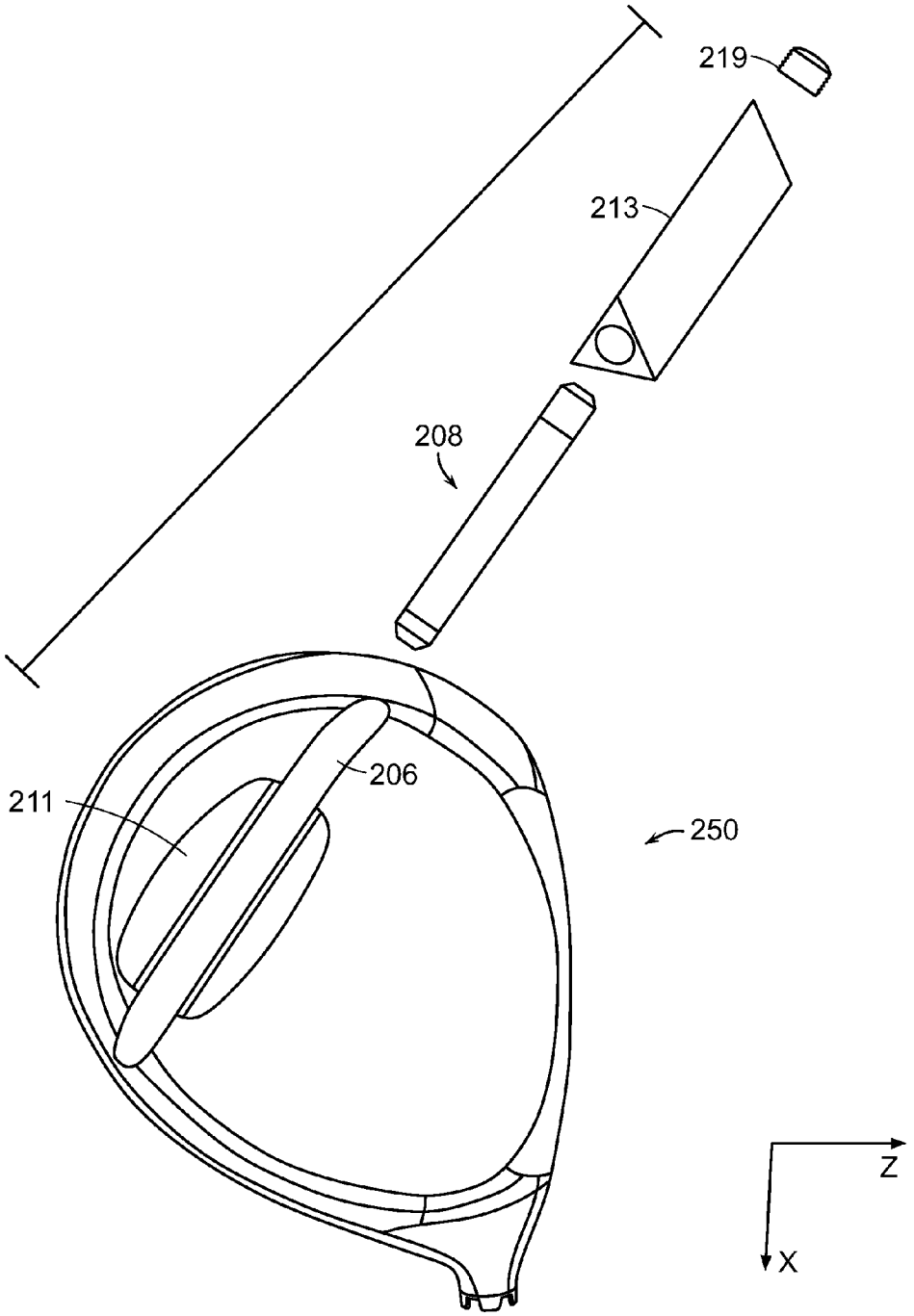
FIG. 28 is an exploded sole view of a golf club head according to a further alternative embodiment of the invention.

It should be noted that in this embodiment, the body portion of the weighted insert 208 is exposed to the external sole portion of the club head 250, which allows an external component such as a sleeve 213 to be used to adjust the way the club head 250 contacts a ground plane. FIG. 28 of the accompanying drawings shows this exploded view of an alternative embodiment of the present invention wherein an additional sleeve 213 is added to the assembly, coinciding with the exposed portion 211 of the cavity 206. The sleeve, as it can be seen, may generally circumferentially encompass the external surface of the weighted insert 208 to create the change in sole contact. In this embodiment, the sleeve 213 could be a triangular shape with each edge of the triangle having a different angle, thus creating three different methods for the golf club 250 to rest on the ground plane. However, numerous other geometries such as a cylindrical rod, a rectangular rod, an oval rod, or any other shape without departing from the scope and content of the present invention so long as it is capable of creating multiple different sole contacts. In a further alternative embodiment, the external walls of the sleeve 213 could even be tapered to create more of a change in the sole contact. The creation of different sole contact planes allows the golf club head to compensate and change for differences in the loft, lie, or even the face angle of the golf club head 250.

Figure 29:
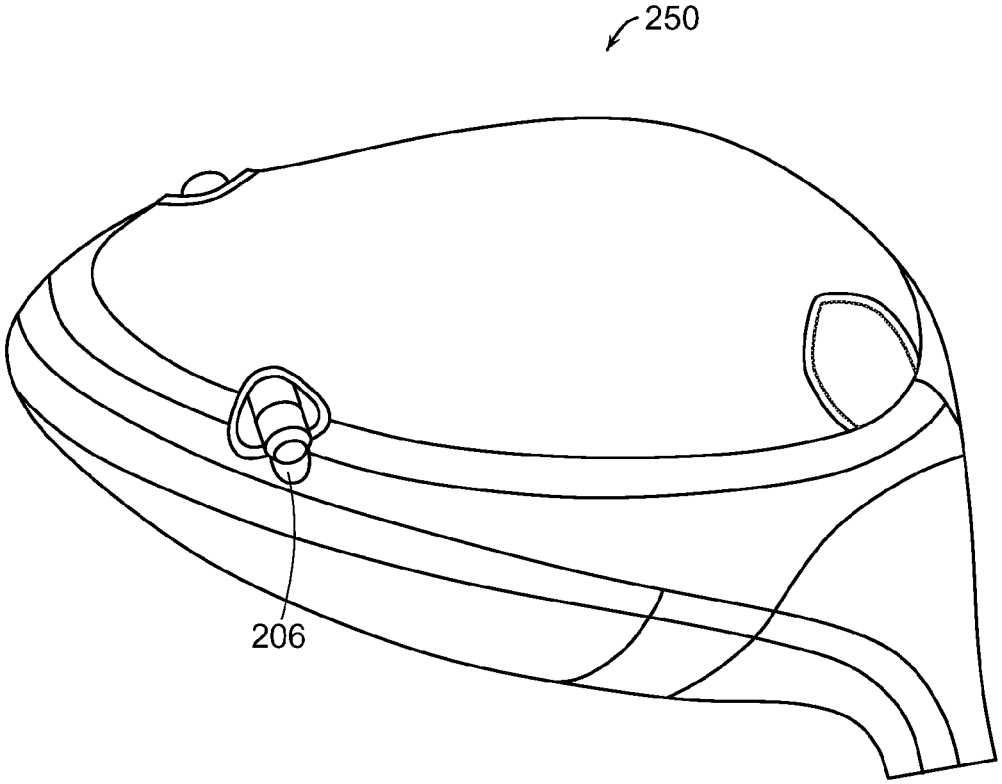
FIG. 29 is a perspective view of a golf club head in accordance with an alternative embodiment of the present invention.

Moving on to FIG. 29, a perspective sole view of a golf club head 250 in accordance with a further alternative embodiment of the present invention is shown. More specifically, the golf club head 250 shown in this embodiment is very similar to the golf club head 250 shown in FIGS. 25-28, except that the weighted insert 208 extends through the internal cavity of the golf club head 50 without being exposed to the sole portion of the golf club head. The weighted insert, although only exposed at the extremities, still have a cavity 206 at one end to allow the weighted insert to be used.

Figure 30:
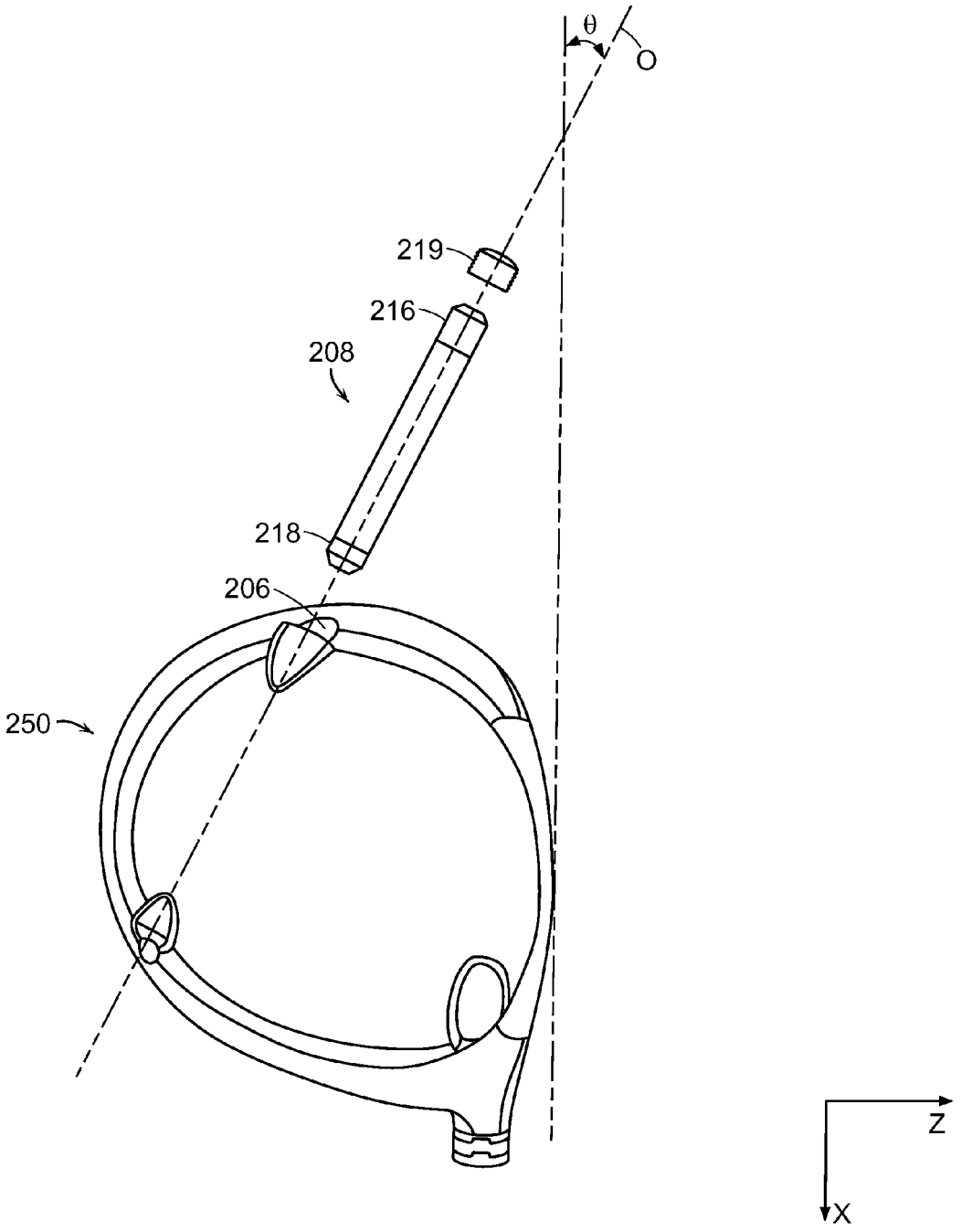
FIG. 30 is an exploded sole view of a golf club head according to the embodiment of FIG. 29.
Figure 31:
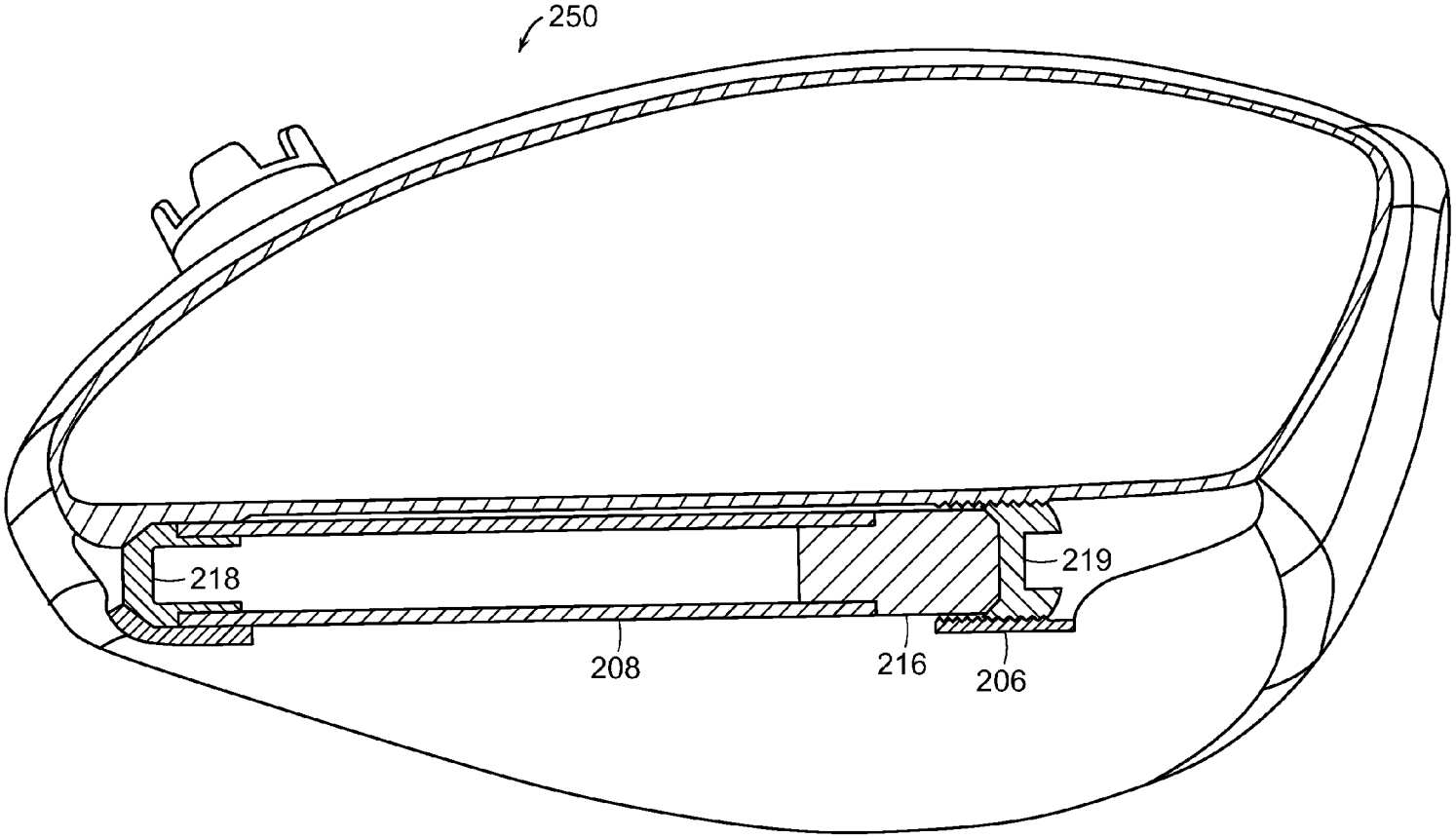
FIG. 31 is a cross-sectional view of a golf club head according to the embodiment of FIG. 30, taken across cross-sectional line O.

The exploded sole view of the golf club head 250 shown in FIG. 30 illustrates that the current embodiment still has the weighted insert placed along the axis O that is offset from the x-axis. The angle θ, similar to before, may generally be between about 0 to about 90 degrees in the positive direction, more preferably between about 3 to about 45 degrees, and most preferably between about 5 to about 35 degrees all without departing from the scope and content of the present invention. To illustrate the internal geometry of this alternative embodiment, a cross-sectional view is shown in FIG. 31 to provide and show how the weighted insert 208 is completely contained within the walls of the club head 250.

Figure 32:
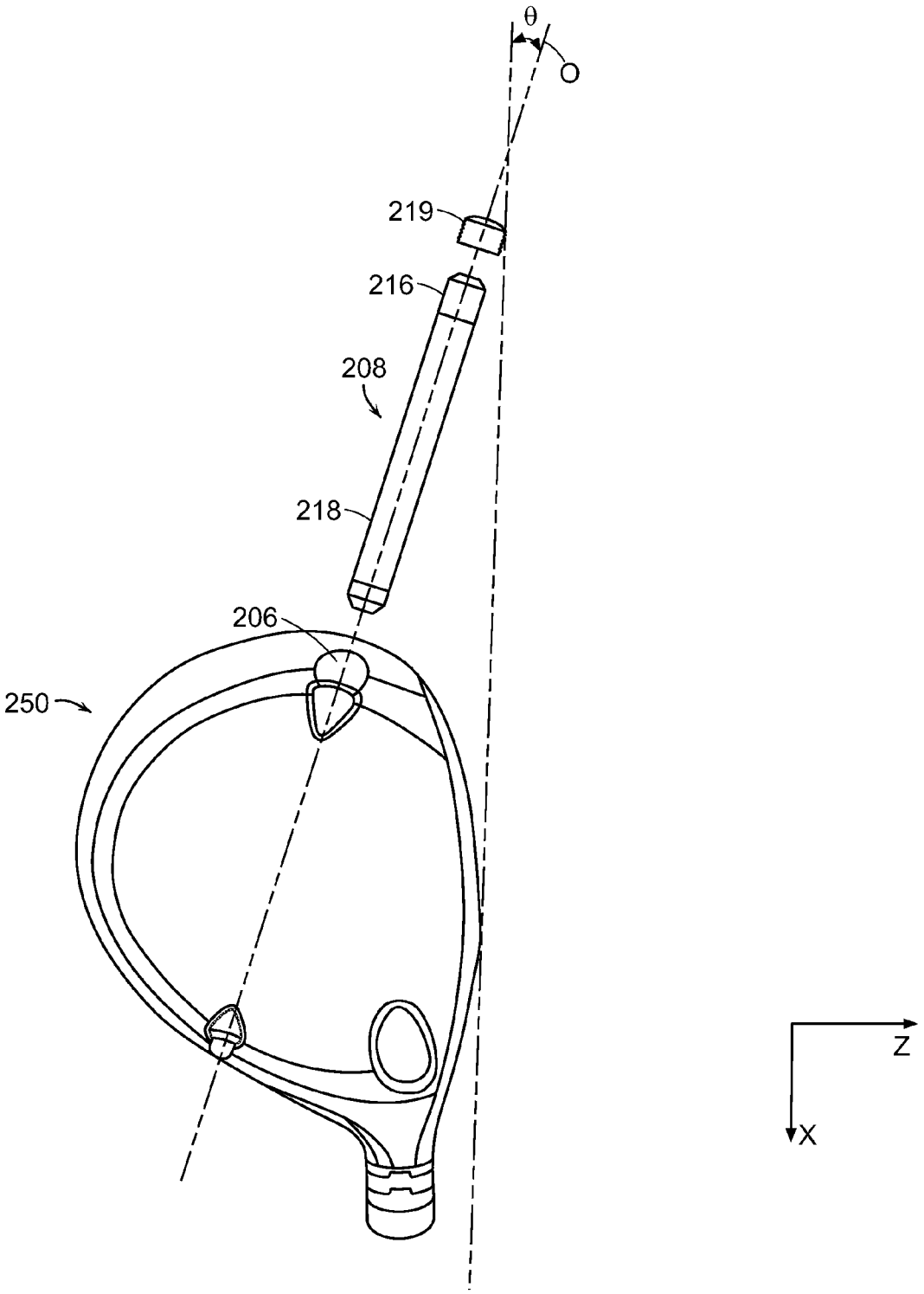
FIG. 32 is an exploded sole view of a golf club head according to a further alternative embodiment of the invention.
Figure 33:
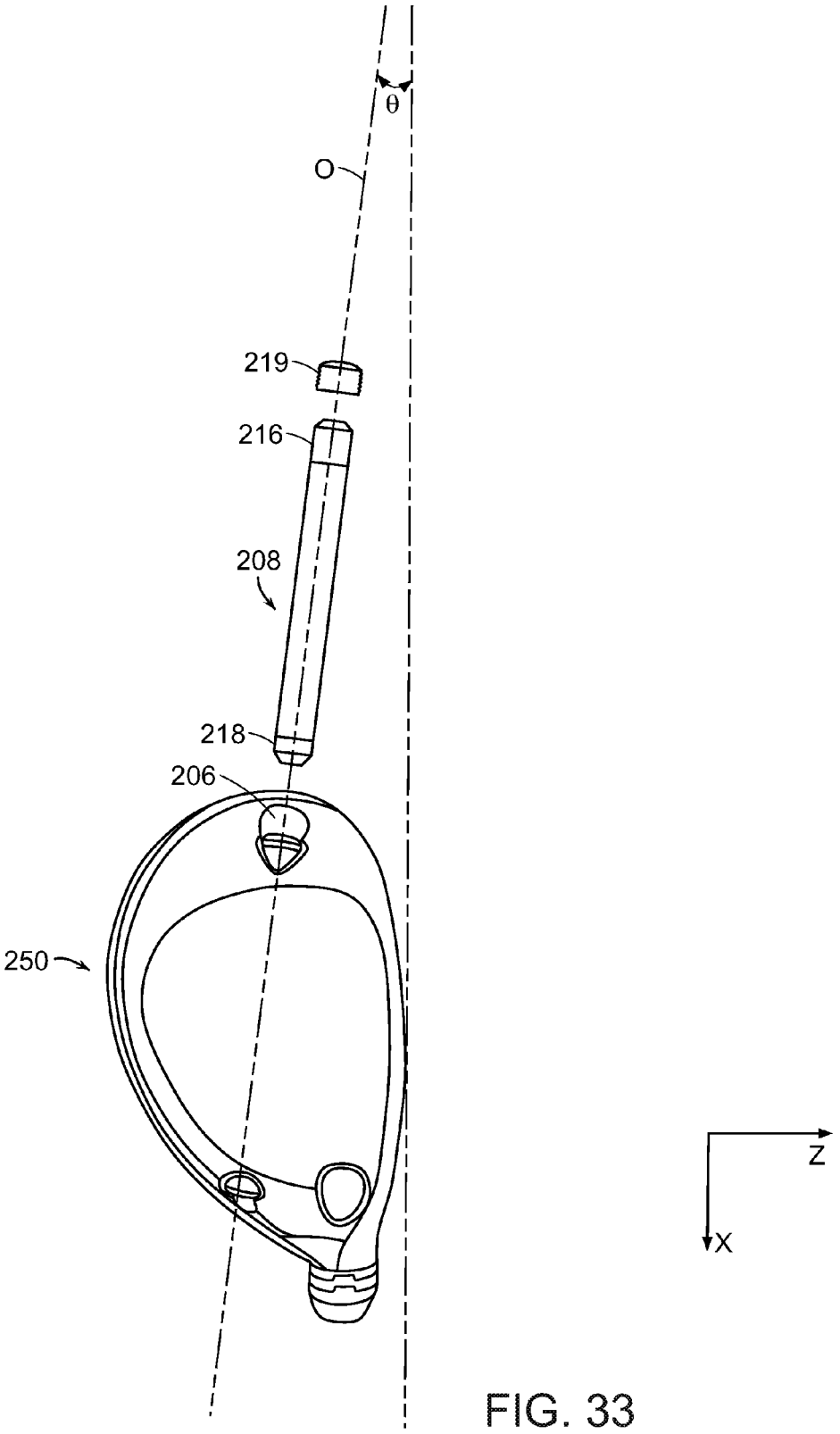
FIG. 33 is an exploded sole view of a golf club head according to a further alternative embodiment of the invention.

FIGS. 32 and 33 shows exploded sole views of club heads 250 in accordance with further alternative embodiments of the present invention. More specifically, the club heads 250 shown here may generally be smaller sized metalwood type club heads such as a fairway wood or a hybrid type club heads 250. It should be noted here that these embodiments illustrate a very important relationship between the volume of the golf club head 250 and the angle θ of the weighted insert 208 relative to the x-axis. Because the adjustment of the center of gravity of the golf club head 250 is a very specific art form, the angle θ of placement of the weighted insert 208 along the sole is a key factor. More specifically, the relationship between the angle θ and the volume of the club head 250 could be quantified as an Angle to Volume Ratio, wherein the Angle to Volume Ratio is defined as the angle θ of the placement of the weighted insert 108 divided by the volume of the club head 250. The current invention, may generally have an Angle to Volume Ratio of between about 0.02 degrees/cc to about 0.25 degrees/cc, more preferably between about 0.05 degrees/cc to about 0.25 degrees/cc, most preferably between about 0.10 degrees/cc to about 0.20 degrees/cc.

Figure 34:
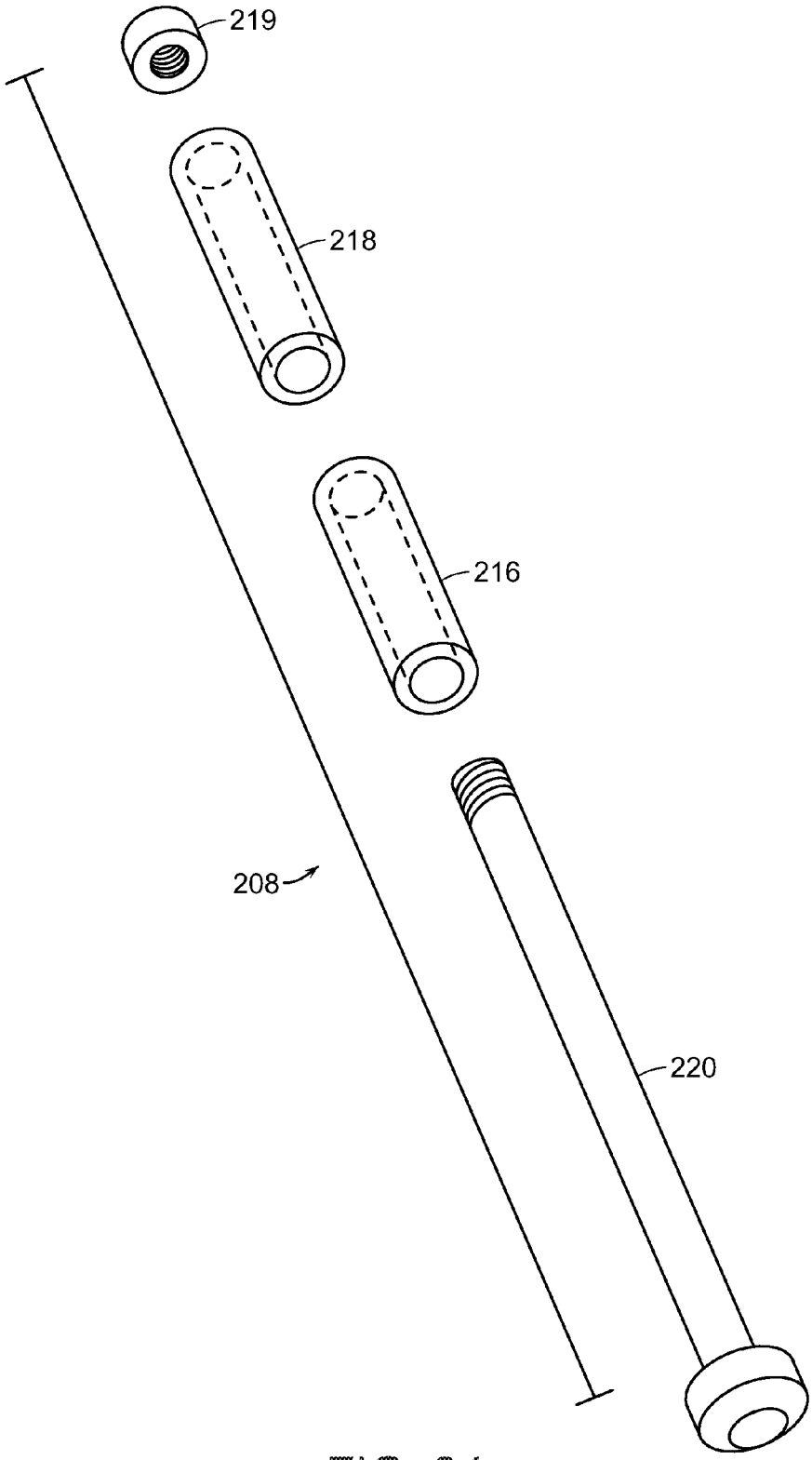
FIG. 34 is an exploded view of a weighted insert in accordance with an alternative embodiment of the present invention.

FIG. 34 of the accompanying drawings shows an exploded view of a weighted insert 208 in accordance with an alternative embodiment of the present invention. The weighted insert 208 has a heavy end 216 piece of the weighted insert 208 and a light end 218 piece of the weighted insert 208 being created by cylindrical pieces that removably slide around a bolt 220. By reversing the orientation of the heavy end 216 piece and the light end 218 piece, the center of gravity of the weighted insert 208 could be adjusted without departing from the scope and content of the present invention. Needless to say, in alternative embodiments of the present invention there could be more than two weight members with different mass properties without departing from the scope and content of the present invention.

Figure 35:
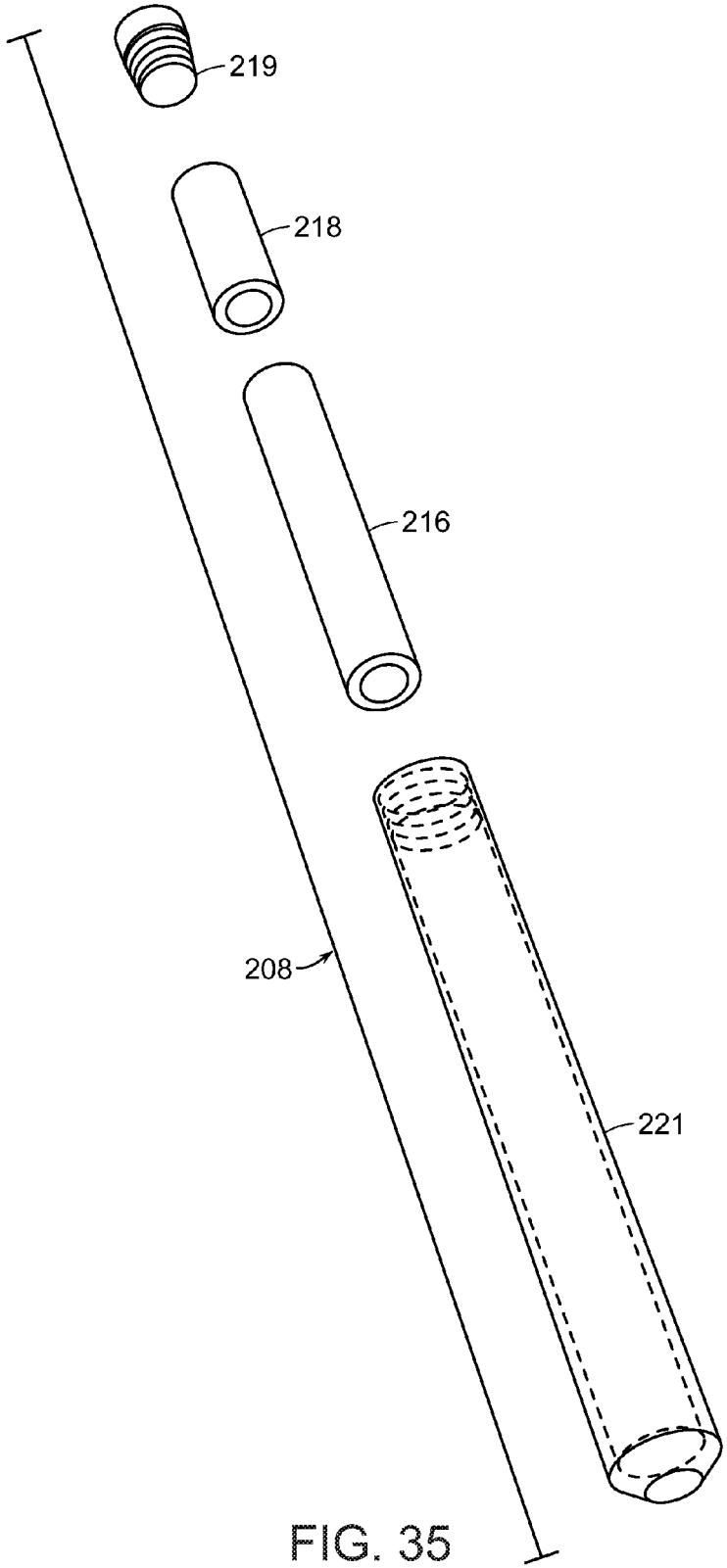
FIG. 35 is an exploded view of a weighted insert in accordance with another alternative embodiment of the present invention.

FIG. 35 of the accompanying drawings shows an exploded view of a weighted insert 208 in accordance with a further alternative embodiment of the present invention. The weighted insert 208 in this embodiment may be comprised of a heavy end 216 piece and a light end 218 piece, both fitting internally in a tube 221. Similar to the embodiment above, reversing the orientation of the heavy end 216 piece and the light end 218 piece can alter the center of gravity of the weighted insert 208, which can result in change of the center of gravity of the golf club head in general.

Figure 36:
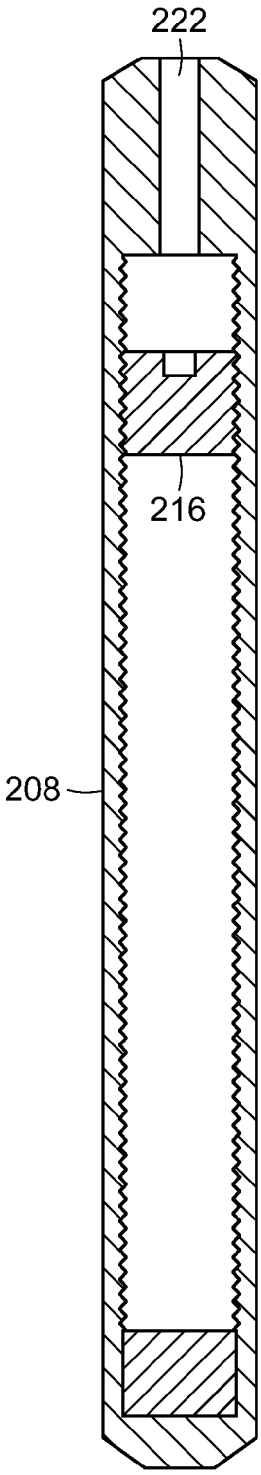
FIG. 36 is a cross-sectional view of a weighted insert in accordance with an alternative embodiment of the present invention.

FIG. 36 of the accompanying drawings shows a cross-sectional view of a weighted insert 208 in accordance with an even further alternative embodiment of the present invention. In this embodiment of the present invention, the weighted insert 208 may contain a heavy end 216 piece that is threaded externally like a screw. The external threads of the heavy end 216 piece may then engage internal threads in the tube to allow the heavy end 216 piece to provide an infinitesimal amount of adjustment settings throughout the threaded region of the tube. The heavy end 216 piece is rotated within the tube via a tool that engages the heavy end 216 piece via an opening in one side of the weighted insert 208.

Figure 37:
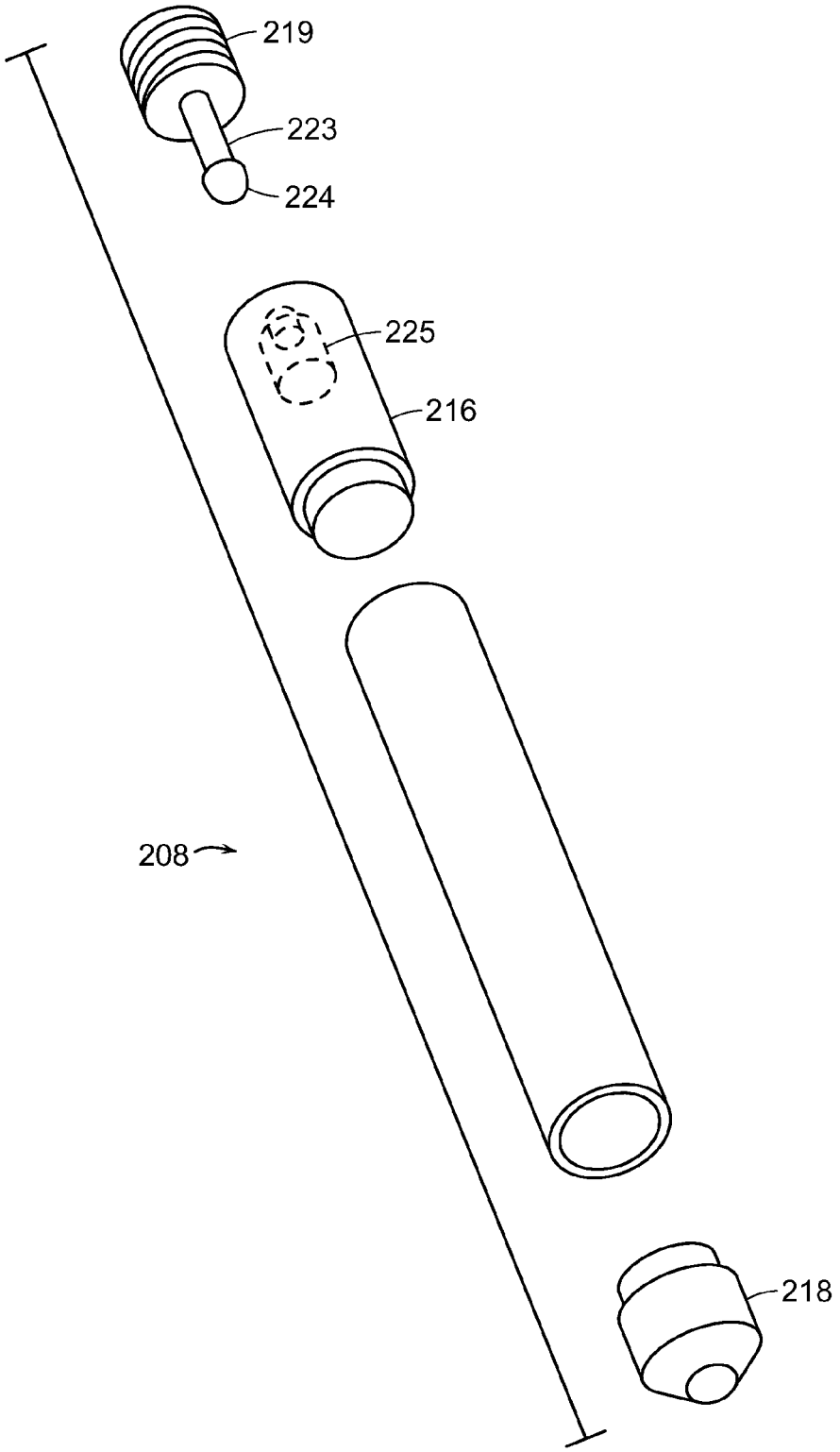
FIG. 37 is an exploded view of a weighted insert in accordance with another alternative embodiment of the present invention.

FIG. 37 of the accompanying drawings shows an exploded view of a weighted insert 208 in accordance with an even further alternative embodiment of the present invention wherein an alternative cap 219 is used. The cap 219 in this embodiment of the present invention may contain a pin 223 with a ball 224 at the end of the cap 219 to engage a "church key" shaped notch or slot 225. This ball and notch embodiment will allow the cap to be centered onto the weighted insert 208 and prevent the cap from being lost during disassembly and assembly. Although FIG. 37 only shows the ball and notch in the heavy end 216 portion of the weighted insert 208, the same geometry can be incorporated into the light end 218 to provide interchangeability of the orientation without departing from the scope and content of the present invention.

Figure 38:
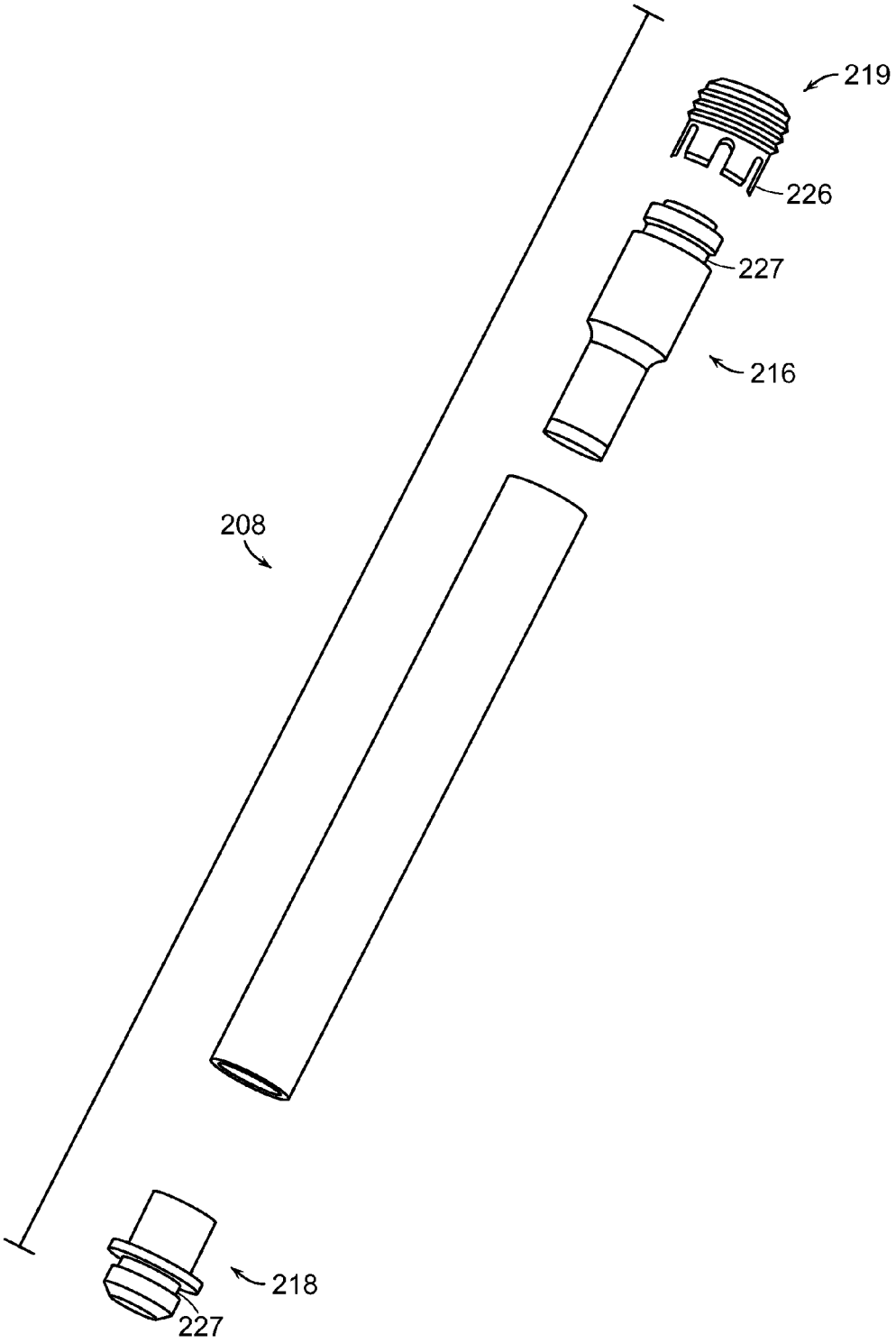
FIG. 38 is an exploded view of a weighted insert in accordance with another alternative embodiment of the present invention.

FIG. 38 of the accompanying drawings shows an exploded view of a weighted insert 208 in accordance with an even further alternative embodiment of the present invention. In this embodiment, the cap 219 is retained together with the weighted insert 208 using a snap fit 226 type mechanism that hooks onto a recessed rim 227 on the weighted insert 208 itself. In an alternative embodiment, the snap fit 226 could also be made out of a detent type mechanism that prohibits the cap from separating from the weighted insert 208 without departing from the scope and content of the present invention. It is worth noting that the weighted insert 208 has a recessed rim 227 at both the heavy end 216 and the light end 218, so the cap 219 could be placed at either extremity of the weighted insert without departing from the scope and content of the present invention.

Figure 39:
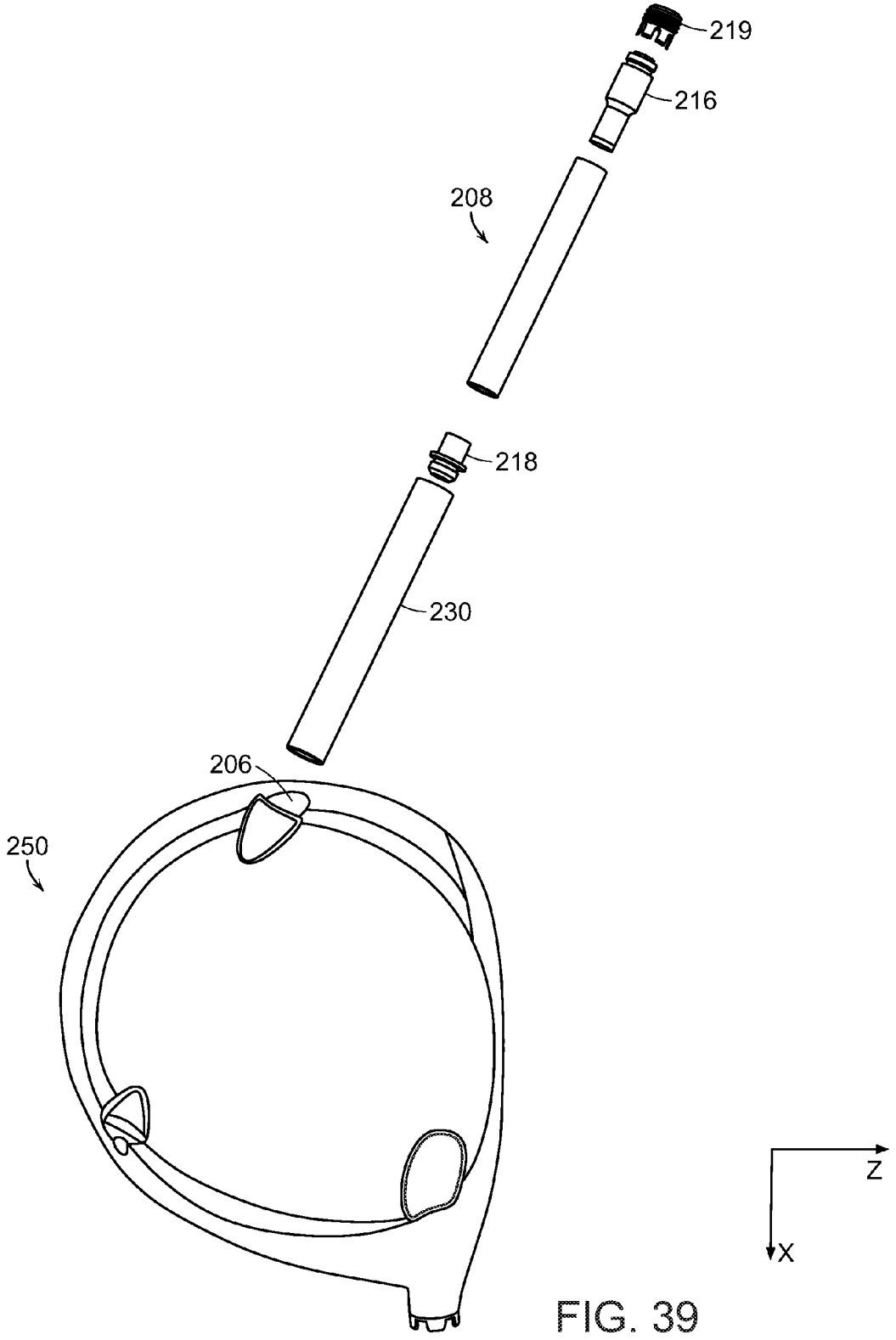
FIG. 39 is an exploded view of a golf club head having a weighted insert in accordance with an alternative embodiment of the present invention.

FIG. 39 of the accompanying drawings shows an exploded view of a golf club 250 in accordance with a further alternative embodiment of the present invention. The weighted insert 208 in this embodiment be further comprised of a tube 230 to shield the weighted insert 208 from contact with any potential debris in the cavity of the golf club head 250. In this embodiment the tube 230 may generally have a diameter that is slightly bigger than the diameter of the weighted insert 208, and be snap fit into the cavity 206 without departing from the scope and content of the present invention. However, in other embodiments, the tube 230 may also be threaded into position in the cavity 206 instead of being snap fit in to provide more structural rigidity also without departing from the scope and content of the present invention. Furthermore, the tube 230 may also be glued into place without departing from the scope and content of the present invention.

In a preferred embodiment of the present invention, the tube 230 may generally be made out of a plastic type material in order to create this barrier against debris without adding additional weight to the weighted insert. However, numerous other material could be used without departing from the scope and content of the present invention so long as it provides a cover for the weighted insert.

Figure 40:
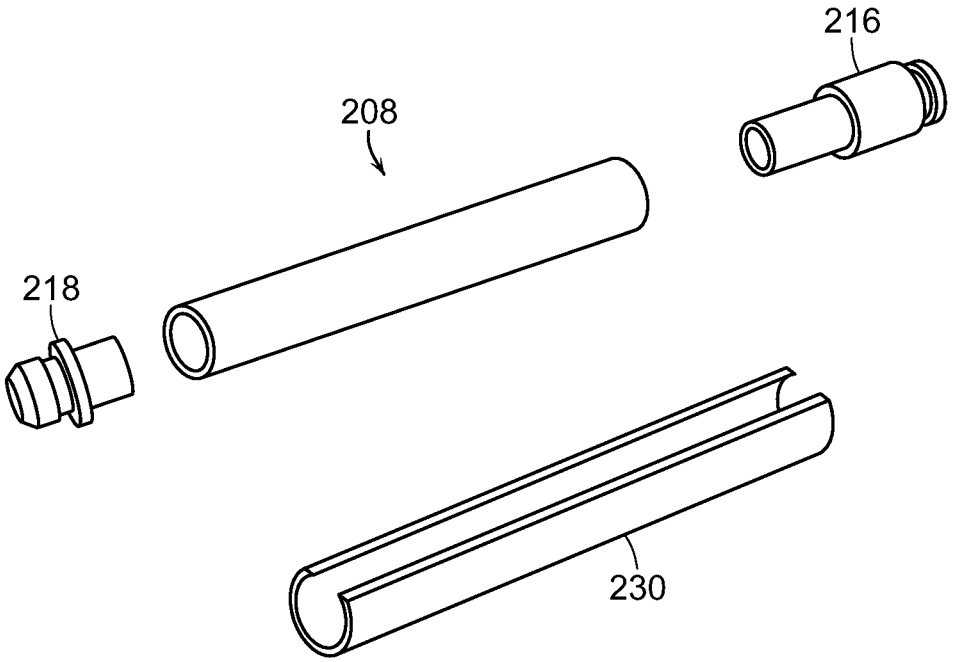
FIG. 40 is an exploded view of a weighted insert shown in FIG. 39.

FIG. 40 provides a close up view of the tube 230 in accordance with an embodiment of the invention as shown in FIG. 39. As it can be seen, the tube 230 has a notched opening, lengthwise along the entire length of the tube 230. This opening allows the tube to compress and reduce its diameter when it is being inserted into the cavity 206 shown in FIG. 39. When the tube decompresses thereby expanding its diameter, it will generally snap into a specific orientation within the cavity of the golf club head leaving the opening facing the crown portion of the golf club head. In an alternative embodiment of the present invention, the opening could be faced towards the back or front of the golf club head to promote to help with the stress levels without departing from the scope and content of the present invention. Having the opening of the tube facing the crown portion of the golf club head is beneficial because most of the debris in the cavity of the golf club head tends to be located towards the sole portion of the golf club head. In addition to the debris, it is common knowledge that a type of glue is usually injected into the internal cavity of the golf club head to make final adjustments to the club head weight. This glue type material, if it comes in contact with the weighted insert 206, may prevent it from being movable and interchangeable. In order to prevent this undesirable effect, the tube 230 cover is created to prevent such a contact.

Figure 41:
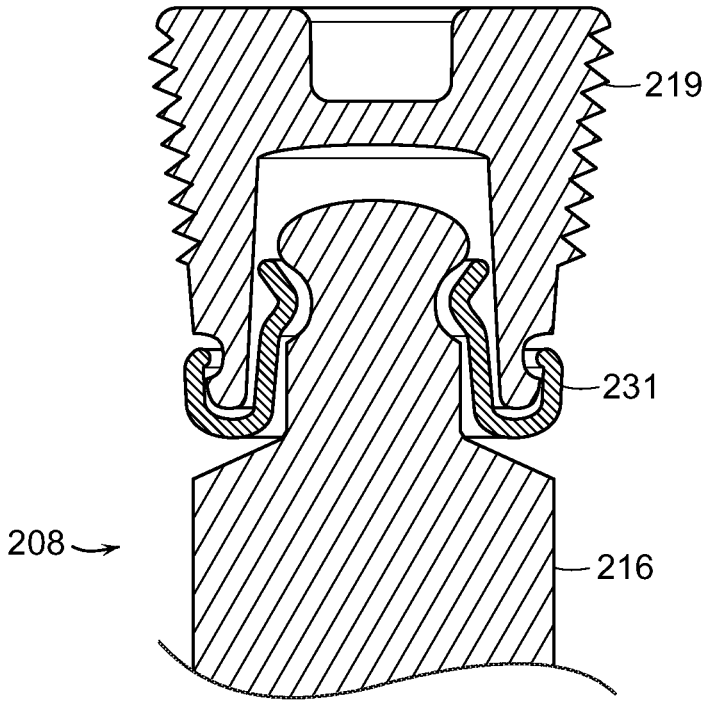
FIG. 41 is an enlarged cross-sectional view of a cap of the weighted insert in accordance with an alternative embodiment of the present invention.

FIG. 41 of the accompanying drawings shows an enlarged partial cross-sectional view of a weighted insert 208 in accordance with a further alternative embodiment of the present invention. In this embodiment, instead of using a snap fit or detent mechanism to secure the cap 219 to the heavy end 216 of the weighted member 208, a clip 231 is used to secure the cap 219 to the weighted insert 208.

Figure 42:
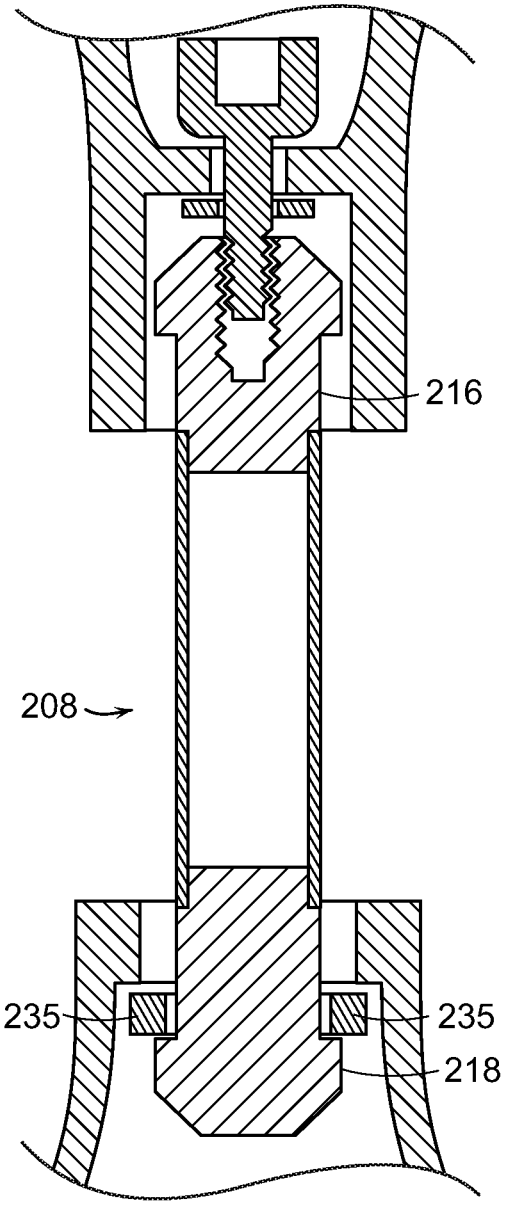
FIG. 42 is an enlarged cross-sectional view of a weighted insert in accordance with a further alternative embodiment of the present invention.

FIG. 42 of the accompanying drawings shows an enlarged partial cross-sectional view of a weighted insert 208 in accordance with another alternative embodiment of the present invention. In this embodiment, the weighted insert is retained in the golf club head in tension rather than in compression as all of the previous embodiments have shown. In this embodiment, there is a slidable retainer 235 that can travel lengthwise along the weighted insert 208 to provide a stopping point for the weighted insert 208. Once the retainer 235 is engaged, a screw can be used to secure the weighted insert in the cavity.

Figure 43:
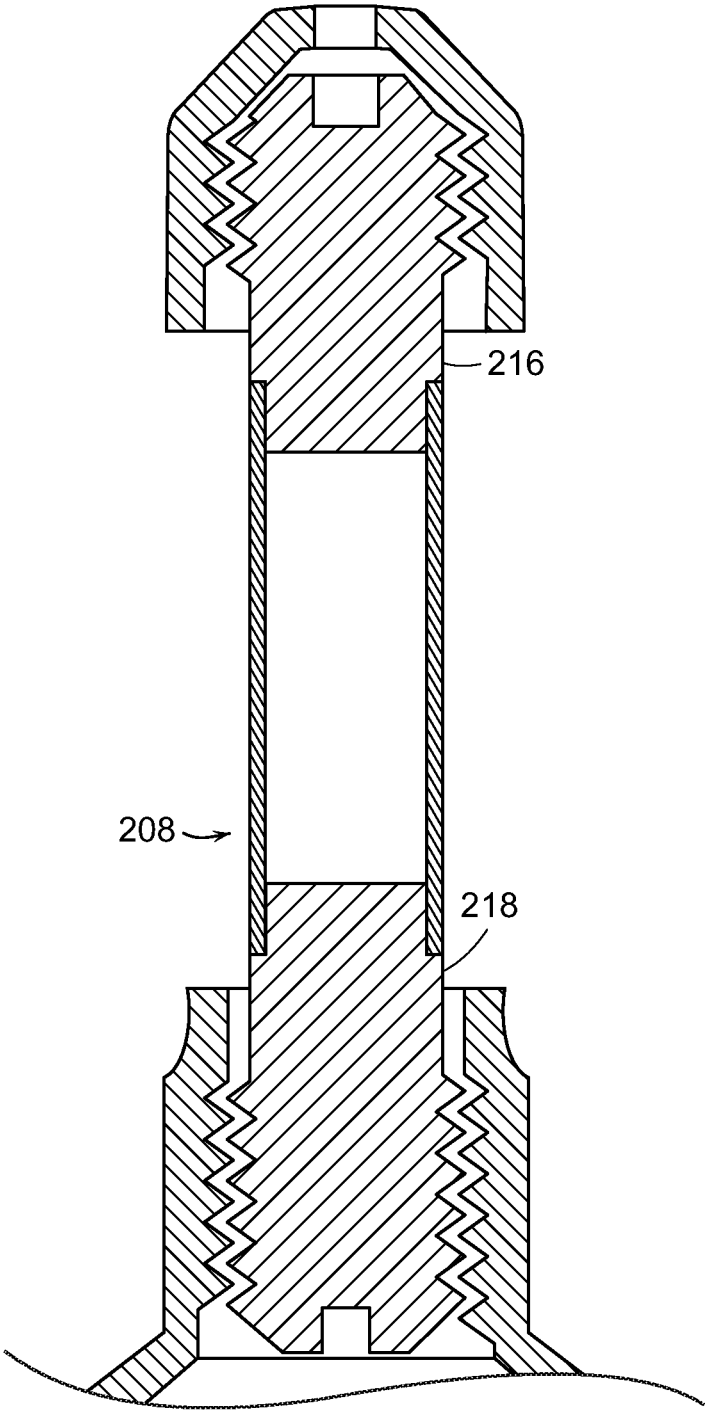
FIG. 43 is an enlarged cross-sectional view of a weighted insert in accordance with another alternative embodiment of the present invention.

FIG. 43 of the accompanying drawings shows an enlarged partial cross-sectional view of a weighted insert 208 in accordance with another further alternative embodiment of the present invention. In this embodiment of the present invention, the weighted insert 208 is neither in tension nor compression. Rather, the weighted insert may have threads on both the heavy end 216 and the light end 218 to more securely attach the weighted insert 208 to the golf club head.

Low friction lubricants, materials, and coatings could be added to various portions of the weighted inserts, caps, cavities, etc described herein. Some advantages might include allowing the weighted insert to rotate freely within the cavity during impact between the golf club head and golf ball without affecting the locking mechanisms and minimizing the risk of inadvertent unlocking of the weighted insert. Examples of low friction coatings may include, for example, physical vapor deposition, teflon, molybdenum disulfide, etc.

Figure 44:
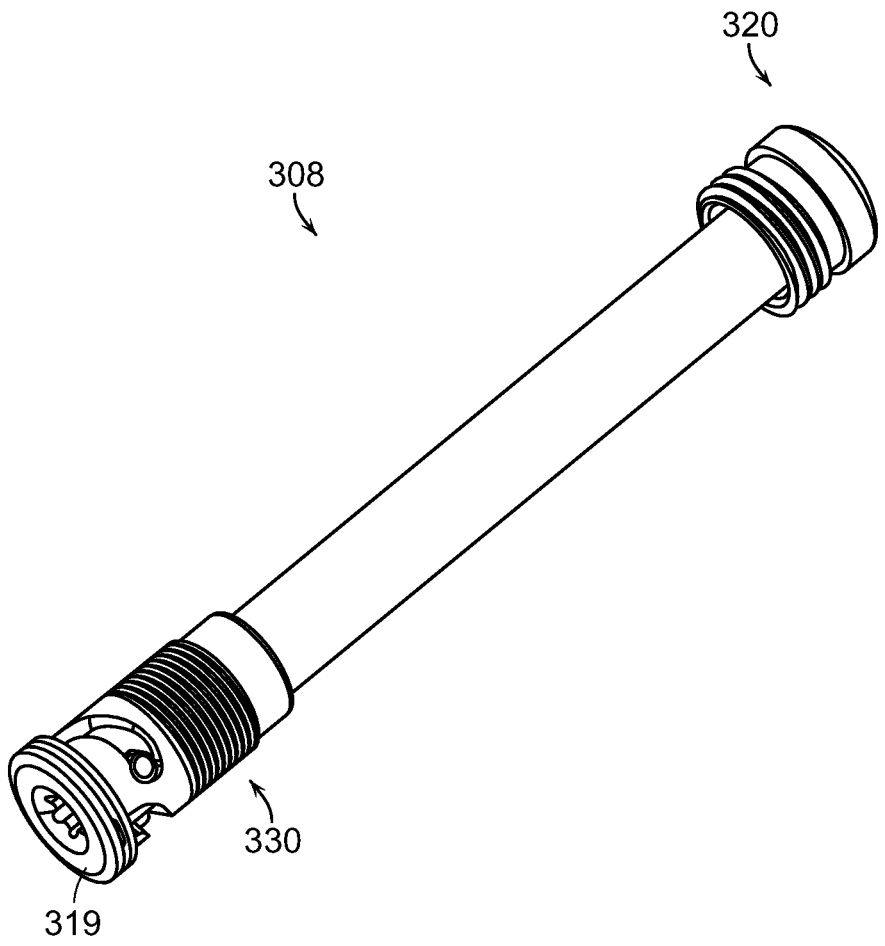
FIG. 44 of the accompanying drawings shows a perspective view of a weighted insert in accordance with another further alternative embodiment of the present invention.
Figure 45:
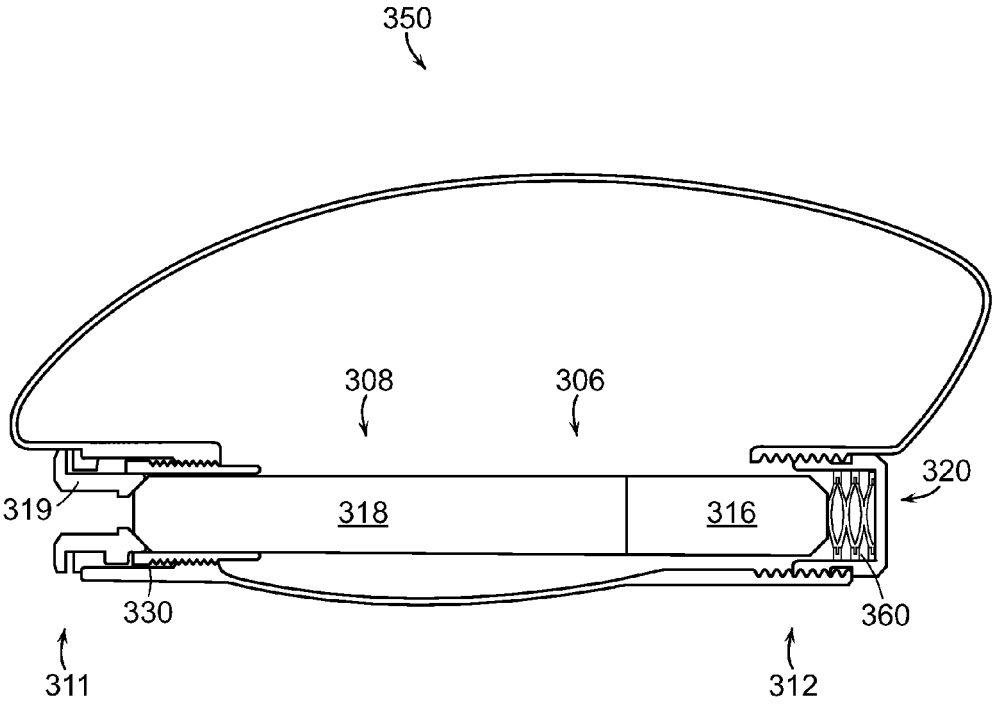
FIG. 45 illustrates a cross section of a golf club head including the weighted insert of FIG. 44.
Figure 46:
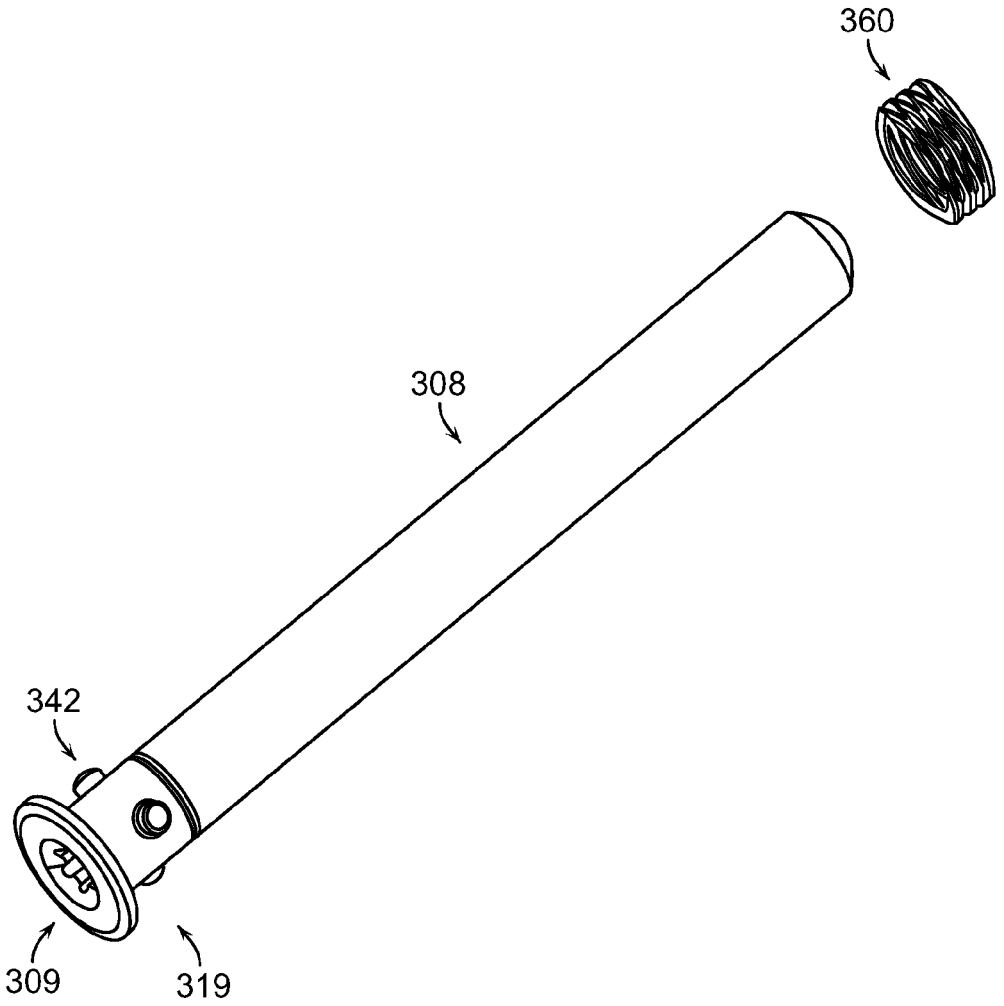
FIG. 46 illustrates a perspective view of the weighted insert of FIG. 44.
Figure 47:
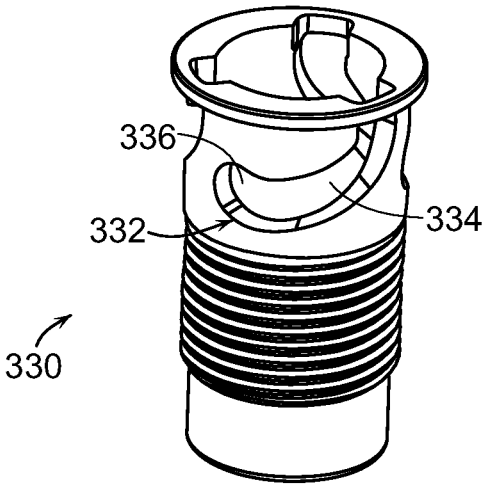
FIG. 47 illustrates a perspective view of a head locking member of the golf club head of FIG. 45.
Figure 48:
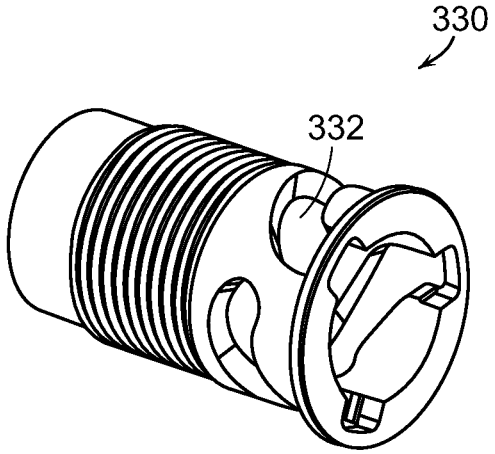
FIG. 48 illustrates a perspective view of a head locking member of the golf club head of FIG. 45.

FIG. 44 of the accompanying drawings shows a perspective view of a weighted insert 308 in accordance with another further alternative embodiment of the present invention. FIG. 45 illustrates a cross section of a golf club head 350 including the weighted insert 308 of FIG. 44. FIG. 46 illustrates a perspective view of the weighted insert 308 of FIG. 44. FIGS. 47 and 48 illustrate perspective views of a head locking member 330 of the golf club head 350 of FIG. 45. In this embodiment, the weighted insert 308 has a heavy end 316 and a light end 318. The weighted insert 308 can be inserted into a cavity 306 formed in the golf club head 350 either heavy end 316 first, as illustrated, or light end 318 first. By reversing the orientation of the weighted insert 308, the center of gravity of the golf club head 350 can be manipulated. The golf club head 350 can include a terminal member 320 at a terminal end 312 of the cavity 306 configured to receive the weighted insert 308. The golf club head 350 can also include a head locking member 330 configured to receive the weighted insert 308.

The weighted insert 308 can include an insert locking member 319 configured to lock the weighted insert 308 in the golf club head 350. The insert locking member 319 can be configured to engage the head locking member 330. The insert locking member 319 can include an insert locking feature 342, as illustrated in FIG. 46. The head locking member 330 can include a head locking feature 332 as illustrated in FIGS. 47 and 48. The insert locking feature 342 and head locking feature 332 can be configured to lock the weighted insert 308 in the cavity 306 of the golf club head 350 by rotating the insert locking member 319 relative to the head locking member 330. In a preferred embodiment, as illustrated in FIGS. 44-48, the head locking member 330 and insert locking member 319 are configured to lock the weighted insert 308 with less than 180 degrees of rotation of the insert locking member 319. In a more preferred embodiment, the head locking member 330 and insert locking member 319 are configured to lock the weighted insert 308 with less than 135 degrees of rotation. In a more preferred embodiment, the head locking member 330 and insert locking member 319 are configured to lock the weighted insert 308 with less than 90 degrees of rotation. In some embodiments, as illustrated in FIGS. 45 and 46, the insert locking member 319 can abut the end of the weighted insert 308, forcing it towards the terminal end of the cavity 306. In some embodiments, it may releasably engage to each end of the weighted insert 308 similar to the cap 219 as illustrated in FIG. 38. In other embodiments, the insert locking member 319 can be affixed to the weighted insert 308. In some embodiments, the insert locking member 319 may be formed integrally with the weighted insert 308. In some embodiments, the weighted insert can include an insert locking member 319 at both ends of the weighted insert 308.

As illustrated in FIGS. 44, 47, and 48, the head locking feature 332 of the head locking member 330 includes at least one slot 334 angled relative to a longitudinal axis of the weighted insert 308, the longitudinal axis extending through the center and along the length of the weighted insert 308. The insert locking member 319, as illustrated in FIG. 46, includes at least one protrusion configured to slide within the slot 334. The insert locking member 319 also includes a tool engagement feature 309 configured to interact with a tool and allow a user to apply a torque to the insert locking member 309. As the insert locking member 319 is rotated relative to the head locking member 330, the protrusion slides along the slot 334, forcing the insert locking member 319 to translate longitudinally towards the terminal member 320, forcing the weighted insert 308 towards the terminal end 312 of the cavity 306. Additionally, a spring 360 may be included in the cavity 306. The spring 360 can be located near the terminal end 312 of the cavity 306 as illustrated in FIG. 45. In additional embodiments, the spring 360 may be located in the open side 311 of the cavity 306. In some embodiments, the spring 360 could be located in the insert locking member 319. In another embodiment, the spring 360 could be located in a cap. The spring 360 can be compressed as the insert locking member 319 forces the weighted insert 308 towards the terminal end 312 of the cavity 306. The head locking feature 332 can include a locked position which locks the weighted insert 308 in the cavity 306. As illustrated in FIGS. 47 and 48, the slot 334 can include a detent 336 such that at full rotation of the insert locking member 319, the insert locking member 319 along with the weighted insert 308 is forced away from the terminal end 312 of the cavity 306 by the spring 360 a small distance, locking the protrusion of the insert locking feature 342 into the detent 336 of the slot 334 of the head locking member 330. Another way to describe the detent 336 would be that the slot 334 has an inflection point such that rotation of the insert locking member 319 initially forces the insert locking member 319 towards the terminal end 312 of the cavity 306 but once the insert locking feature 342 passes the inflection point in the slot 334, the insert locking member 319 is forced away from the terminal end 312 of the cavity 306. The insert locking member 319 is held in the locked position by the spring 360 forcing the insert locking feature 342 into the detent 336 of the slot 334, preventing rotation of the insert locking member 319 and thus preventing translation of the weight insert 308. In some embodiments, examples of springs 360 may include, coil springs, wave washer springs, conical washer springs, rubber springs, elastomer springs, as well as combinations thereof, etc.

The terminal member 320 and/or head locking member 330 can be integrated into various portions of the golf club head 350 which may include, for example, the sole (as illustrated), the skirt, the crown, etc. The terminal member 320 and/or head locking member 330 can be formed integrally in the club head 350 or it can be formed separately and affixed to the club head 350 as illustrated in FIG. 45. The terminal member 320 and/or head locking member 330 could be affixed to the golf club head 350 in a number of ways which may include, for example, welding, adhesive, threaded engagement, etc. FIG. 45 depicts the terminal member 320 and head locking member 330 incorporating male threads which engage female threads formed in the cavity 306 of the golf club head 350.

Figure 49:
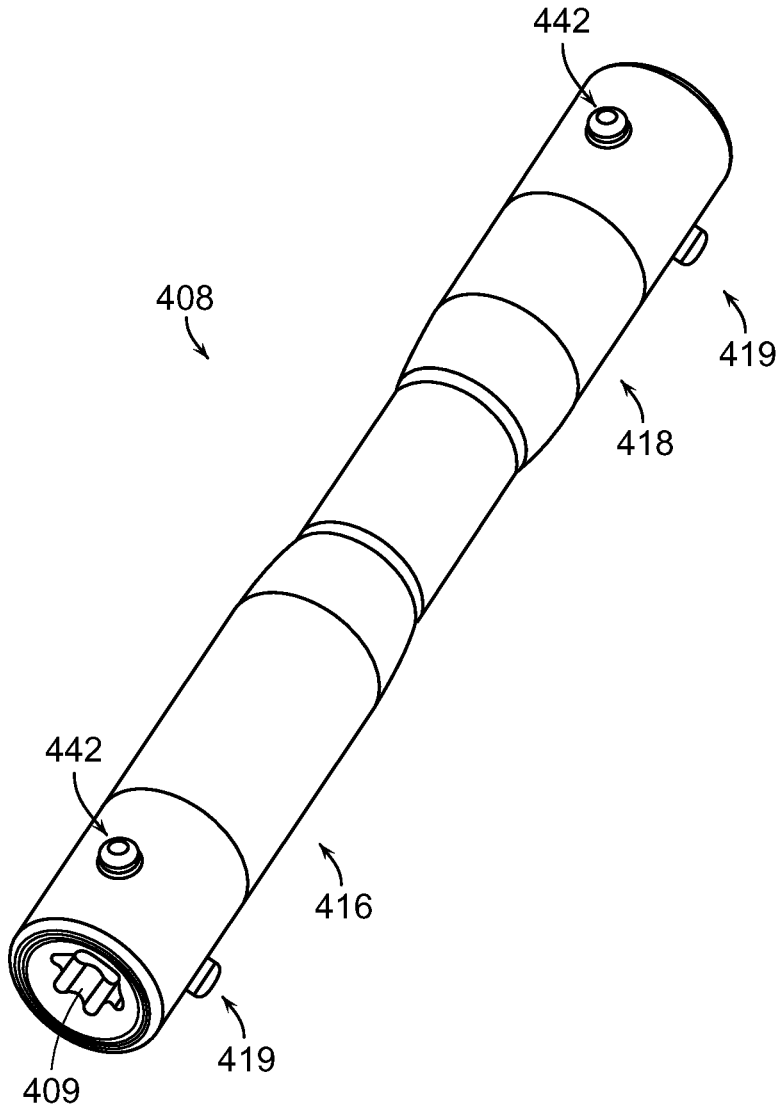
FIG. 49 of the accompanying drawings shows a perspective view of a weighted insert in accordance with another further alternative embodiment of the present invention.
Figure 50:
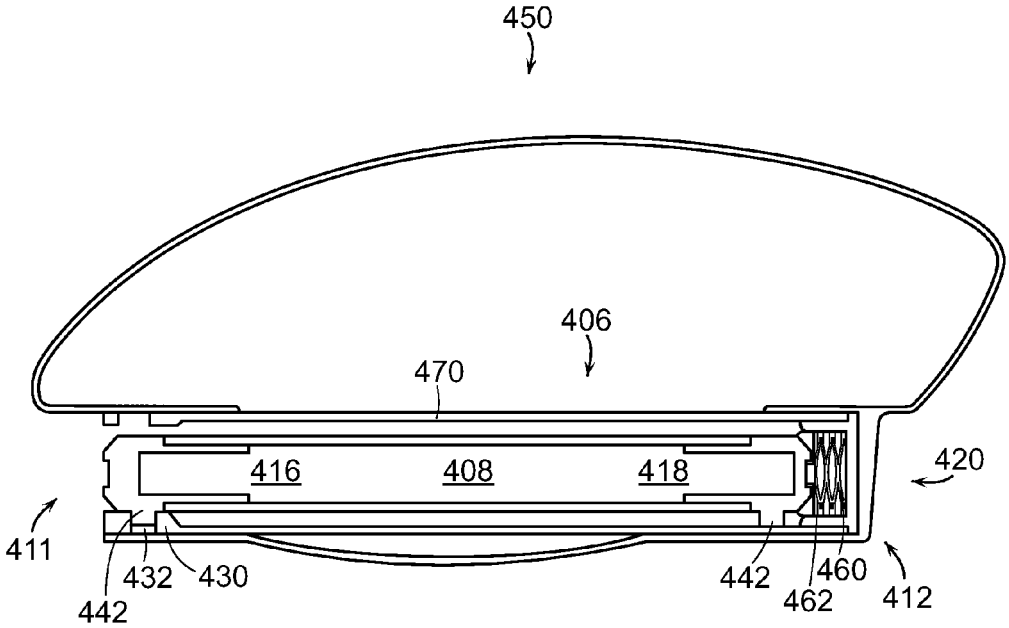
FIG. 50 illustrates a cross section of a golf club head including the weighted insert of FIG. 49.
Figure 51:
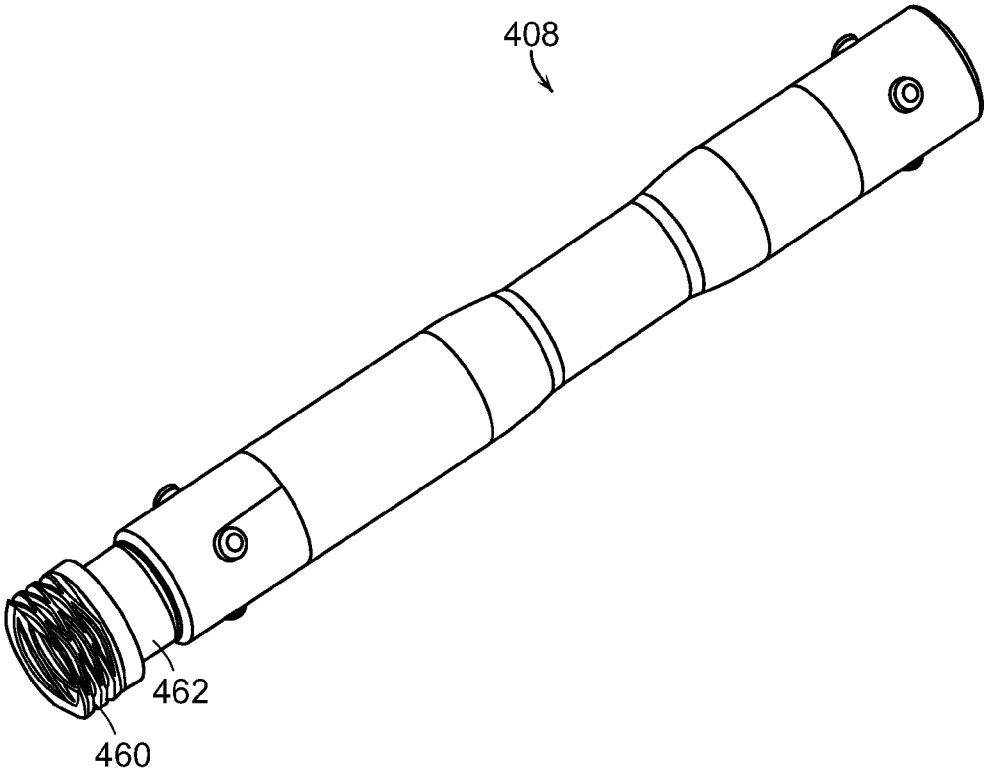
FIG. 51 illustrates a perspective view of the weighted insert of FIG. 49 including a spring and centering member.
Figure 52:
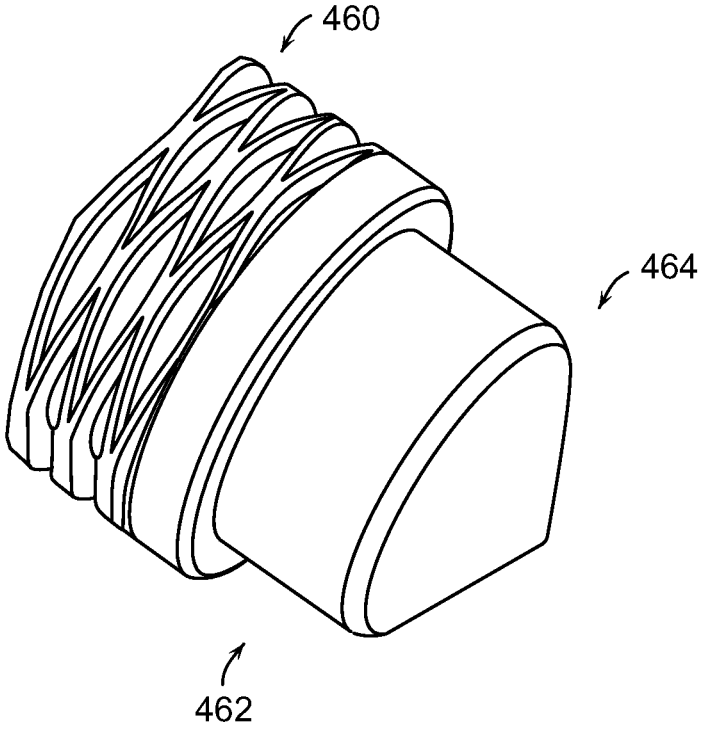
FIG. 52 illustrates a perspective view of the spring and centering member of FIG. 51.
Figure 53:
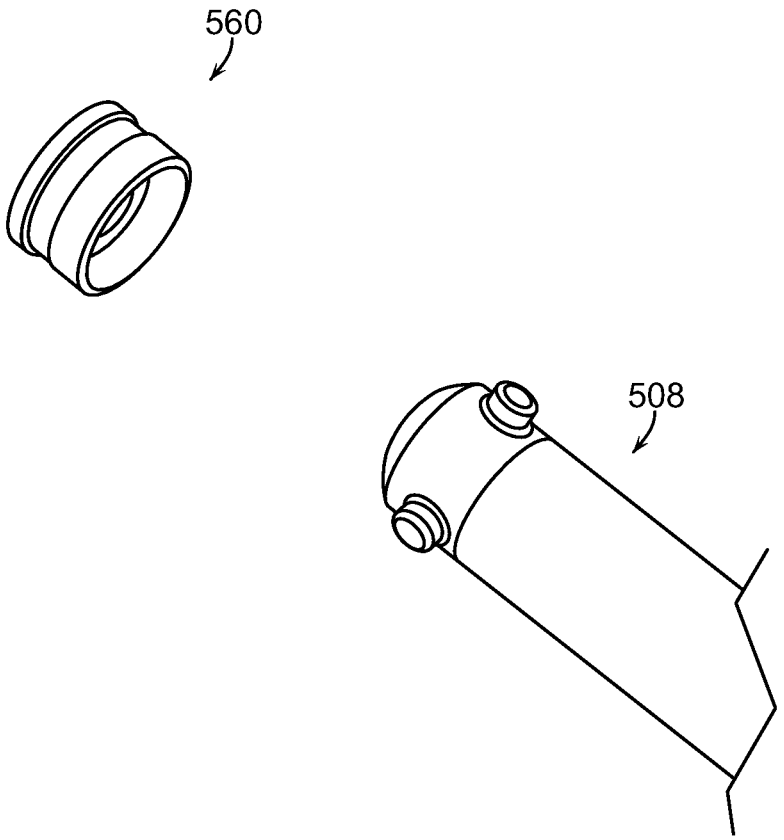
FIG. 53 illustrates a perspective view of a spring.
Figure 54:
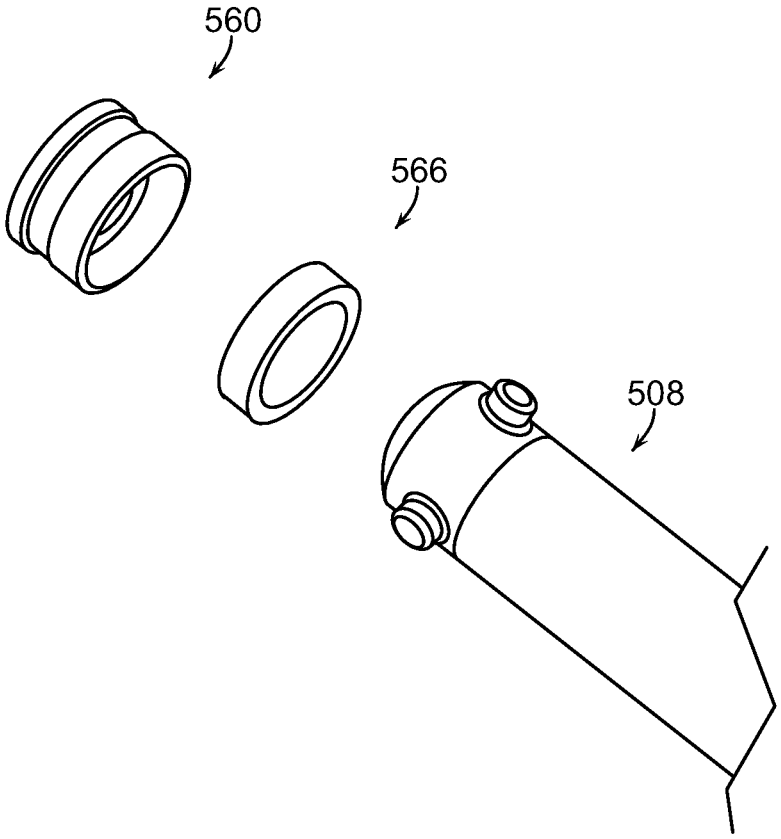
FIG. 54 illustrates a perspective view of a low friction member as well as the spring of FIG. 54.

FIG. 49 of the accompanying drawings shows a perspective view of a weighted insert 408 in accordance with another further alternative embodiment of the present invention. FIG. 50 illustrates a cross section of a golf club head 450 including the weighted insert 408 of FIG. 49. FIG. 51 illustrates a perspective view of the weighted insert 408 of FIG. 49 including a spring 460 and centering member 462. FIG. 52 illustrates a perspective view of the spring 460 and centering member 462 of FIG. 51. FIG. 53 illustrates a perspective view of a spring 560. FIG. 54 illustrates a perspective view of a low friction member as well as the spring of FIG. 53.

The weighted insert 408 includes an insert locking member 419 integrated into each end of the weighted insert 408. This allows the weighted insert 408 to be flipped and reinserted into the golf club head 450 without the need to remove and reattach a removable insert locking member to the opposite end of the weighted insert 408. The head locking member 430 head locking feature 432 can include an additional track (not illustrated) to ensure the insert locking feature 442 can pass through, allowing the weighted insert 408 to be fully inserted into the cavity 406 of the golf club head 450. In another embodiment, the head locking member 430 could be centrally located in the cavity 406 and insert locking member 419 could be centrally located on the weighted insert 408, allowing a single insert locking member 419 to interact with the head locking member 430, no matter the orientation of the weighted insert 408.

As illustrated in FIGS. 50 and 51, the cavity 406 can include a spring 460 and a centering member 462. The spring 460 can function as described in earlier embodiments. The spring 460 illustrated in FIG. 52 is composed of wave washers. Additionally, a centering member 462 can also reside in the cavity 406 to transfer the force of the spring 460 to the weighted insert 408. The centering member 462 can include a centering feature 464 which is pointed to help center the weighted insert 408 within the cavity 406 at the terminal end 412 of the cavity 406. The centering member 462 can be configured to engage the tool engagement feature 409 of the weighted insert 408. The centering member 462 can be configured to have a low coefficient of friction relative to either the weighted insert 408 or the spring 460, allowing the weighted insert 408 to rotate relative to the golf club head 450. In other embodiments, the weighted insert 408 can be centered by the inner wall of the terminal member of the cavity 406. As illustrated in FIGS. 53 and 54, the spring 560 can be non-metallic and may be comprised of rubber, elastomer, plastic, or other compressible materials. The spring 560 may also have reliefs formed in its geometry so as to ensure it does not become infinitely stiff as it is compressed inside the terminal end 412 of the cavity 406. Additionally, the weighted insert 508 and spring 560 may have tapered surfaces configured to engage one another when the weighted insert 508 is inserted into the cavity 406 of the golf club head 450. In some embodiments, as illustrated in FIG. 54, a low friction member 566 may be installed between the spring 560 and weighted insert 508 to promote low friction between the weighted insert 508 and spring 560, allowing the weighted insert 508 to rotate freely.

Figure 55:
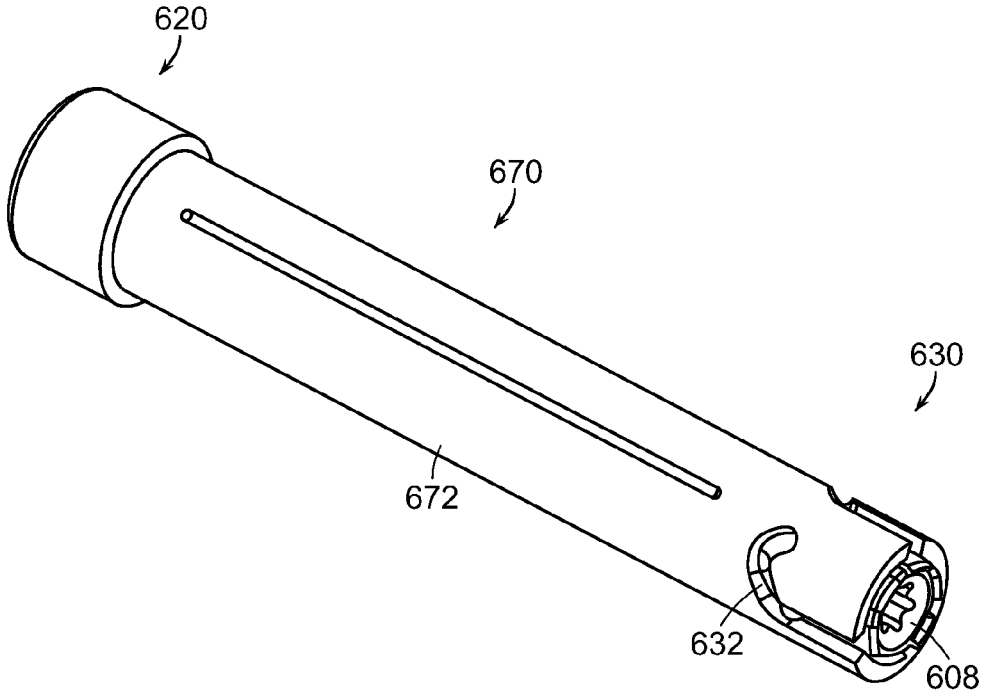
FIG. 55 of the accompanying drawings shows a perspective view of an insert retaining member.

FIG. 55 of the accompanying drawings shows a perspective view of an insert retaining member 670. The embodiment illustrated in FIG. 59 incorporates the terminal member 620, and head locking member 630 into an insert retaining member 670. This allows the entire assembly to be permanently installed in the golf club head as a single piece, reducing assembly costs. In addition to including a head locking feature 632 to lock the weighted insert 608 in place, the insert retaining member 670 can include a sheath portion 672 (see FIG. 55) preventing debris and/or hot melt within the golf club head from contacting the weighted insert 608. In some embodiments, the sheath portion can be made of a lightweight material such as plastic and can also be made very thin. The sheath can be multi-material in that it includes a base structural portion with a plurality of apertures which is covered with a thin lightweight material sealing off the cavity from the remainder of the golf club head interior. The insert retaining member can be formed from a single piece or can be formed of a plurality of pieces. The insert retaining member can be permanently adhered to the golf club head in a number of ways which may include, for example, adhesives, welding, etc.

Figure 56:
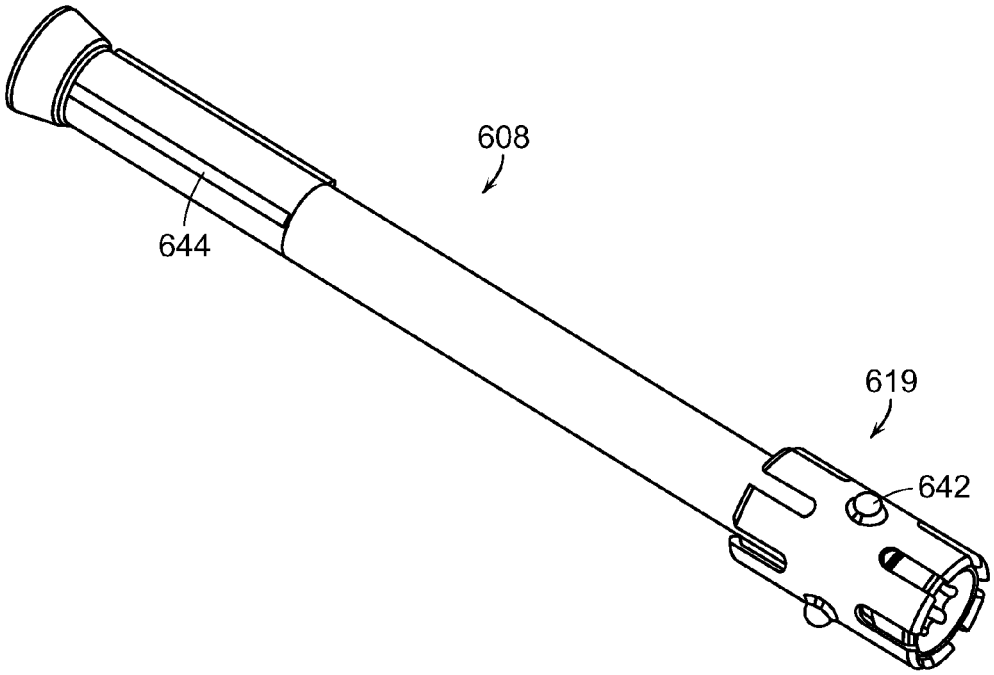
FIG. 56 illustrates a perspective view of a weighted insert with a sliding insert locking member.
Figure 57:
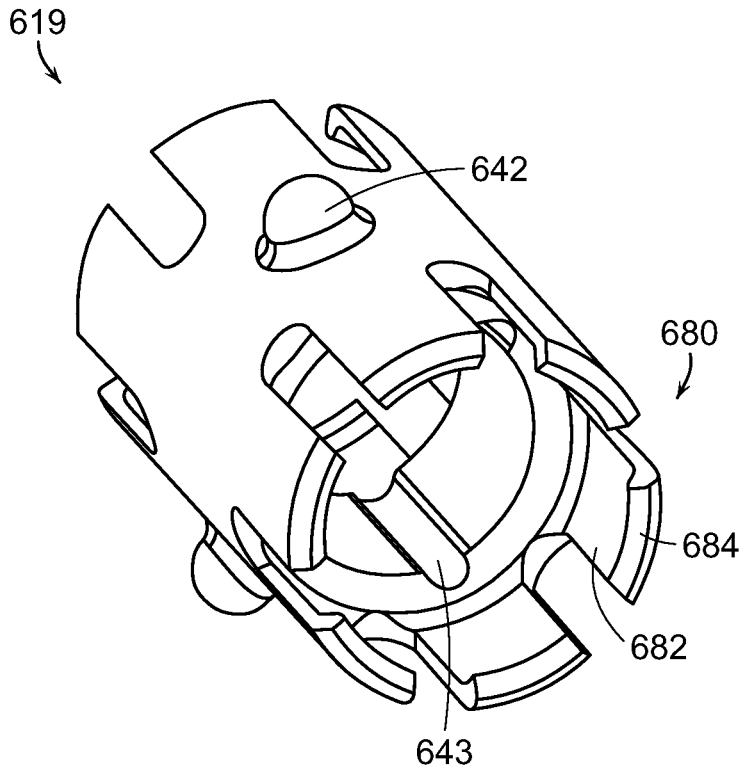
FIG. 57 illustrates a perspective view of a sliding insert locking member.
Figure 58:
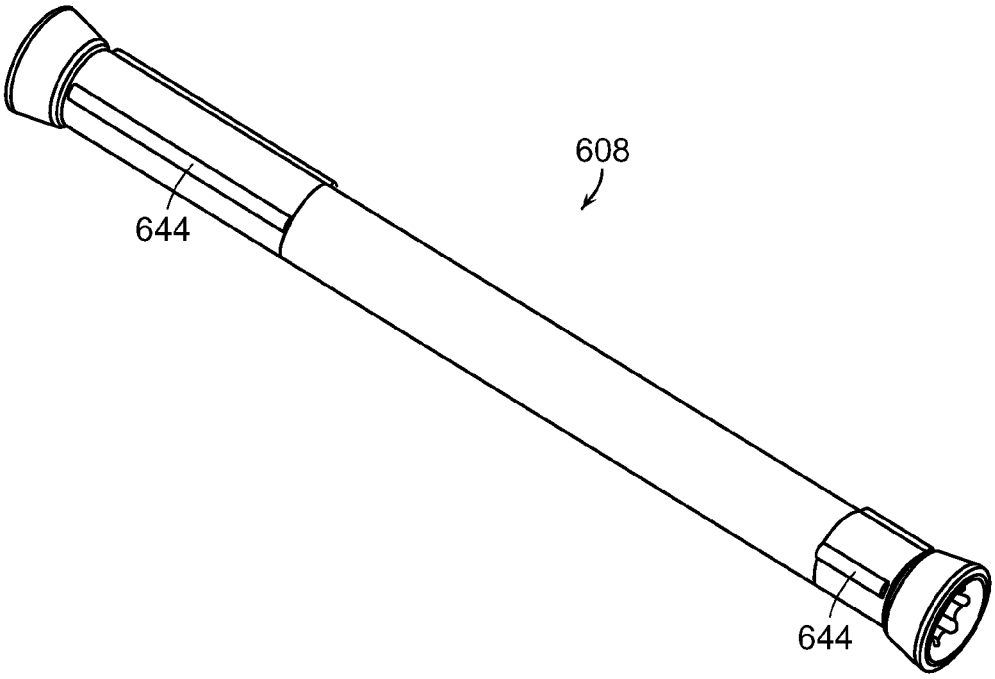
FIG. 58 illustrates a perspective view of the weighted insert of FIG. 56.
Figure 59:
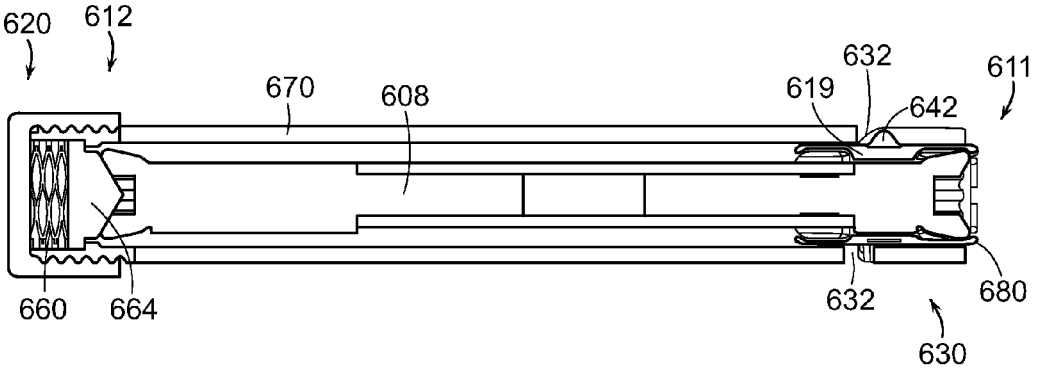
FIG. 59 illustrates a cross sectional view of the weighted insert of FIG. 56 installed in the insert retaining member of FIG. 55.

FIG. 56 illustrates a perspective view of a weighted insert 608 with a sliding insert locking member 619. FIG. 57 illustrates a perspective view of a sliding insert locking member 619. FIG. 58 illustrates a perspective view of the weighted insert 608 of FIG. 56. FIG. 59 illustrates a cross sectional view of the weighted insert 608 of FIG. 56 installed in the insert retaining member 670 of FIG. 55. The sliding insert locking member 619 of FIGS. 56-59 is configured to slide along the weighted insert 608 when the orientation of the weighted insert 608 is flipped, allowing it to be located at the opening of the cavity and to engage the head locking feature 632, locking the weighted insert 608 in place.

The weighted insert 608 can include anti-rotation features 644 configured to engage anti-rotation features 643 on the sliding insert locking member 619, allowing torque applied to the weighted insert 608 via the tool engagement feature to be transferred to the sliding insert locking member 619, and thus allowing the sliding insert locking member 619 to rotate relative to the head locking member 630 and lock the weighted insert 608 in place. In the embodiment illustrated in FIG. 59, the head locking member 630 is integrated into the insert retaining member 670 and includes head locking features 632 similar to those described above.

As illustrated in FIG. 56, the anti-rotation feature 644 of the weighted insert 608 can include rails protruding from the weighted insert 608 configured to engage the sliding insert locking member 619. As illustrated in FIG. 57, the anti-rotation member 643 of the sliding insert locking member 619 can include channels configured to engage the rails of the weighted insert 608. In some embodiments, the channels and rails can resemble splines. In another embodiment, the roles could be reversed and the weighted insert 608 could include channels and the sliding insert locking member 619 could include rails. In addition, as illustrated in FIGS. 57 and 59, the sliding insert locking member 619 can further include slide locks 680 configured to lock the sliding insert locking member 619 at the end of the weighted insert 608. As illustrated in FIGS. 57 and 59, the slide lock 680 can comprise one or more deflectable arms 682, each having a shelf 684 configured to grab the end of the weighted insert 608 once it is slid to the end of the weighted insert 608. When the user wants to slide the sliding insert locking member 619 to the opposite end of the weighted insert 608, once a threshold slide force is applied to the sliding insert locking member 619, the deflectable arm 682 will deflect, unlocking the sliding insert locking member 619 from the end of the weighted insert 608 and allowing it to slide towards the opposite end. The sliding insert locking member 619 can include slide locks 680 on the opposite end of the sliding insert locking member 619 configured to lock the sliding insert locking member 619 at the opposite end of the weighted insert 608.

Figure 60:
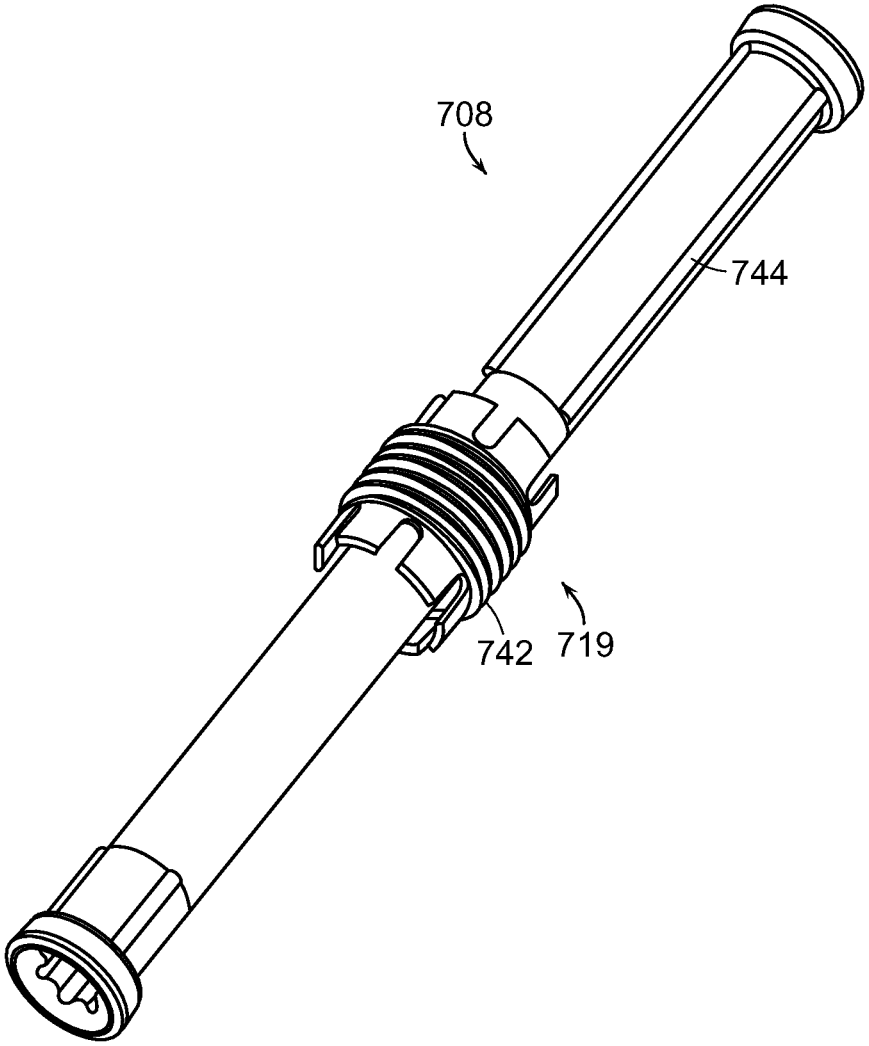
FIG. 60 illustrates a perspective view of an additional embodiment of the weighted insert and sliding insert locking member of FIG. 56.
Figure 61:
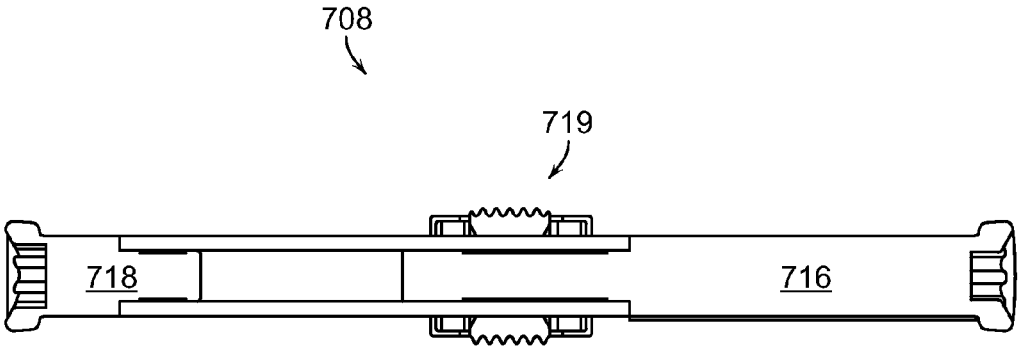
FIG. 61 illustrates a cross sectional view of the weighted insert and sliding insert locking member of FIG. 60.

FIG. 60 illustrates a perspective view of an additional embodiment of the weighted insert and sliding insert locking member of FIG. 56. FIG. 61 illustrates a cross sectional view of the weighted insert 708 and sliding insert locking member 719 of FIG. 60. In the embodiment illustrated in FIGS. 60 and 61, the insert locking feature 742 of the sliding insert locking member 719 comprises threads similar to the cap 219 illustrated in FIG. 38 configured to engage threads located on the head locking member (not illustrated), as opposed to the head locking features and insert locking features described herein.

Figure 62:
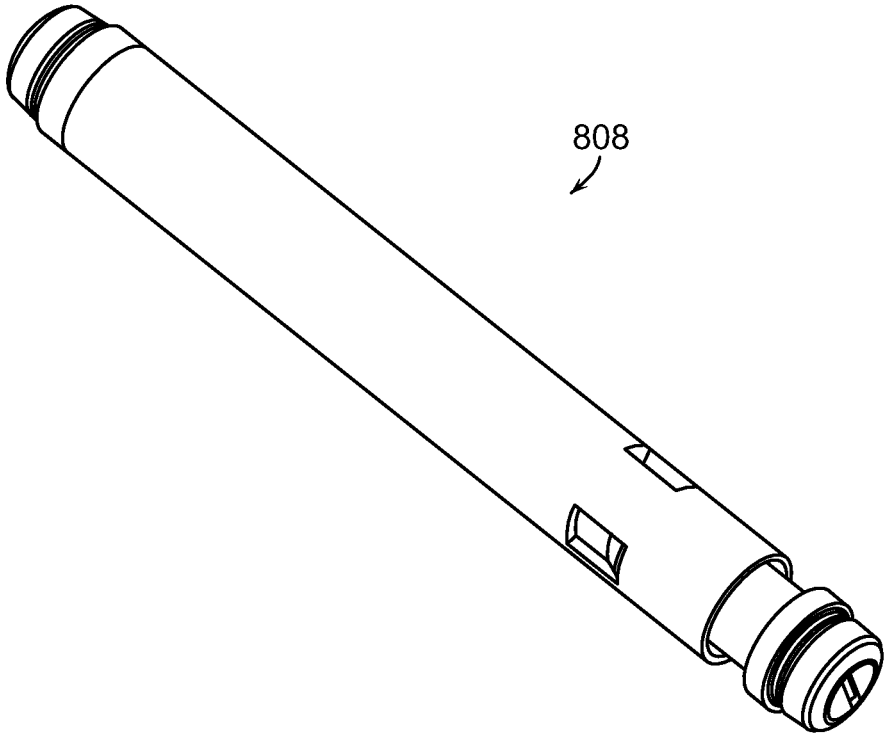
FIG. 62 illustrates a perspective view of an additional embodiment of a weighted insert.
Figure 63:
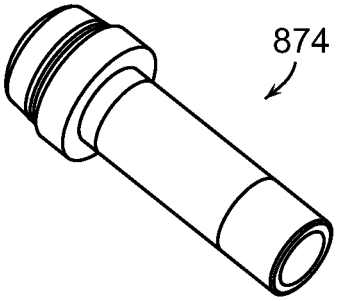
FIG. 63 illustrates a perspective view of components of the weighted insert of FIG. 62.
Figure 63:
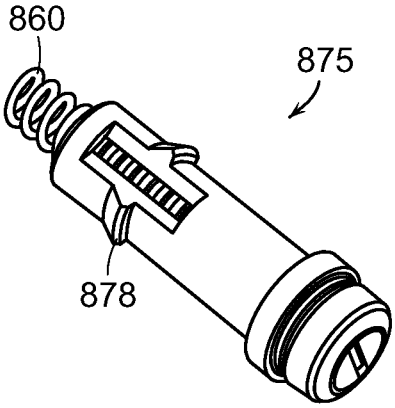
Figure 64:
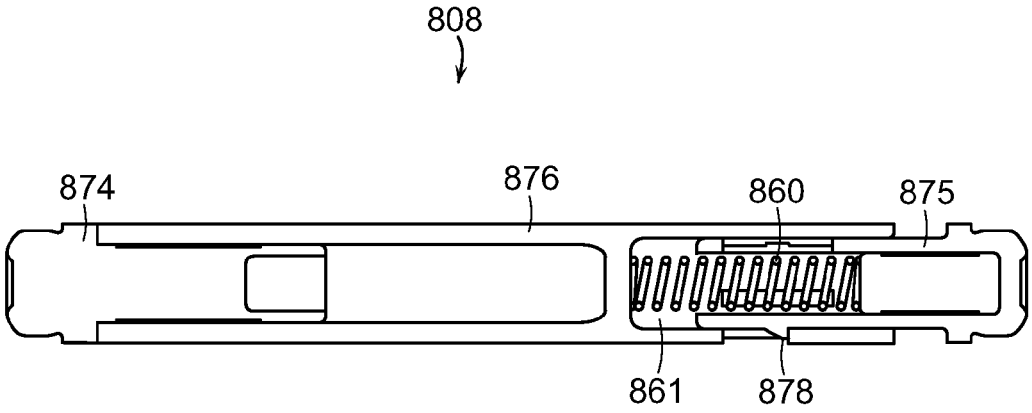
FIG. 64 illustrates a cross sectional view of the weighted insert of FIG. 62.

FIG. 62 illustrates a perspective view of an additional embodiment of a weighted insert 808. FIG. 63 illustrates a perspective view of components of the weighted insert 808 of FIG. 62. FIG. 64 illustrates a cross sectional view of the weighted insert 808 of FIG. 62. The weighted insert 808 illustrated in FIGS. 62-64 contains a spring 860 internally, and does not require an additional spring in the cavity of the golf club head. The weighted insert 808 includes a first portion 874 and a second portion 875, the second portion 875 configured to slide longitudinally along the axis of the weight insert 808, relative to the first portion 874. In one embodiment, as illustrated in FIG. 64, the weight insert 808 may further comprise a third portion 876. The first portion 874 can be affixed to the third portion 876. The third portion 876 can include a sliding bore 861 configured to slidably receive the second portion 875. The second portion 875 can be configured to slide within the sliding bore 861 of the third portion 876. Additionally, the sliding bore 861 can include a spring 860, configured to force the second portion 875 away from the first portion 874. Additionally, the second portion 875 can include a slide stop 878, configured to limit the travel of the second portion 875 relative to the third portion 876 once assembled. In an additional embodiment the first portion 874 may be formed integrally with the third portion 876.

Figure 65:
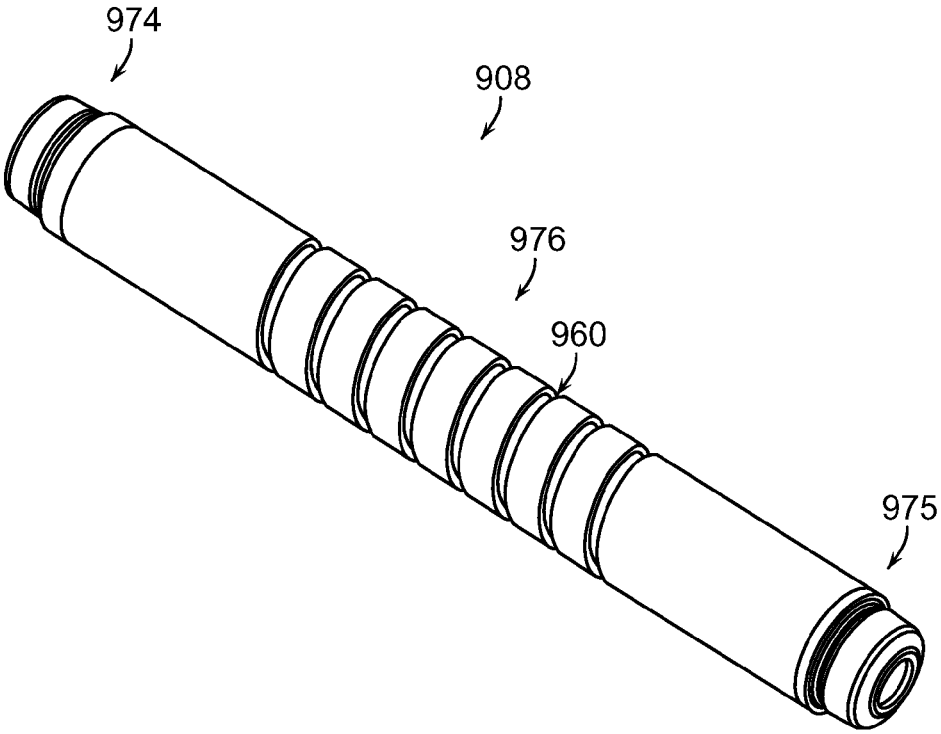
FIG. 65 illustrates a perspective view of an additional embodiment of a weighted insert.
Figure 66:
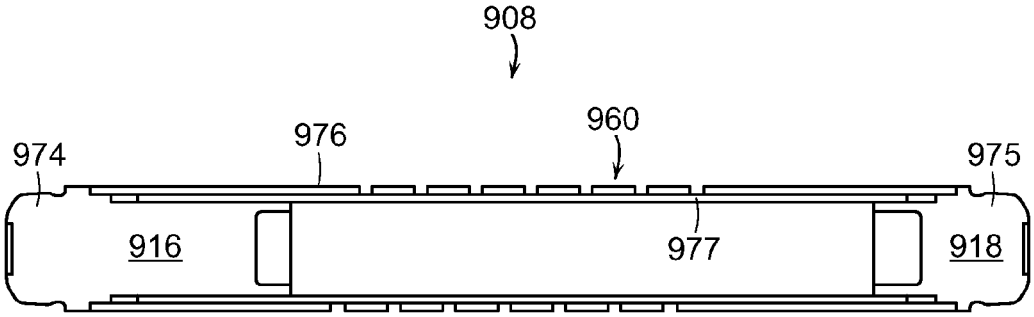
FIG. 66 illustrates a cross sectional view of the weighted insert of FIG. 65.

FIG. 65 illustrates a perspective view of an additional embodiment of a weighted insert 908. FIG. 66 illustrates a cross sectional view of the weighted insert 908 of FIG. 65. Similar to the weight insert 808 of FIGS. 62-64, the weight insert 908 of FIGS. 65 and 66 does not require an additional spring as it is configured to decrease and increase in length when being used in conjunction with the other head locking features and insert locking features described herein. The weighted insert 908 of FIGS. 65 and 66 includes a first portion 974 at one end of the weight insert 908 and a second portion 975 at the opposite end of the weight insert 908. The weight insert also includes a third portion 976 affixed to both the first portion 974 and the second portion 975. The third portion 976 is configured to deform in length along the longitudinal axis of the weight insert 908 as the ends of the weight insert 908 are forced together. As illustrated in FIGS. 65 and 66, the third portion 976 can include a spiral cut along at least a portion of its length, allowing the third portion 978 to act as a spring 960. Additionally, the weight insert 908 can include a fourth portion 977 configured to slide within the third portion 976, preventing any deformation that is not along the axis of the weight insert 908, such as buckling. In another embodiment, the fourth portion 977 could be located around the third portion 976.

Figure 76:
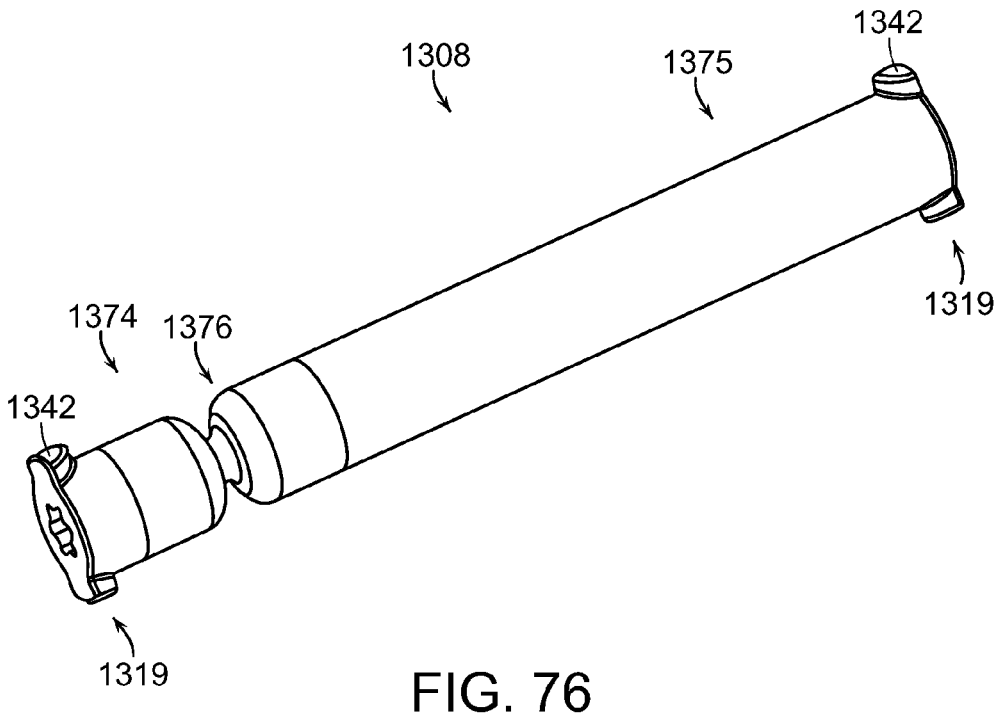
FIG. 76 illustrates a perspective view of an additional embodiment of a weighted insert.
Figure 77:
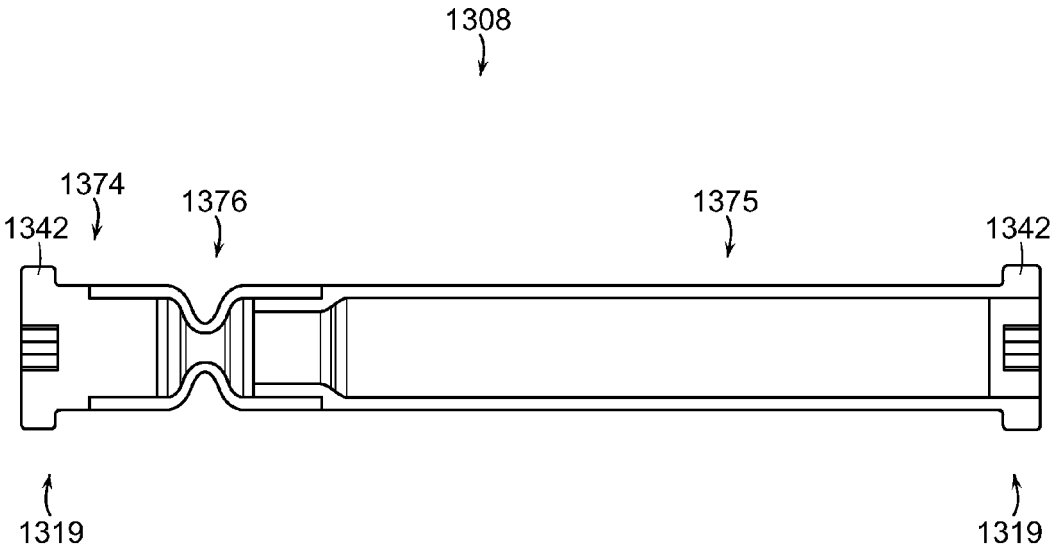
FIG. 77 illustrates a cross sectional view of the weighted insert of FIG. 76.

Some of the embodiments described herein require compression of either the weighted insert or compression of the weighted insert along with a spring. In additional embodiments, the head locking feature and insert locking feature may load the weighted insert in tension rather than compression, locking the weighted insert in place. FIG. 76 illustrates a perspective view of an additional embodiment of a weighted insert 1308. FIG. 77 illustrates a cross sectional view of the weighted insert 1308 of FIG. 76. The weighted insert 1308 includes a first portion 1374 at one end of the weighted insert 1308 and a second portion 1375 at the opposite end of the weighted insert 1308. The weight insert also includes a third portion 1376 affixed to both the first portion 1375 and second portion 1375. The third portion 1376 is configured to deform in length along the along the longitudinal axis of the weighted insert 1308 as the ends of the weight insert 1308 are pulled apart. As illustrated in FIGS. 76 and 77, the third portion 1376 can include an accordion like structure, acting like a spring. The weighted insert 1308 could include a fourth portion around the outside of the first portion 1374, second portion 1375, and third portion 1376, configured to prevent any deformation that is not along the axis of the weight insert 1308, such as buckling (not illustrated). In a tension loaded weighted insert such as the weighted insert 1308 illustrated in FIGS. 76 and 77, the channels of the head locking feature may be oriented at such an angle, that rotating the weighted insert 1308 relative to the golf club head would stretch the weighted insert 1308. Additionally, the detents may be configured such that the tension in the weighted insert 1308 in a locked position helps to prevent the weighted insert 1308 from coming dislodged from the detent during play. The weighted insert 1308 can also include insert locking features 1319, preferable at both ends of the weighted insert 1308. The locking features 1319 can include protrusions 1342 configured to interact with a head locking feature.

Figure 67:
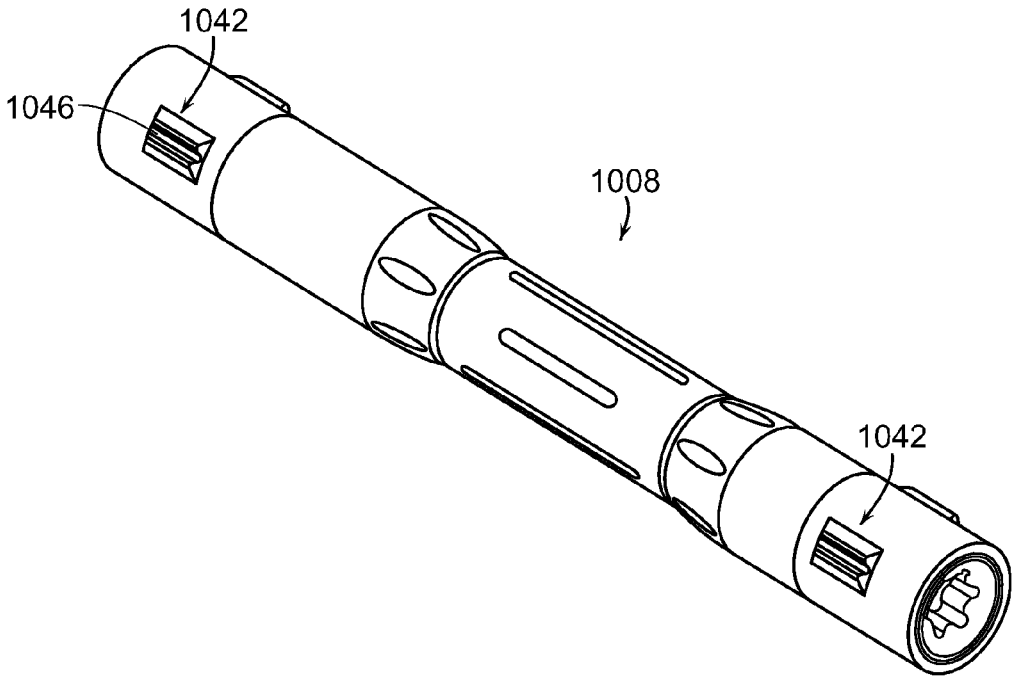
FIG. 67 illustrates a perspective view of an additional embodiment of a weight insert.
Figure 68:
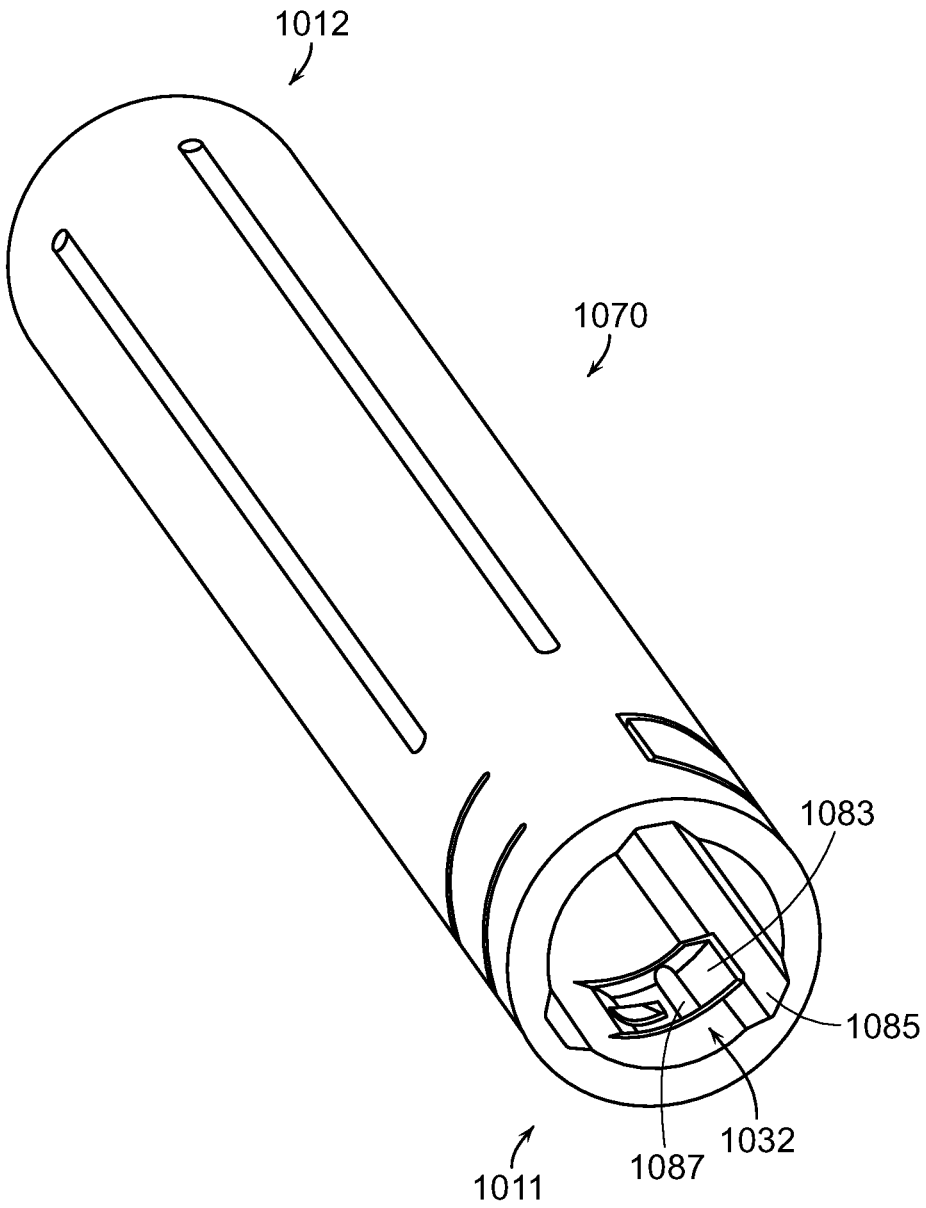
FIG. 68 illustrates a perspective view of an insert retaining member configured to receive the weigh insert of FIG. 67.
Figure 69:
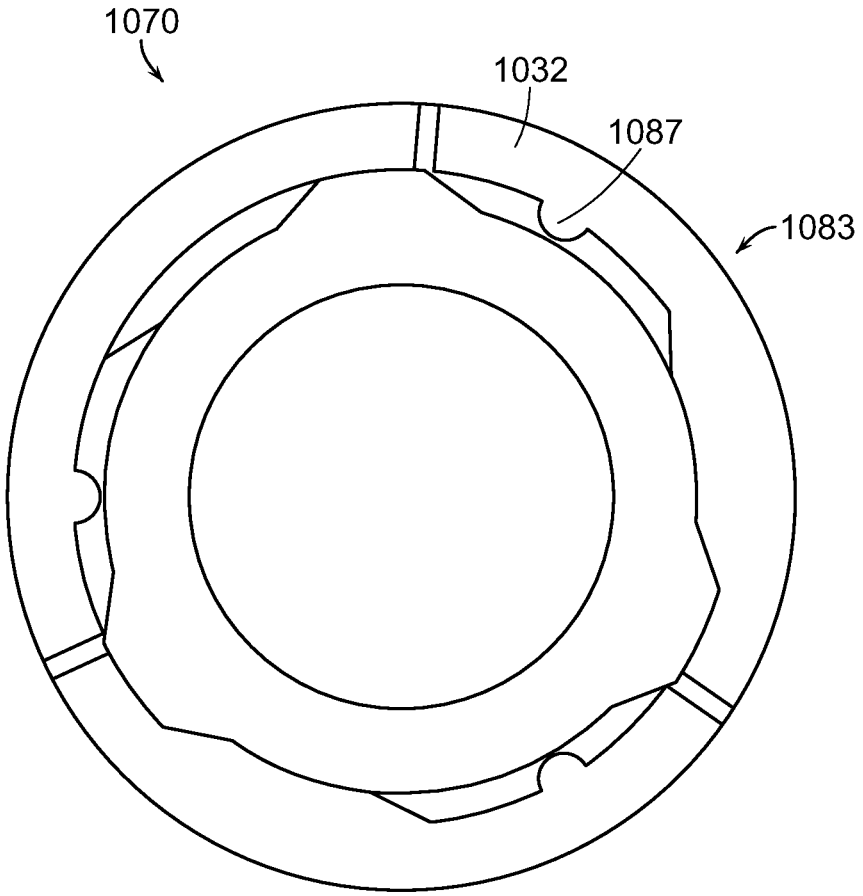
FIG. 69 is an end view of the insert retaining member of FIG. 68.
Figure 70:
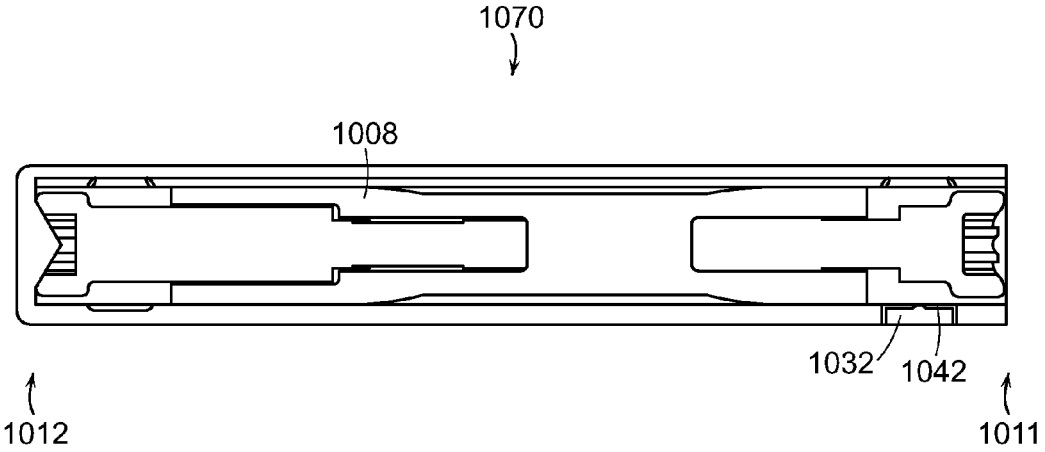
FIG. 70 is a cross sectional view of the weight insert of FIG. 67 installed in the insert retaining member of FIG. 68.

FIG. 67 illustrates a perspective view of an additional embodiment of a weight insert 1008. FIG. 68 illustrates a perspective view of an insert retaining member 1070 configured to receive the weigh insert 1008 of FIG. 67. FIG. 69 is an end view of the insert retaining member 1070 of FIG. 68. FIG. 70 is a cross sectional view of the weight insert 1008 of FIG. 67 installed in the insert retaining member 1070 of FIG. 68. The weight insert 1008 is configured to rotate into a locked position without the need for the weighted insert 1008 to translate longitudinally within the cavity of the golf club head. The insert locking feature 1042 of the weighted insert 1008 includes at least one protrusion. As illustrated in FIG. 67, the insert locking feature 1042 includes at least one pair of protrusions with a relief 1046 between them. The protrusions can be shaped like a rail, extending in a direction substantially parallel to the axis of the weighted insert 1008. The insert retaining member 1070 includes at least one channel 1085 to receive the insert locking feature 1042 as it is installed in the insert retaining member 1070. Additionally, the insert retaining member 1070 includes a corresponding head locking feature 1032. The head locking feature 1032 of the insert retaining member 1070 includes a protrusion 1087 configured to engage the relief 1046 of the insert locking feature 1042. The protrusion 1087 of the head locking feature 1032 can be formed on a deflectable arm 1083, which deflects as the weighted insert 1008 is rotated, and then snaps back as the protrusion 1087 of the head locking feature 1032 engages the relief 1046 of the insert locking feature 1042, locking the weighted insert 1008 in the golf club head. As illustrated in FIG. 67, the weighted insert 1008 can include insert locking features 1042 at each end of the weighted insert 1008. In another embodiment the insert locking features 1042 may be located centrally on the weighted insert 1008. In another embodiment, the insert locking features 1042 may be on a sliding insert locking member.

Figure 71:
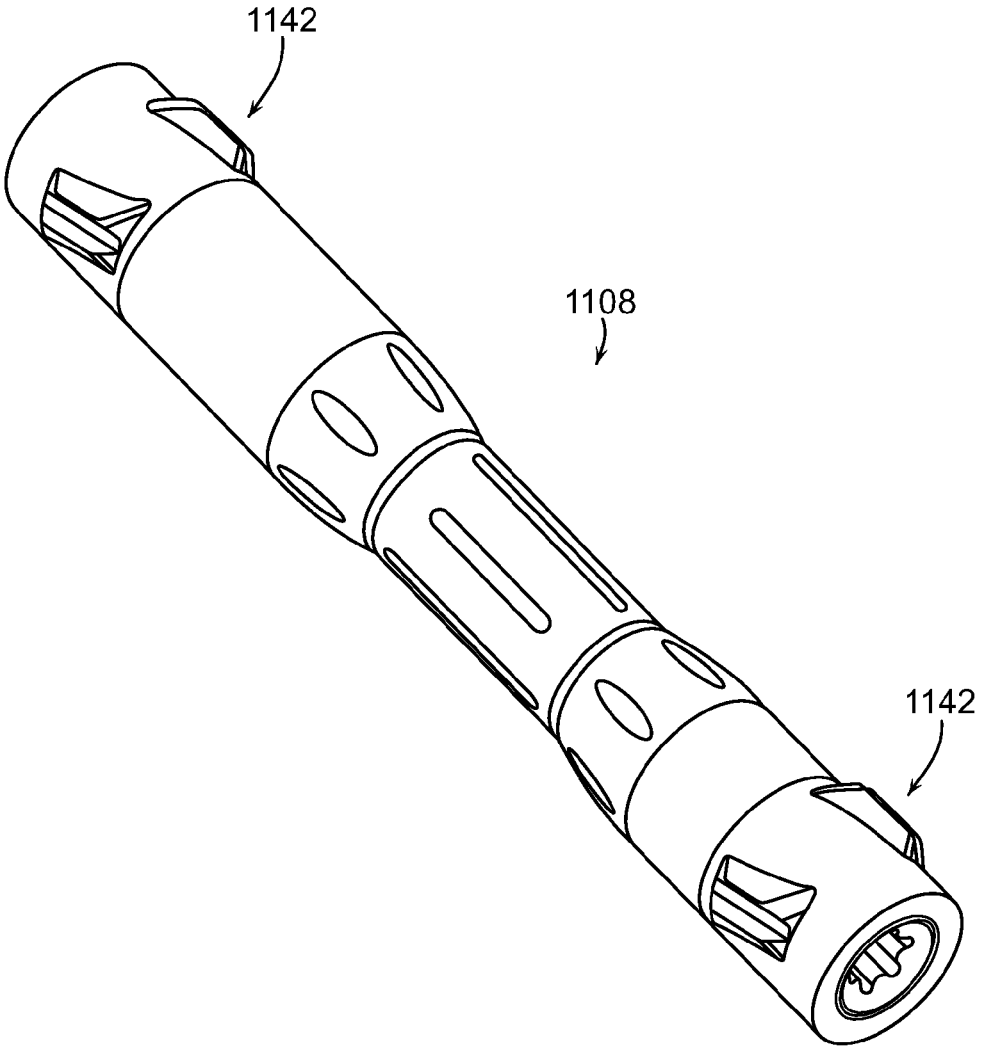
FIG. 71 illustrates an additional embodiment of a weighted insert.
Figure 72:
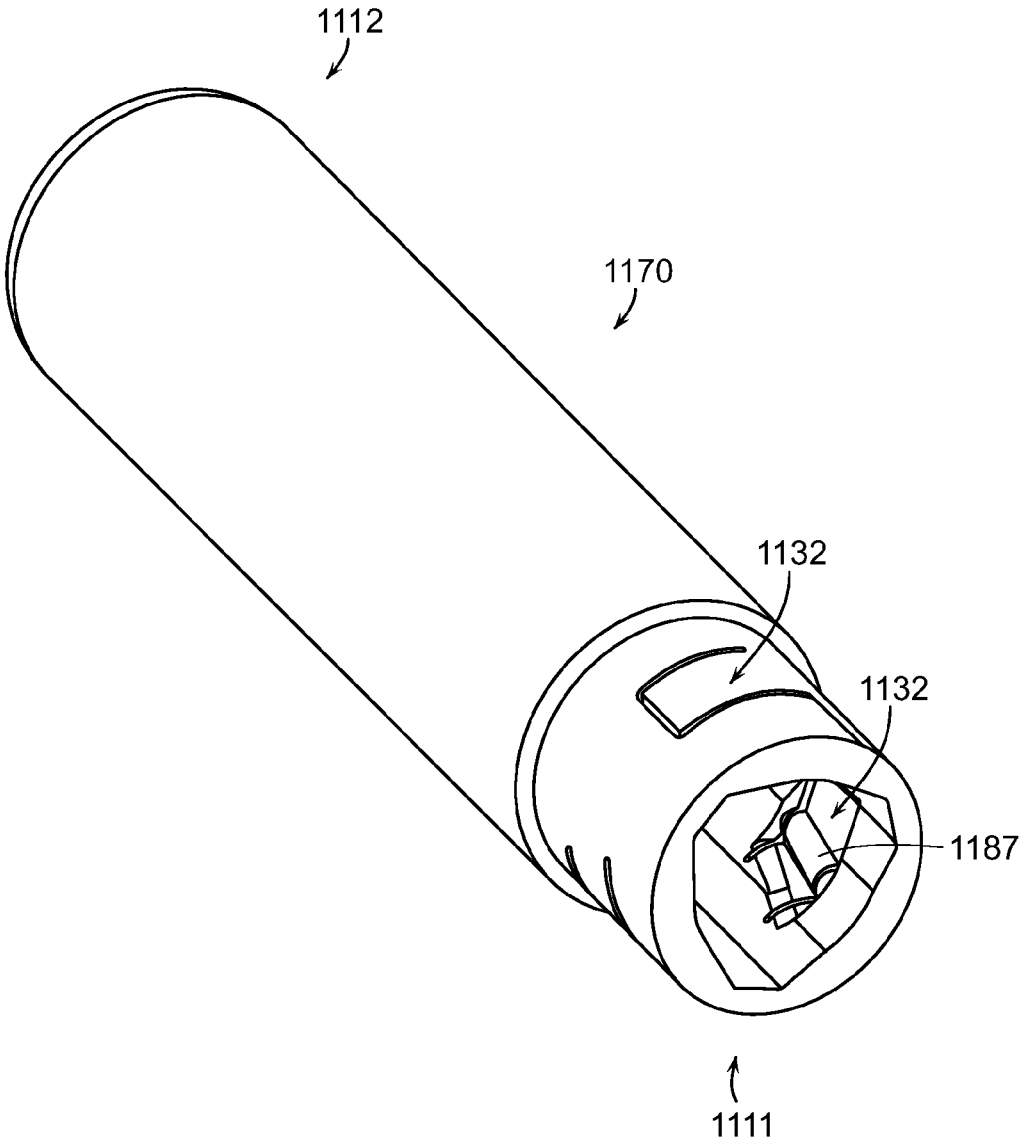
FIG. 72 illustrates a perspective view of an insert retaining member configured to receive the weighted insert of FIG. 71.

FIG. 71 illustrates an additional embodiment of a weighted insert 1108. FIG. 72 illustrates a perspective view of an insert retaining member 1170 configured to receive the weighted insert 1108 of FIG. 71. The weighted insert 1108 is similar to the weighted insert of FIGS. 67-70 however the protrusions and reliefs of the insert locking feature 1142 extend in a direction oblique to longitudinal axis of the weighted insert 1108. Additionally, the protrusions 1187 of the head locking features 1132 are angled as well to engage the insert locking features 1142.

Figure 73:
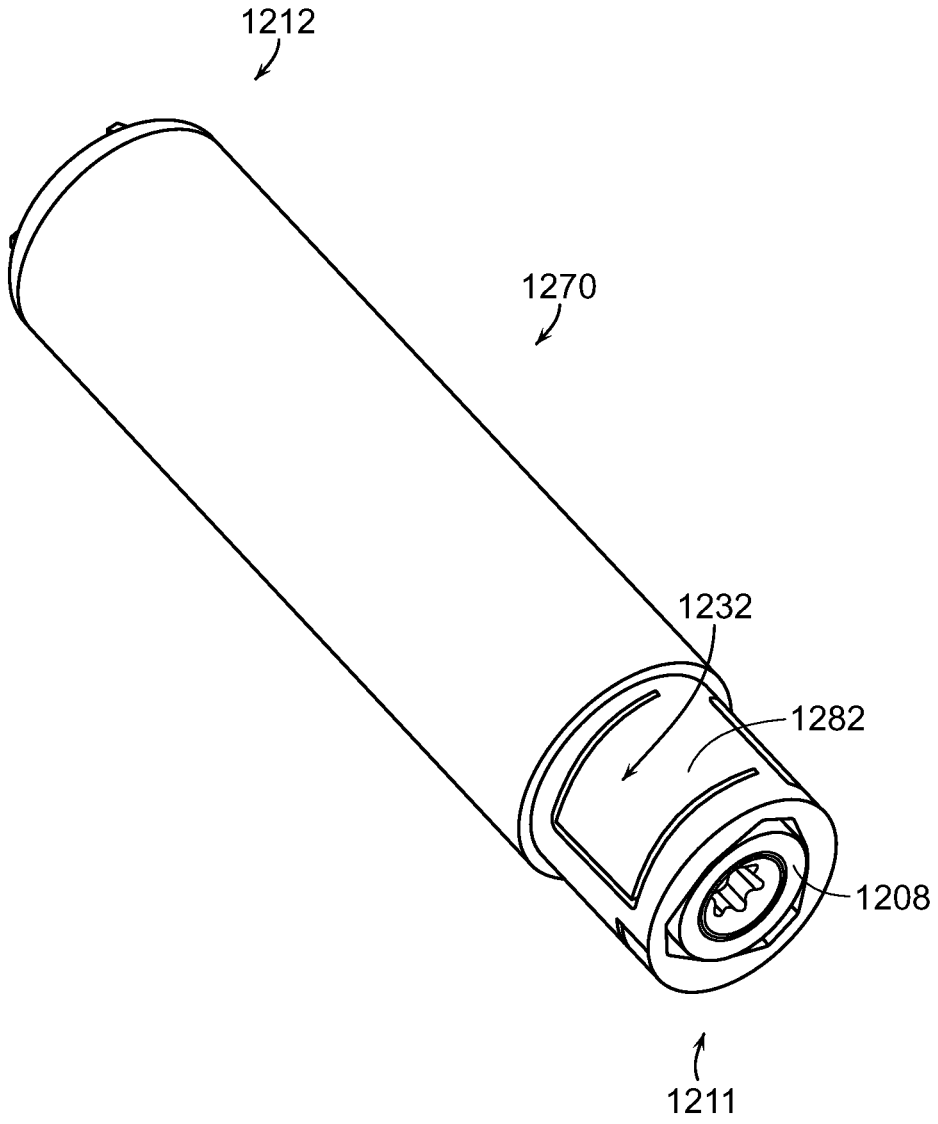
FIG. 73 illustrates an additional embodiment of an insert retaining member.
Figure 74:
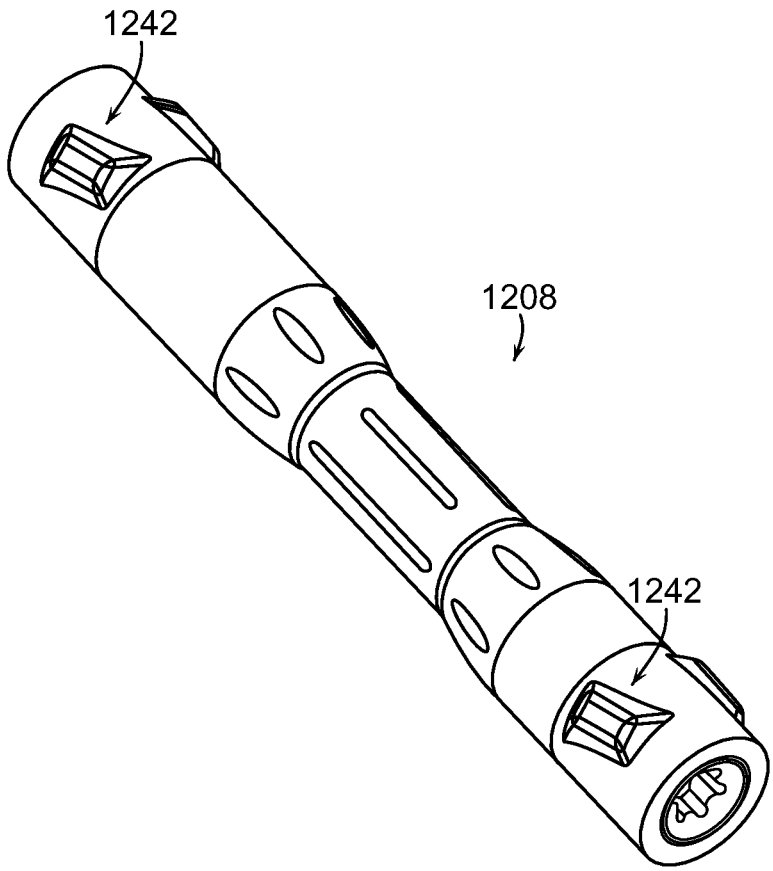
FIG. 74 illustrates an additional embodiment of a weighted insert configured to reside in the insert retaining member of FIG. 73.
Figure 75:
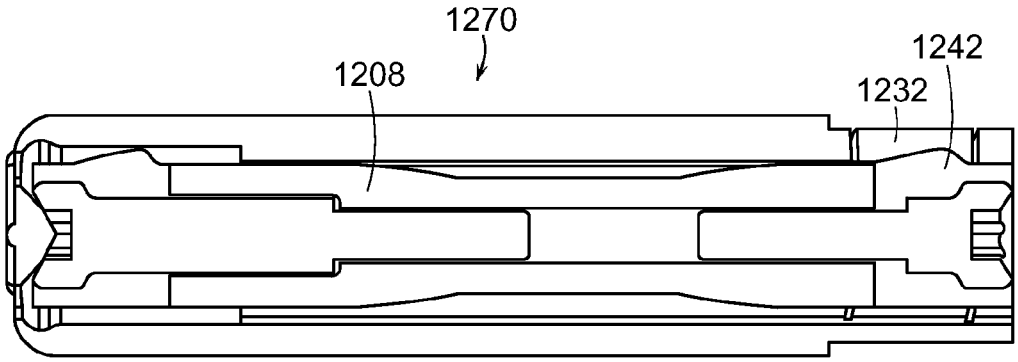
FIG. 75 illustrates a cross sectional view of the insert retaining member and weighted insert of FIGS. 73 and 74.

FIG. 73 illustrates an additional embodiment of an insert retaining member 1270. FIG. 74 illustrates an additional embodiment of a weighted insert 1208 configured to reside in the insert retaining member 1270 of FIG. 73. FIG. 75 illustrates a cross sectional view of the insert retaining member 1270 and weighted insert 1208 of FIGS. 73 and 74. The weighted insert 1208 is similar to the weighted inserts of FIGS. 67-72, with a few key differences. Rather than a pair of protrusions, the insert locking feature 1242 includes single protrusion without a relief. Additionally, the ends of the protrusions are tapered, allowing them to contact a corresponding taper of the head locking feature 1232 of the insert retaining member, further limiting longitudinal movement of the weighted insert 1208 inside the club head when the weighted insert 1208 is in a locked position. Additionally, rather than the deflectable arms 1282 of the head locking features 1232 being aligned perpendicular to the longitudinal axis of the weighted insert 1208 like in earlier embodiments, the deflectable arms 1282 are aligned oblique to the longitudinal axis of the weighted insert 1208 such that as the weighted insert 1208 is rotated into a locked position, the insert locking feature 1242 and head locking feature 1232 not only restrict rotation of the weighted insert 1208 relative to the insert retaining member 1270, but also force the weighted insert 1208 towards the terminal end 1212 of the insert retaining member 1270. This feature further reduces the chance of the weighted insert 1208 moving within the club head once in a locked position and prevents any rattling when the club head strikes a golf ball.

In a preferred embodiment, the head locking features and insert locking features described herein are configured to lock the weighted insert with less than 180 degrees of rotation of the insert locking member. In a more preferred embodiment, the head locking features and insert locking features are configured to lock the weighted insert 308 with less than 135 degrees of rotation. In a more preferred embodiment, the head locking features and insert locking features are configured to lock the weighted insert 308 with less than 90 degrees of rotation. Additionally, the head locking features and insert locking features described herein could be incorporated into other embodiments, for example replacing the threads of the cap 219 of the embodiment illustrated in FIG. 38.

In some embodiments, the weighted inserts described herein may not have a heavy end and a lighter end, but may have a CG located centrally along their length. Such a neutral weighted insert could make for even more CG location options for the golf club head if used as an option in addition to a conventional weighted insert with a heavy end and a lighter end.

The insert locking features described and illustrated herein have generally been offset from the ends of the weighted insert. In some embodiments, not illustrated the insert locking features can be located immediately adjacent the ends of the weighted insert. Additionally, the slots of the head locking features described and illustrated herein have generally allowed for locking of the weighted insert inside the golf club head strictly via rotation of the insert locking member relative to the golf club head. In some embodiments, not illustrated, locking or unlocking of the weighted insert can be achieved with not only rotation of the insert locking member, but also via force along the longitudinal axis of the weighted insert exerted on the insert locking member via the tool. Additionally, the weighted inserts described and illustrated herein generally have a lightweight end and a heavy end such that their center of gravity is offset from their dimensional center. In additional embodiments, the weighted inserts may not have an offset center of gravity. The weighted insert may have two heavy ends or two light ends for example. In additional embodiments, the insert locking members described and illustrated herein may include a seal to prevent any fluids or particles from entering or leaving the cavity and/or golf club head.

Figure 78:
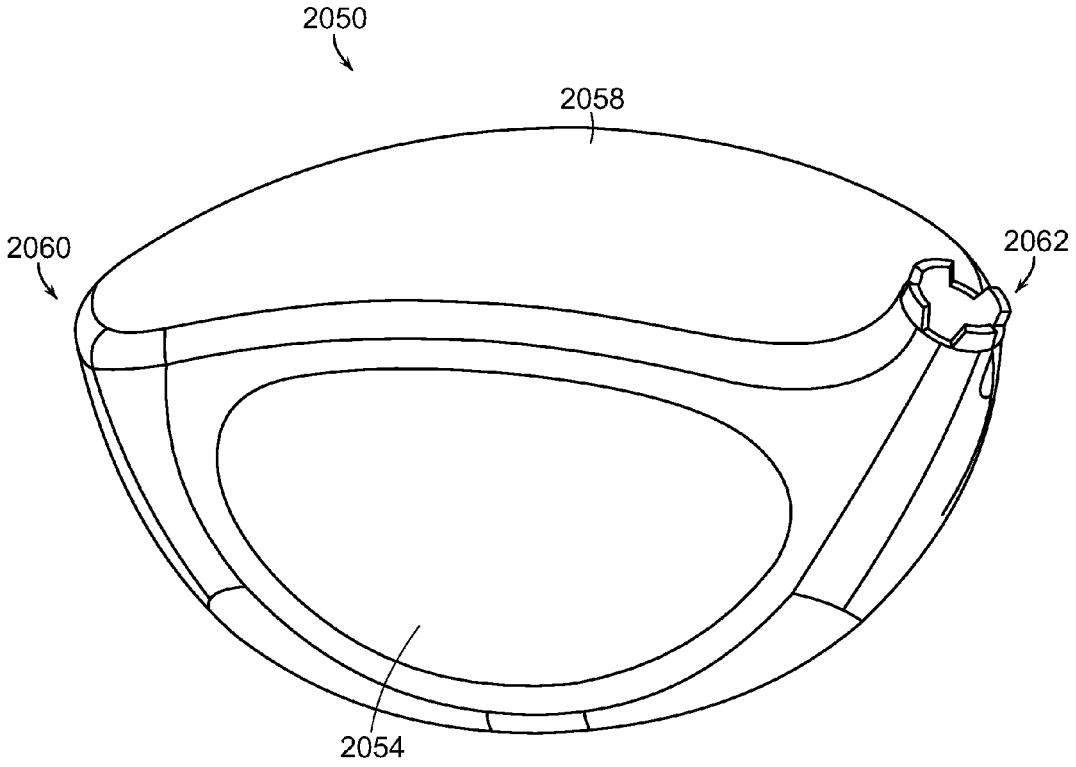
FIG. 78 of the accompanying drawings illustrates a perspective view of one embodiment of a golf club head.
Figure 79:
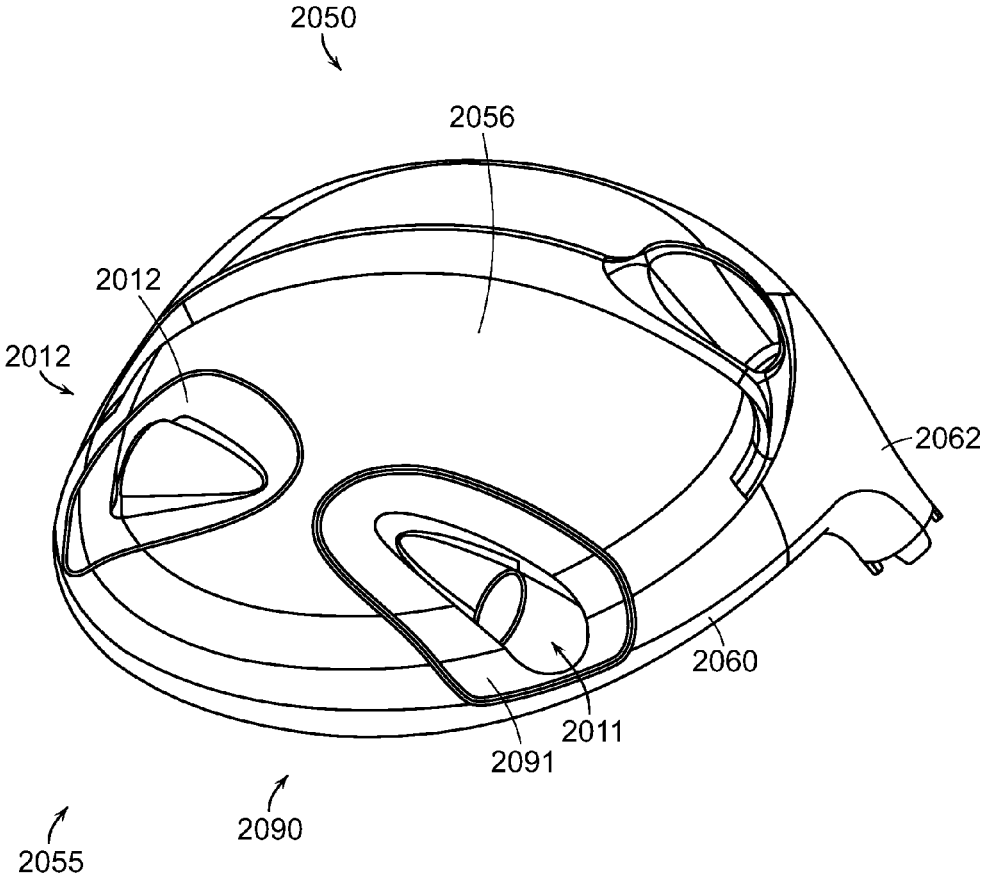
FIG. 79 illustrates a perspective view of the bottom of the golf club head of FIG. 78 including one embodiment of a weight retention system including a first weight retention member and a second weight retention member.
Figure 80:
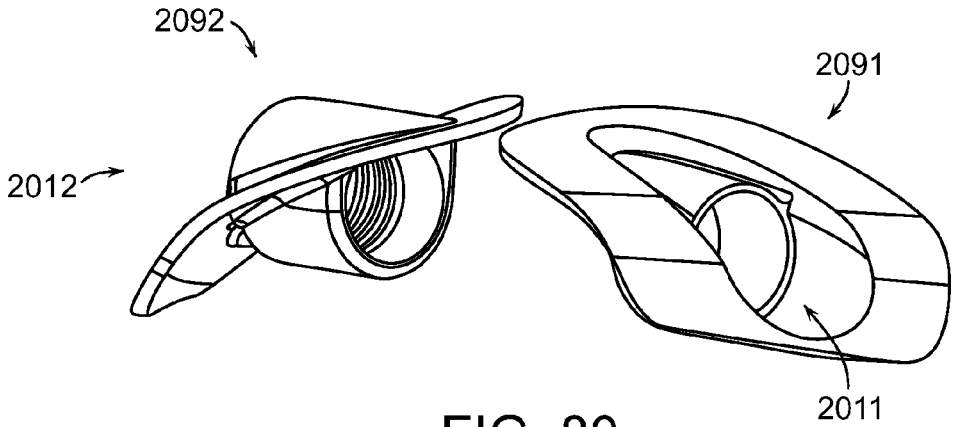
FIG. 80 illustrates a perspective view of one embodiment of the weight retention system of FIG. 79.
Figure 86:
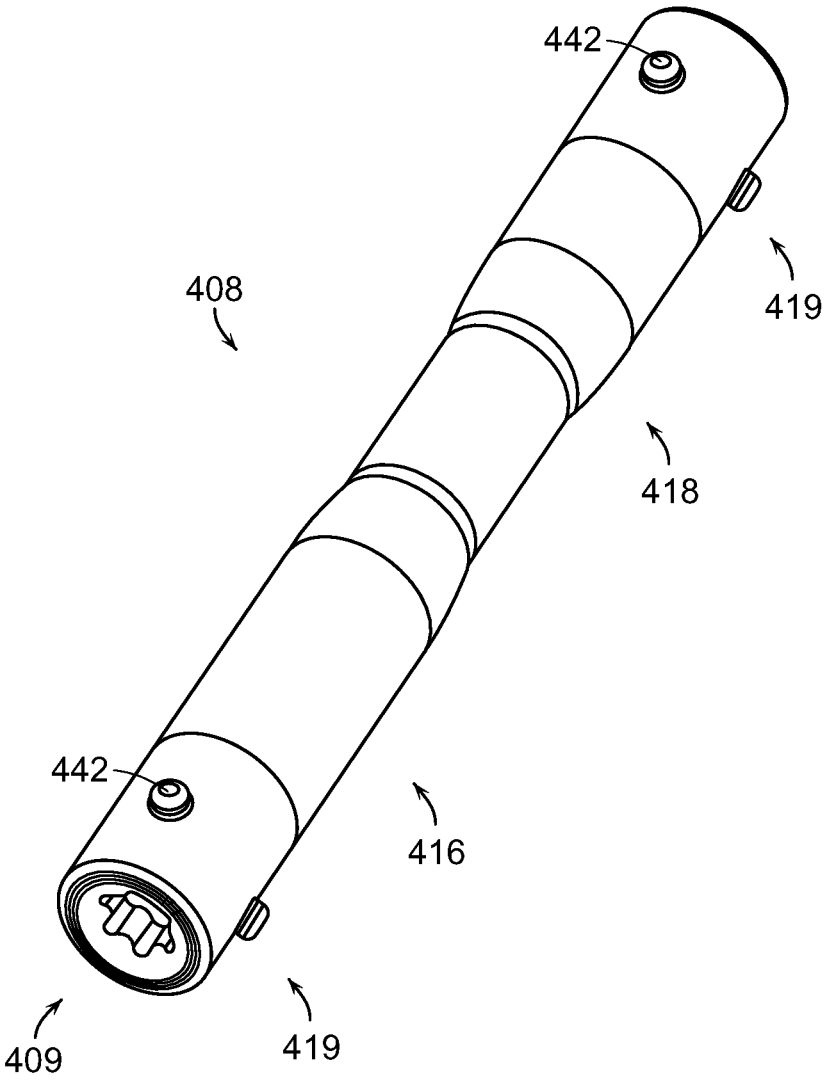
FIG. 86 illustrates a perspective view of a weighted insert.

FIG. 78 of the accompanying drawings illustrates a perspective view of one embodiment of a golf club head 2050. FIG. 79 illustrates a perspective view of the bottom of the golf club head 2050 of FIG. 78 including one embodiment of a weight retention system 2090 including a first weight retention member 2091 and a second weight retention member 2092. FIG. 80 illustrates a perspective view of one embodiment of the weight retention system 2090 of FIG. 79. The golf club head 2050 includes a body having a striking face 2054, a sole 2056, a crown 2058, a skirt 2060, and a hosel 2062. The body defines a hollow interior 2064 (See FIGS. 93 and 94). The golf club head 2050 includes a weight retention system 2090 configured to receive a weighted insert 408. The weighted insert 408 is configured such that its center of gravity can be manipulated, by, for example, reversing the orientation of the weighted insert 408. The weight retention system 2090 can be configured to receive any of the weighted inserts described herein, although the weight retention system 2090 illustrated in FIGS. 79-83 and 94 is configured to retain a weighted insert 408 as illustrated in FIG. 86, also illustrated in FIG. 49 and described in further detail above.

The weight retention system 2090 can include a first weight retention member 2091 and a second weight retention member 2092 as illustrated in FIG. 79. The weight retention system can include a cavity configured to receive the weighted insert 408. The first weight retention member 2091 includes an opening 2011 to receive the weighted insert 408. The second weight retention member 2092 can comprise the terminal end 2012 of the cavity receiving the weighted insert 408. In some embodiments, the first weight retention member 2091 can be substantially similar to the head locking member 330 as described above and as illustrated in FIGS. 44, 45, 47 and 48.

Figure 81:
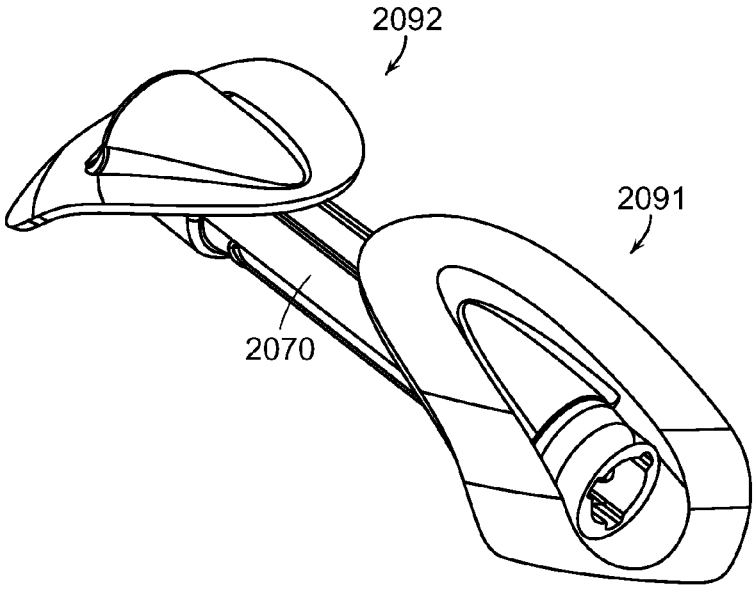
FIG. 81 illustrates a perspective view of the weight retention system of FIG. 80 including a third weight retention member.
Figure 82:
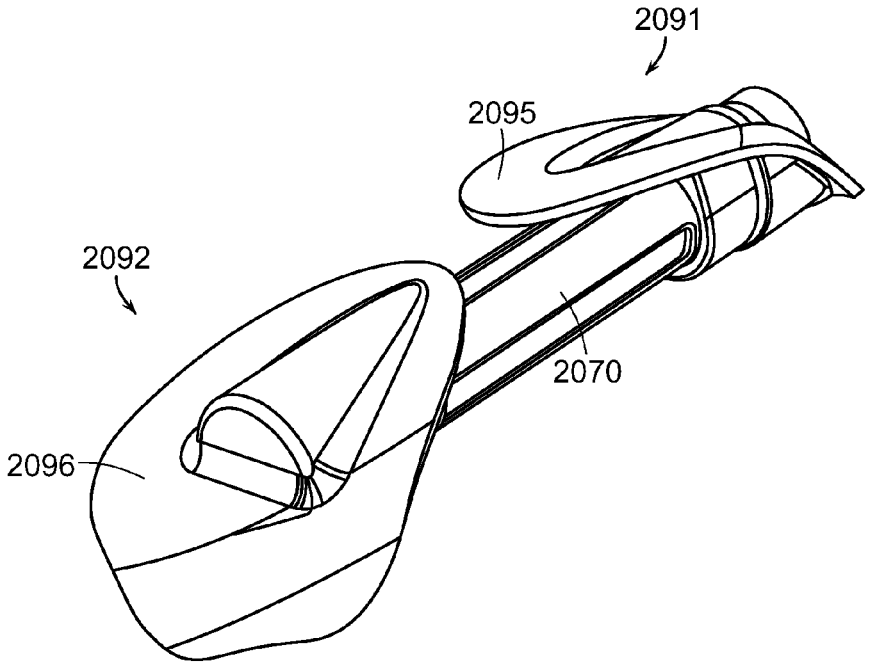
FIG. 82 illustrates an additional perspective view of the weight retention system of FIG. 81.
Figure 83:
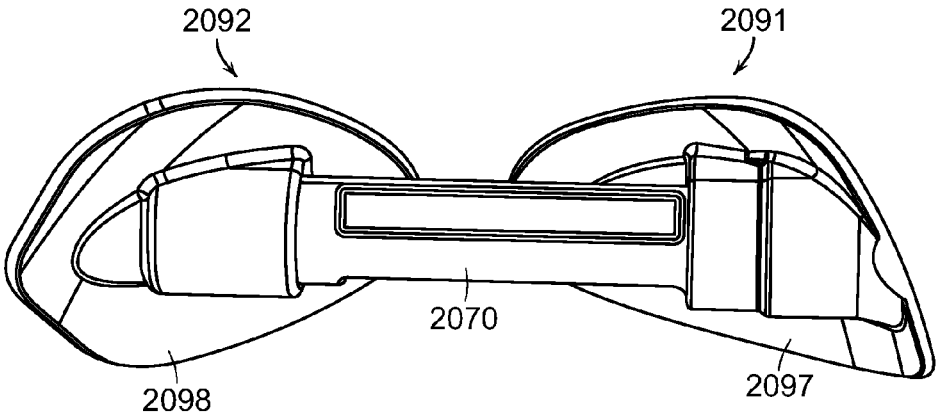
FIG. 83 illustrates an additional perspective view of the weight retention system of FIG. 81.
Figure 84:
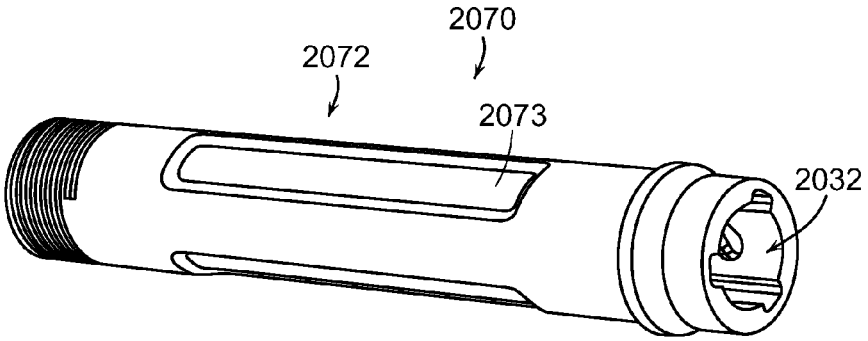
FIG. 84 illustrates a perspective view of one embodiment of the insert retaining member of FIG. 81.
Figure 85:
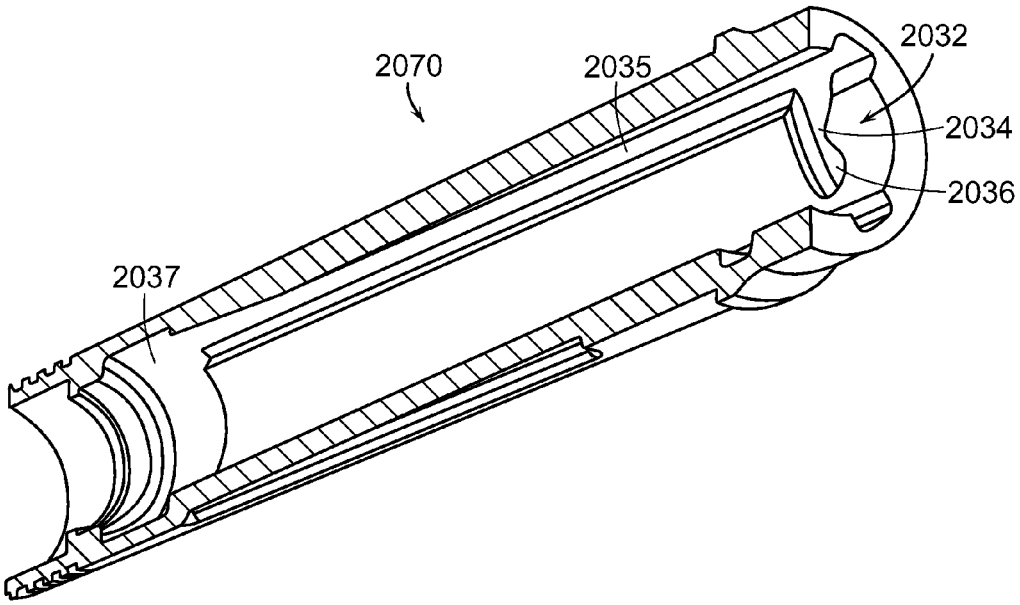
FIG. 85 illustrates a cross-sectional view of the third weight retention member of FIG. 81.

FIG. 81 illustrates a perspective view of the weight retention system 2090 of FIG. 80 including a third weight retention member 2070. FIG. 82 illustrates an additional perspective view of the weight retention system 2090 of FIG. 81. FIG. 83 illustrates an additional perspective view of the weight retention system 2090 of FIG. 81. In the illustrated embodiments, the first weight retention member 2091 is formed separately from the second weight retention member 2092. In a preferred embodiment, the first weight retention member 2091 can be connected to the second weight retention member 2092 via a third weight retention member 2070. FIG. 84 illustrates a perspective view of one embodiment of the insert retaining member of FIG. 81. FIG. 85 illustrates a cross-sectional view of the third weight retention member of FIG. 81. The third weight retention member 2070 can be substantially similar to the insert retaining member 670 described herein and illustrated for example, in FIG. 55. The first weight retention member 2091 has an outer surface 2095 exposed to the exterior of the golf club head 2050 and an interior surface 2097. Similarly, the second weight retention member 2091 has an outer surface 2096 exposed to the exterior of the golf club head 2050 and an interior surface 2098.

The third weight retention member 2070 can include threads or another method of locking the third weight retention member 2070 to the second weight retention member 2092. The second weight retention member 2092 can include a terminal portion 2092 configured to receive and engage the terminal end of the third weight retention member 2070. Additionally, the third weight retention member 2070 can include a head locking feature 2032 as illustrated in FIGS. 84 and 85. In some embodiments, the head locking feature 2032 is substantially similar to the head locking feature 632 illustrated in FIG. 55. The head locking feature 2032 illustrated in FIGS. 84 and 85 includes at least one slot 2034 and at least one detent 2036 similar to the head locking feature 332 illustrated in FIGS. 47 and 48. Additionally, the head locking feature 2032 includes at least one longitudinal slot 2035 to allow a weighted insert 408 such as the one illustrated in FIG. 86, with a plurality of protrusions 442, to be inserted into the weight retention system 2090 in a plurality of orientations, by allowing at least one protrusion 442 to slide along the longitudinal slot until it reaches the terminal end 2012 where it can rotate freely within a terminal recess 2037. Additionally, the third weight retention member 2070 can include reliefs 2073 for weight savings.

Figure 87:
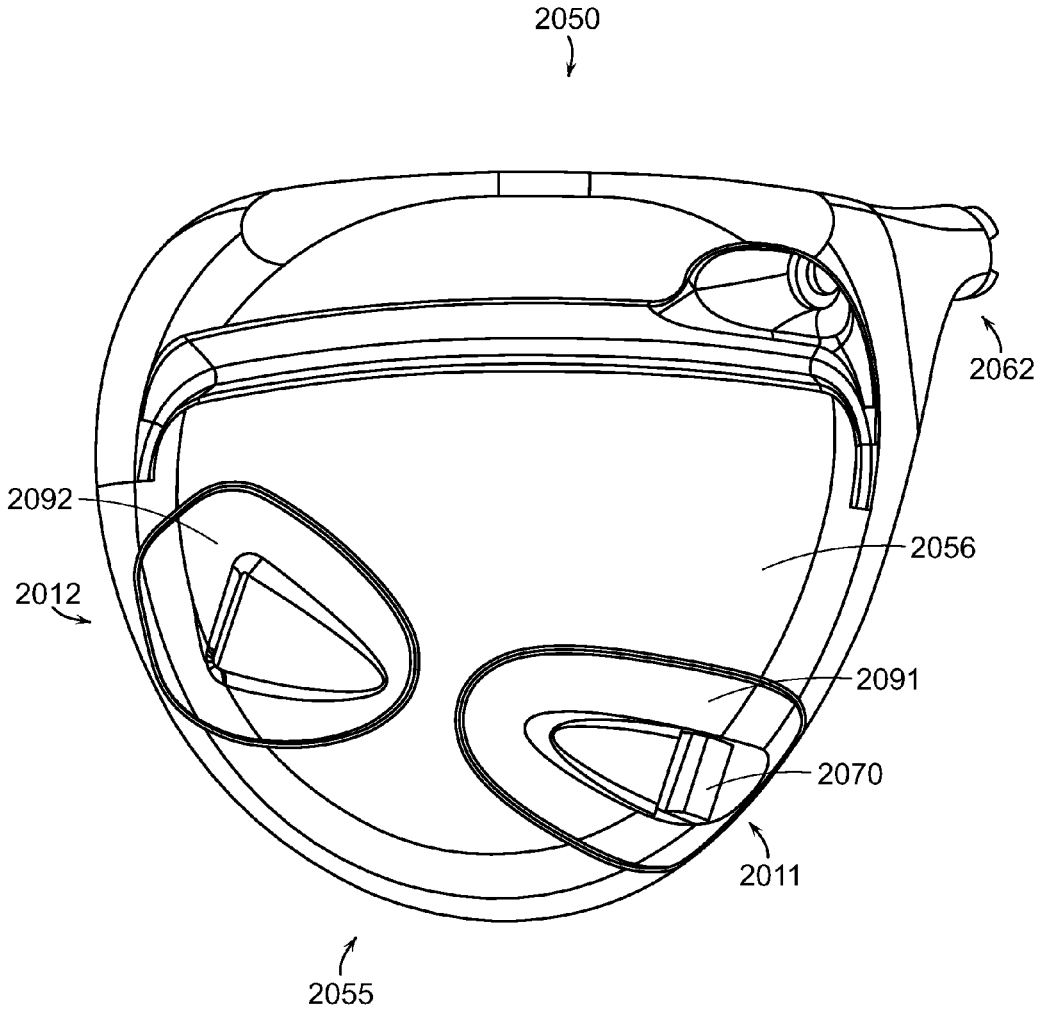
FIG. 87 illustrates a perspective view of the bottom of the golf club head of FIG. 78 including the third weight retention member of FIG. 81.
Figure 88:
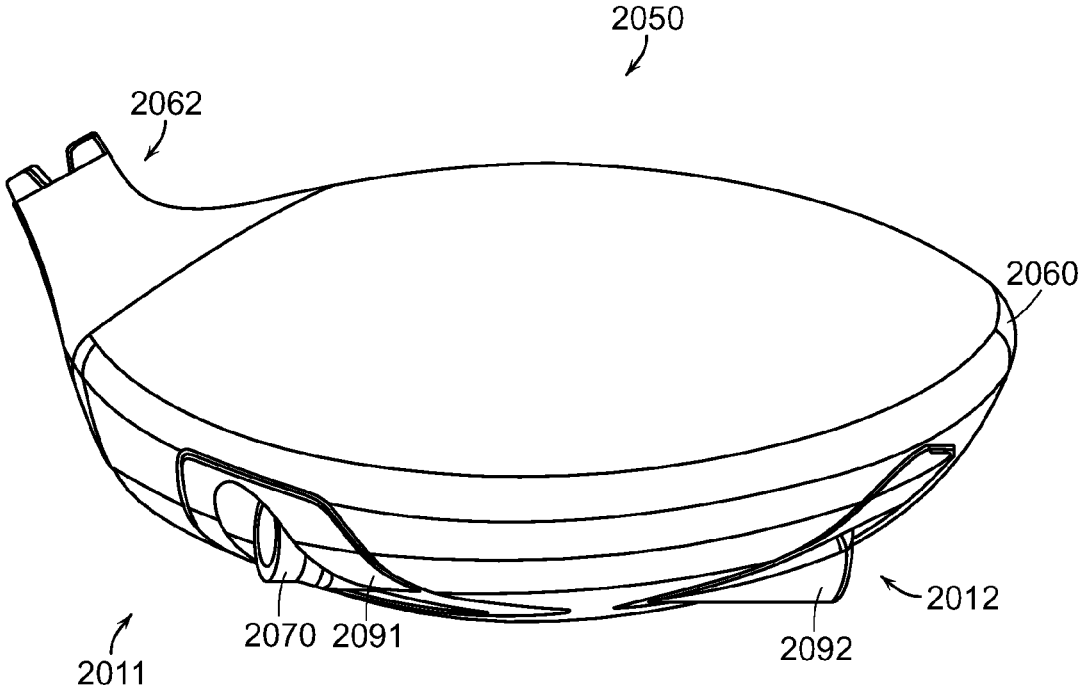
FIG. 88 illustrates an additional perspective view of the golf club head of FIG. 87.
Figure 89:
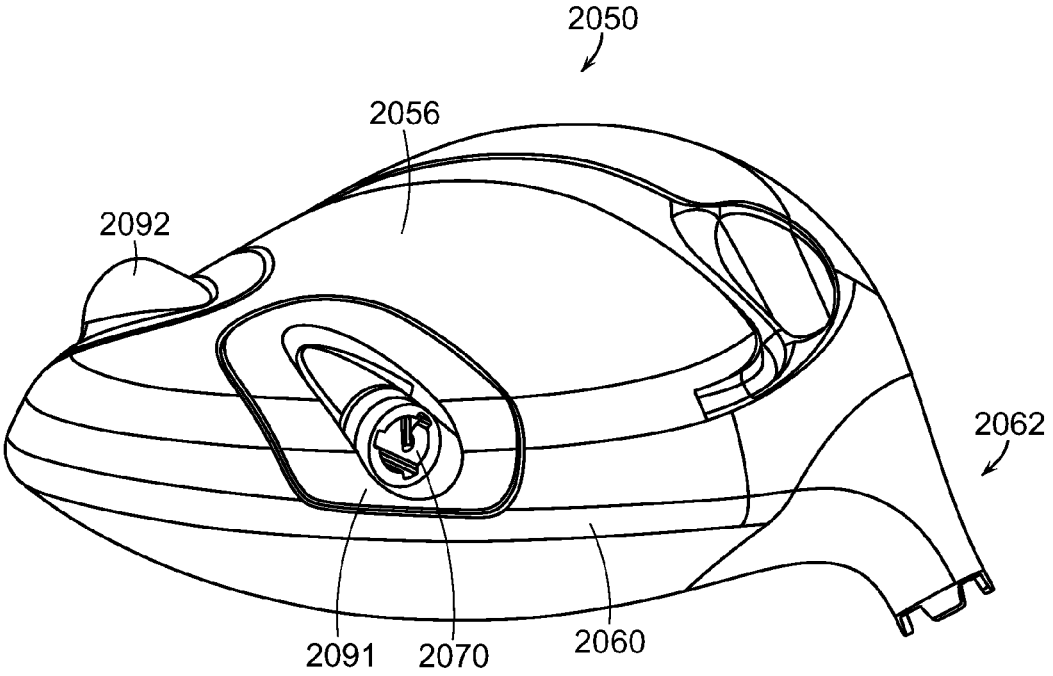
FIG. 89 illustrates an additional perspective view of the golf club head of FIG. 87.
Figure 90:
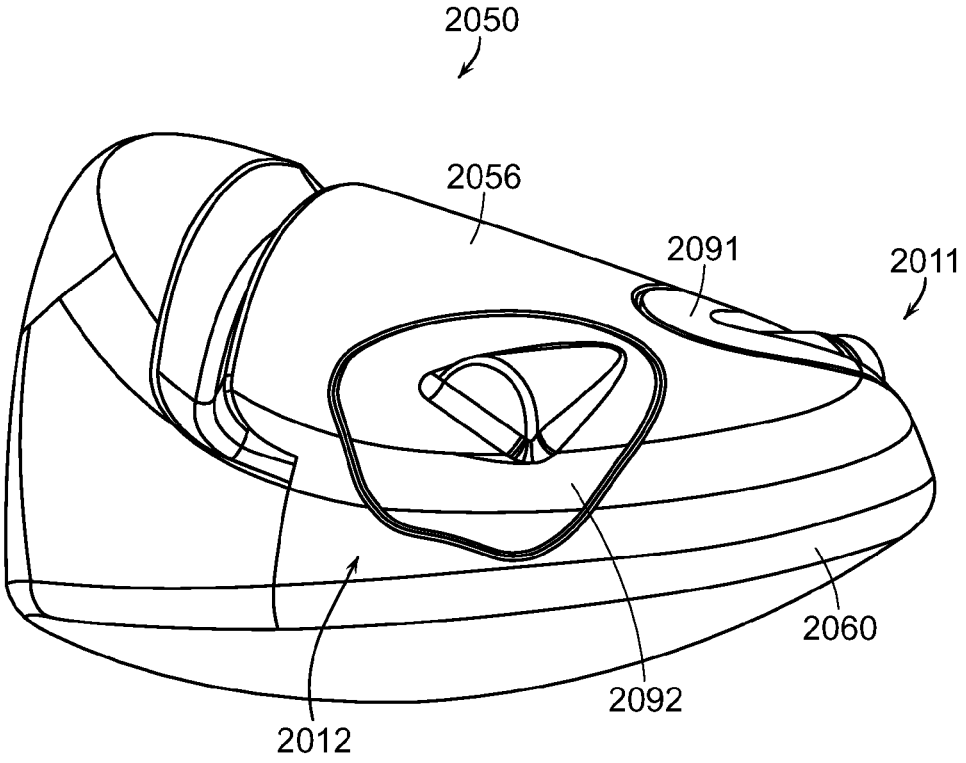
FIG. 90 illustrates an additional perspective view of the golf club head of FIG. 87.
Figure 91:
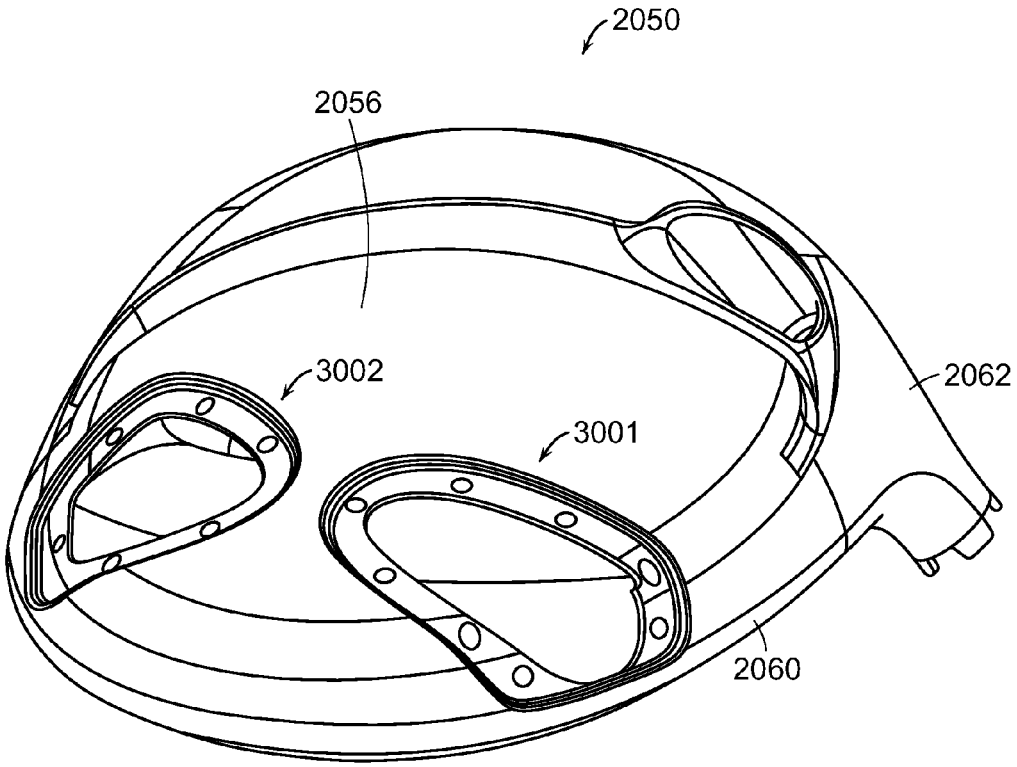
FIG. 91 illustrates a perspective view of the bottom of the golf club head without the weight retention system.
Figure 92:
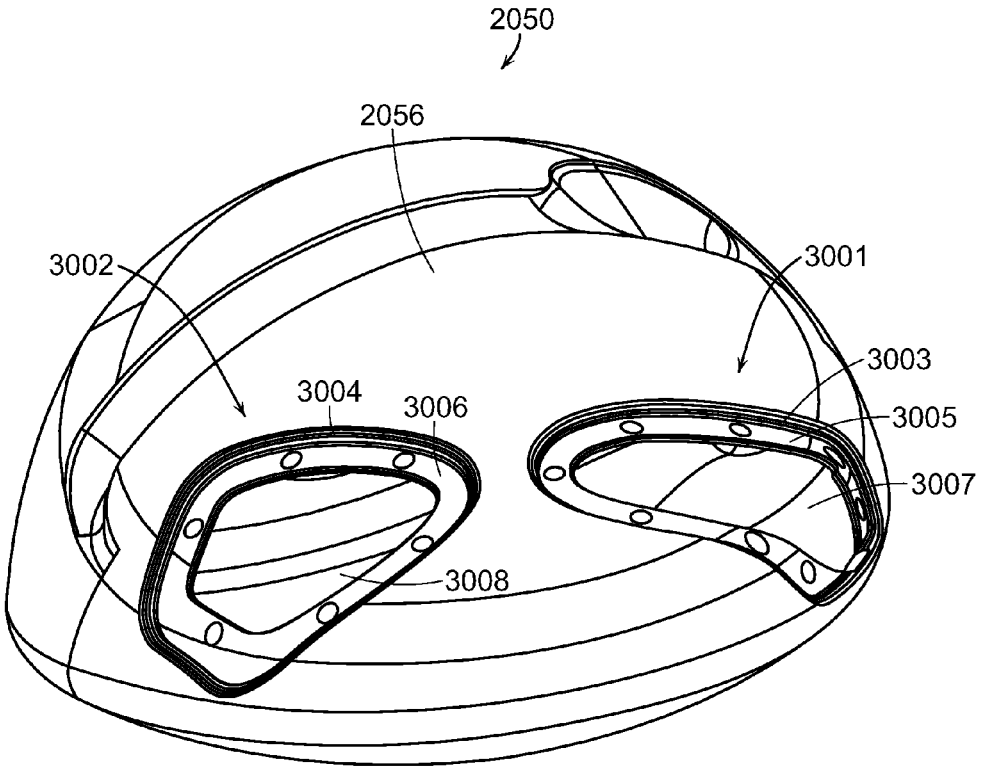
FIG. 92 illustrates an additional perspective view of the golf club head of FIG. 91.
Figure 93:
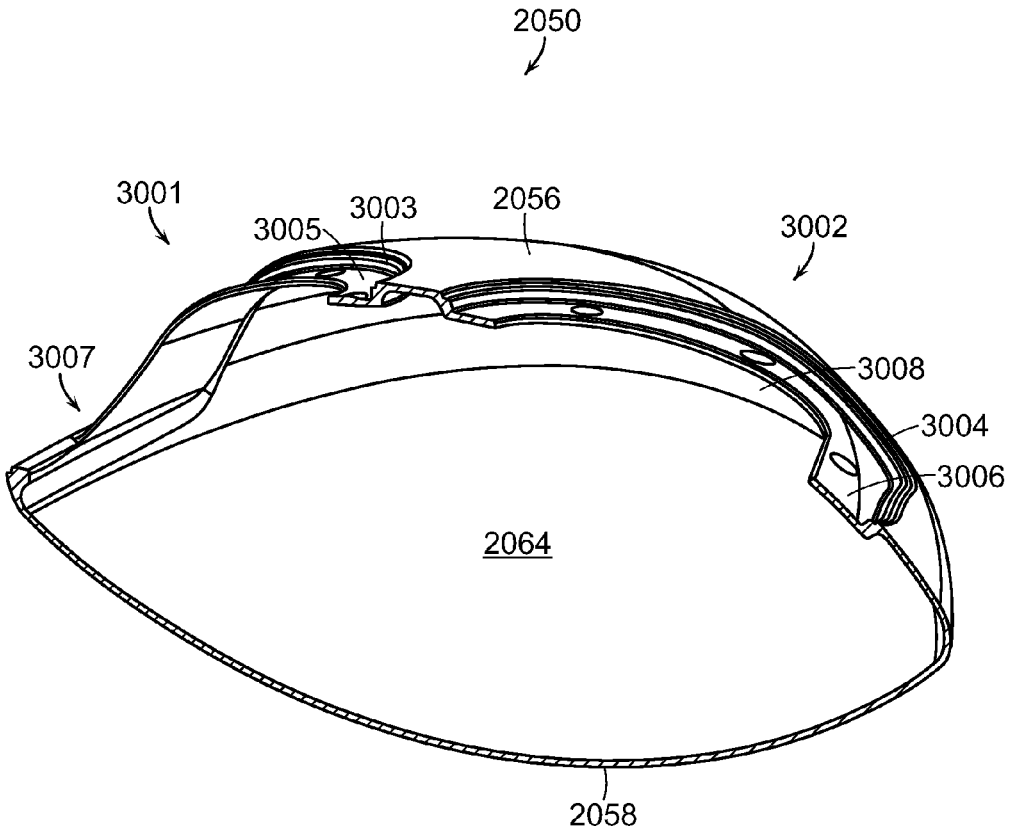
FIG. 93 illustrates a cross-sectional view of the golf club head of FIG. 91.
Figure 94:
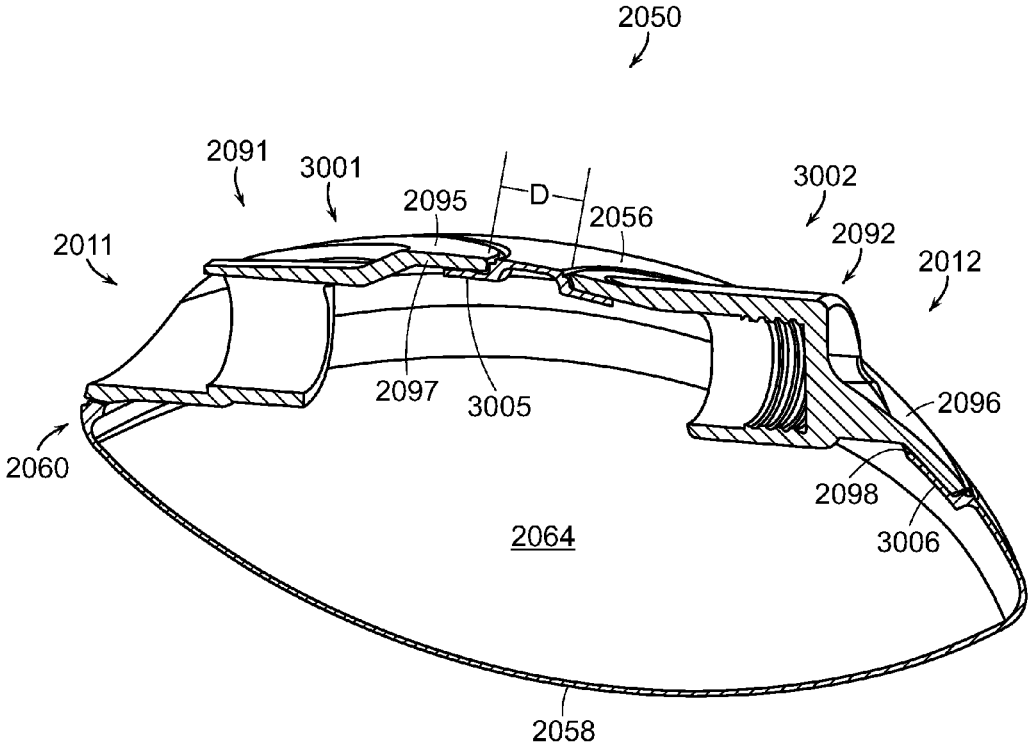
FIG. 94 illustrates a cross-sectional view of the golf club head of FIG. 79.
Figure 95:
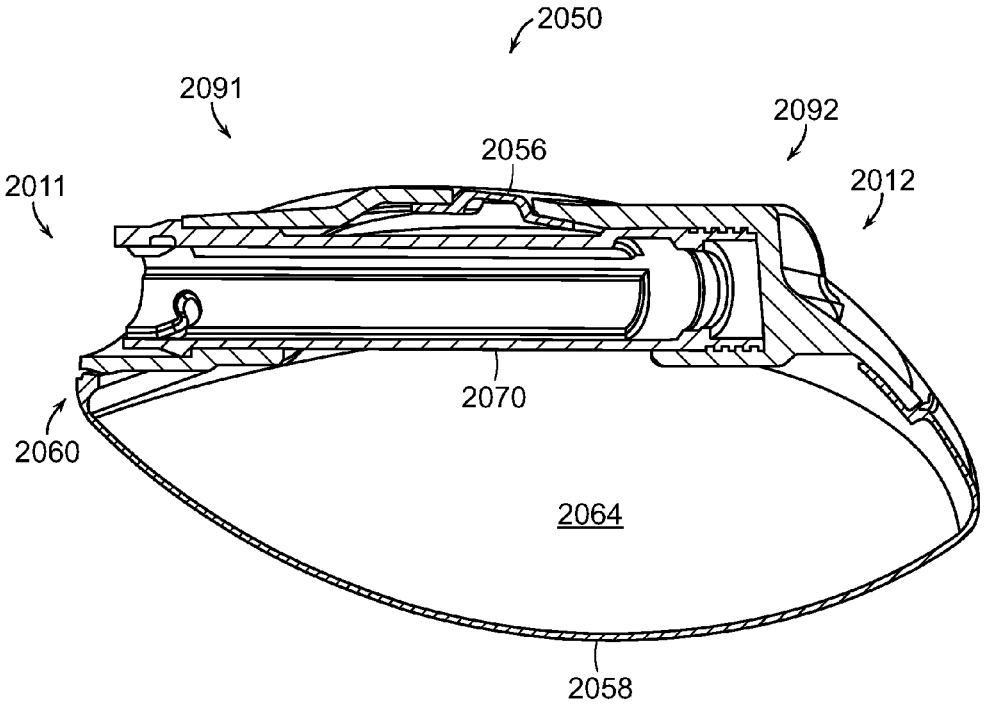
FIG. 95 illustrates a cross-sectional view of the golf club head of FIG. 87.

FIG. 87 illustrates a perspective view of the bottom of the golf club head 2050 of FIG. 78 including the third weight retention member of FIG. 81. FIG. 88 illustrates an additional perspective view of the golf club head 2050 of FIG. 87. FIG. 89 illustrates an additional perspective view of the golf club head 2050 of FIG. 87. FIG. 90 illustrates an additional perspective view of the golf club head 2050 of FIG. 87. FIG. 91 illustrates a perspective view of the bottom of the golf club head 2050 without the weight retention system. FIG. 92 illustrates an additional perspective view of the golf club head 2050 of FIG. 91. FIG. 93 illustrates a cross-sectional view of the golf club head 2050 of FIG. 91. FIG. 94 illustrates a cross-sectional view of the golf club head 2050 of FIG. 79. FIG. 95 illustrates a cross-sectional view of the golf club head 2050 of FIG. 87.

In the illustrated embodiments, the first weight retention member 2091 is formed separately from the second weight retention member 2092. The third weight retention member 2070 can be formed separately from both the first weight retention member 2091 and second weight retention member 2092 as illustrated. In an additional embodiment, the third weight retention member 2070 can be formed integrally with the first weight retention member 2091. In another additional embodiment, the third weight retention member 2070 can be formed integrally with the second weight retention member 2092. In a preferred embodiment, the third weight retention member 2070 is affixed to the first weight retention member 2091 and second weight retention member 2092 after the first weight retention member 2091 and second weight retention member 2092 have been affixed to the golf club head 2050.

As illustrated in FIGS. 91-93, the golf club head 2050 includes a first receptacle 3001 and a second receptacle 3002. The first receptacle 3001 is configured to receive and permanently couple to the first weight retention member 2091 and the second receptacle 3002 is configured to receive and permanently couple to the second weight retention member 2092. Each receptacle 3001, 3002 can include a shelf 3005, 3006 which forms an exterior surface recessed towards the interior 2064 of the golf club head 2050 relative to the outer surface of the golf club head 2050. As illustrated in FIGS. 91-93, the shelves 3005, 3006 are recessed relative to the sole 2056. In other embodiments, not illustrated, the receptacles may not be recessed. The receptacles 3001, 3002 can include perimeter walls 3003, 3004 connecting the shelves 3005, 3006 to the golf club head 2050. The receptacles 3001, 3002 can also include apertures 3007, 3008 exposing the golf club head interior 2064 to the exterior of the golf club head when the weight retention members 2091, 2092 are not installed.

As illustrated in FIG. 94, the weight retention members 2091, 2092 can be configured to reside in their respective receptacles 3001, 3002. The interior surfaces 2097, 2098 of the weight retention members 2091, 2092 can be configured to abut the shelves 3005, 3006 of the receptacles 3001, 3002. Additionally, the perimeter walls 3003, 3004 surround at least a portion of the weight retention members 2091, 2092 helping to hold them in place. In a preferred embodiment, the interior surfaces 2097, 2098 are permanently affixed to the receptacles 3001, 3002. Affixation can be achieved via adhesives, for example. The receptacles 3001, 3002 allow for the weight retention members 2091, 2092 to be installed such that the outer surfaces 2095, 2096 are substantially flush with the outer surface of the golf club head 2050, or more specifically the sole 2056, as illustrated in FIGS. 86-88.

As illustrated in FIG. 95, once the first weight retention member 2091 is installed in the first receptacle 3001 and the second weight retention member 2092 is installed in the second receptacle 3002, the third weight retention member 2070 can be installed through the opening of the 2011 of the first weight retention member 2091 and engage the second weight retention member 2092. In some embodiments, the third weight retention member 2070, can couple the first weight retention member 2091 to the second weight retention member 2092, further increasing the strength of the weight retention system 2090. In some embodiments, and as illustrated in FIGS. 91-95, at least a portion of the shelf 3005 of the first receptacle 3001 can be inclined relative to at least a portion of the shelf 3006 of the second receptacle 3002, such that installation and engagement of the third weight retention member 2070 clamps the first weight retention member 2091 towards the second weight retention member 2092 and thus the first weight retention member 2091 against the first shelf 3005 and the second weight retention member 2092 against the second shelf 3006.

Forming the weight retention members 2092, 2092, 2070 separately from the golf club head 2050 and then permanently affixing them to the golf club head 2050, has advantages which include, for example, ease of manufacture, reduced weight, etc. The first weight retention member 2091, second weight retention member 2092 and third weight retention member 2070 can be made from a variety of lightweight materials which may include, for example, plastic, composite, aluminum, magnesium, fiber reinforced plastic, fiberglass reinforced plastic, carbon fiber reinforced plastic, resin, polymer, urethane, thermoplastics, engineering thermoplastics, polyetheretherketone, nylon, fiber impregnated nylon, etc. It is preferable the lightweight materials have a lower density than the material from which the majority of the golf club head 2050 is formed, which may include for example, titanium or steel. As illustrated in FIG. 94, it can be advantageous to have distance D, defined as the shortest distance between the first weight retention member 2091 and the second weight retention member 2092, to be greater than 5 millimeters.

In an alternative embodiment, not explicitly illustrated, the body of the golf club head can incorporate the second weight retention member into its construction. Such an embodiment could include a combination of the terminal end 412 illustrated in FIG. 50 with the first weight retention member 2091 and third weight retention member 2070 illustrated in FIGS. 79-83 and the first receptacle 3001 illustrated in FIG. 91.

One embodiment of a weight retention system is configured to receive a weighted insert 408 (see FIG. 86). The weight retention system can alternatively be configured to receive any of the other weighted inserts described herein. The weight retention system can include a weight retention member. The weight retention system can be located on the sole 2056 of the golf club head 2050. The weight retention system includes an opening and a terminal end. The opening is configured to receive the weighted insert 408 which then slides into the cavity of the weight retention system towards the terminal end. The weight retention member, much like the weight retention members 2091 and 2092 of FIGS. 87-90, can be formed separately from the golf club head 2050 of a lightweight material and affixed to the golf club head 2050.

The golf club head 2050 can include a receptacle configured to receive and permanently couple the weight retention member to the golf club head. In some embodiments, the receptacle can include an aperture exposing the golf club head interior to the exterior of the golf club head 2050 when the weight retention member is not installed. The receptacle can include a shelf configured to abut a portion of the weight retention member, the shelf being recessed from the outer surface of the golf club head. At least a portion of the shelf can be substantially parallel to the sole surface 2057 of the golf club head. The sole surface 2057 being the external surface of the sole 2056. In some embodiments, the shelf can be a curved surface. The receptacle can include a shelf at each end of the receptacle, more specifically, the receptacle can include a shelf at the opening end of the receptacle and a shelf at the terminal end of the receptacle. In another embodiment, the receptacle may not include an aperture and the shelf may run the length of the receptacle.

Additionally, the receptacle can include perimeter walls configured to retain the weight retention member. The perimeter walls can be formed at an angle to the sole surface. The perimeter walls can be substantially perpendicular to the sole surface. The receptacle can include a perimeter wall on each side of the receptacle. The perimeter walls can be substantially parallel to each other.

The weight retention member can include abutment surfaces including an interior surface configured to abut the shelf and side walls configured to abut the perimeter walls of the receptacle. Additionally, the weight retention member can include locating features to accurately locate the weight retention member within the receptacle. The locating features can be protrusions configured to abut the ends of the aperture of the receptacle. Additionally, the weight retention member can include an external portion configured to be visible from the exterior of the golf club head 2050. The external portion can be substantially flush with the sole surface 2057 of the golf club head. In other embodiments, the external portion 4096 can protrude proudly from the sole surface 2057.

In some embodiments the weight retention system can also include an additional weight retention member, similar to the third weight retention member 2070 illustrated in FIGS. 84 and 85. In some embodiments, the additional weight retention member can be formed separately from the weight retention member. In other embodiments, the additional weight retention member can be formed integrally with the weight retention member. The weight retention system can further include a head locking feature 2032 configured to lock and retain the weighted insert 408 within the weight retention system.

In additional embodiments (not illustrated), a golf club head can include a plurality of weight retention systems so that the golf club head can have one more weighted inserts releasably affixed to the golf club head. The weight members can be selectively installed in a preferred weight retention system or even swapped between weight retention systems to optimize the center of gravity for a player's swing. In other embodiments each weight retention system can be configured to couple a plurality of weighted inserts to the golf club head.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head comprising:

a body having a face, a sole, a crown, and a skirt joining said face, sole and crown;

a hollow golf club interior within said body;

said body having a coordinate system with an x-axis located horizontal to the club face, a y-axis located vertical to the club face, and a z-axis located through the club face;

said body having a center of gravity;

wherein said body comprises a first receptacle, said first receptacle comprising a first aperture;

wherein said body comprises a second receptacle, said second receptacle comprising a second aperture; and a weight retention system configured to receive a weighted insert, said weight retention system comprising:

a first weight retention member affixed to said first receptacle, said first weight retention member comprising an opening, at least a portion of said first weight retention member extending through said first aperture into said hollow golf club interior; and a second weight retention member affixed to said second receptacle, at least a portion of said second weight retention member extending through said second aperture into said hollow golf club interior;

wherein a majority of said body, by weight, is formed from a first material having a first density;

wherein said weighted insert comprises a heavy end and a lighter end, wherein said weight retention system is configured to receive said weighted insert in both a first configuration and a second configuration, wherein said first configuration comprises said heavy end of said weighted insert adjacent said second weight retention member and said second configuration comprises said lighter end of said weighted insert adjacent said second weight retention member;

wherein at least a portion of said first receptacle is located on said sole;

wherein at least a portion of said second receptacle is located on said sole;

wherein said first weight retention member is permanently affixed to said first receptacle and wherein said second weight retention member is permanently affixed to said second receptacle;

wherein said first receptacle includes a first shelf, wherein said first weight retention member includes an inner surface and an outer surface opposite said inner surface, wherein said inner surface of said first weight retention member abuts said first shelf, and wherein at least a portion of said outer surface of said first weight retention member is substantially flush with an external surface of said sole;

wherein said first weight retention member and said second weight retention member are formed from a second material, said second material having a second density and wherein said second density is less than said first density;

wherein said second receptacle comprises a second shelf, wherein at least a portion of said first shelf is angled relative to at least a portion of said second shelf, and wherein said first shelf and said second shelf are recessed towards said hollow golf club interior from said sole.

2. A golf club head comprising:

a body having a face, a sole, a crown, and a skirt joining said face, sole and crown;

a hollow golf club interior within said body;

said body having a coordinate system with an x-axis located horizontal to the club face, a y-axis located vertical to the club face, and a z-axis located through the club face;

said body having a center of gravity;

wherein said body comprises a first receptacle, said first receptacle comprising a first aperture, wherein at least a portion of said first receptacle is located on said sole;

wherein said body comprises a second receptacle, said second receptacle comprising a second aperture, wherein at least a portion of said second receptacle is located on said sole; and a weight retention system configured to receive a weighted insert, said weight retention system comprising:

a first weight retention member affixed to said first receptacle, said first weight retention member comprising an opening, at least a portion of said first weight retention member extending through said first aperture into said hollow golf club interior;

a second weight retention member affixed to said second receptacle, at least a portion of said second weight retention member extending through said second aperture into said hollow golf club interior; and wherein a majority of said body, by weight, is formed from a first material having a first density;

wherein said first weight retention member and said second weight retention member are formed from a second material, said second material having a second density;

wherein said second density is less than said first density.

3. The golf club head of claim 2, wherein at least a portion of said first receptacle and at least a portion of said second receptacle are located on said skirt.

4. The golf club head of claim 2, wherein said first weight retention member is permanently affixed to said first receptacle and wherein said second weight retention member is permanently affixed to said second receptacle.

5. The golf club head of claim 2, wherein said first receptacle includes a first shelf, wherein said first weight retention member includes an inner surface and an outer surface opposite said inner surface, wherein said inner surface of said first weight retention member abuts said first shelf, and wherein at least a portion of said outer surface of said first weight retention member is substantially flush with an external surface of said sole.

6. The golf club head of claim 5, wherein said second receptacle comprises a second shelf, wherein at least a portion of said first shelf is angled relative to at least a portion of said second shelf.

7. The golf club head of claim 6, wherein said first shelf and said second shelf are recessed towards said hollow golf club interior from said sole.

8. The golf club head of claim 2, wherein said first weight retention member and said second weight retention member are formed fiber reinforced plastic.

9. The golf club head of claim 2, wherein said weighted insert comprises a heavy end and a lighter end, wherein said weight retention system is configured to receive said weighted insert in both a first configuration and a second configuration, wherein said first configuration comprises said heavy end of said weighted insert adjacent said second weight retention member and said second configuration comprises said lighter end of said weighted insert adjacent said second weight retention member.

10. The golf club head of claim 2, wherein said first weight retention member is located on a heel side of said golf club head and said second weight retention member is located on a toe side of said golf club head.

11. The golf club head of claim 2, wherein said second weight retention member comprises a bore, said bore comprising internal threads.

12. A golf club head comprising:

a body having a face, a sole, a crown, and a skirt joining said face, sole and crown;

a hollow golf club interior within said body;

said body having a coordinate system with an x-axis located horizontal to the club face, a y-axis located vertical to the club face, and a z-axis located through the club face;

said body having a center of gravity;

wherein said body comprises a first receptacle, said first receptacle comprising a first aperture, wherein at least a portion of said first receptacle is located on said sole;

wherein said body comprises a second receptacle, said second receptacle comprising a second aperture, wherein at least a portion of said second receptacle is located on said sole; and a weight retention system configured to receive a weighted insert, said weight retention system comprising:

a first weight retention member affixed to said first receptacle, said first weight retention member comprising an opening, at least a portion of said first weight retention member extending through said first aperture into said hollow golf club interior;

a second weight retention member affixed to said second receptacle, at least a portion of said second weight retention member extending through said second aperture into said hollow golf club interior; and wherein a majority of said body, by weight, is formed from a first material having a first density;

wherein said weighted insert comprises a heavy end and a lighter end, wherein said weight retention system is configured to receive said weighted insert in both a first configuration and a second configuration, wherein said first configuration comprises said heavy end of said weighted insert adjacent said second weight retention member and said second configuration comprises said lighter end of said weighted insert adjacent said second weight retention member.

13. The golf club head of claim 12, wherein at least a portion of said first receptacle and at least a portion of said second receptacle are located on said skirt.

14. The golf club head of claim 12, wherein said first weight retention member is permanently affixed to said first receptacle and wherein said second weight retention member is permanently affixed to said second receptacle.

15. The golf club head of claim 12, wherein said first receptacle includes a first shelf, wherein said first weight retention member includes an inner surface and an outer surface opposite said inner surface, wherein said inner surface of said first weight retention member abuts said first shelf, and wherein at least a portion of said outer surface of said first weight retention member is substantially flush with an external surface of said sole.

16. The golf club head of claim 15, wherein said second receptacle comprises a second shelf, wherein at least a portion of said first shelf is angled relative to at least a portion of said second shelf, and wherein said first shelf and said second shelf are recessed towards said hollow golf club interior from said sole.

17. The golf club head of claim 12, wherein said first weight retention member and said second weight retention member are formed fiber reinforced plastic.

18. The golf club head of claim 12, wherein said first weight retention member and said second weight retention member are formed from a second material, said second material having a second density and wherein said second density is less than said first density.

19. The golf club head of claim 12, wherein said first weight retention member is located on a heel side of said golf club head and said second weight retention member is located on a toe side of said golf club head.

20. The golf club head of claim 12, wherein said second weight retention member comprises a bore, said bore comprising internal threads.

* * * * *